US006108021A

United States Patent [19]

Morikawa et al.

[11] Patent Number: 6,108,021

[45] **Date of Patent: *Aug. 22, 2000**

[54] IMAGE FORMING METHOD AND APPARATUS, AND IMAGE RECORDING AND INDICATING APPARATUS

[75] Inventors: Minoru Morikawa; Yasuo Katano; Shinji Tanaka, all of Kanagawa, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/953,718

[22] Filed: Oct. 17, 1997

[51] Int. Cl.[7] ..... B41J 2/32

[52] U.S. Cl. ..... 347/221

[58] Field of Search ..... 347/171, 172, 347/221; 503/201

[56] References Cited

U.S. PATENT DOCUMENTS

| | | | |
|---|---|---|---|
| 5,175,568 | 12/1992 | Oyamaguchi et al. | 347/113 |
| 5,177,506 | 1/1993 | Katano | 347/113 |
| 5,200,762 | 4/1993 | Katano et al. | 347/221 |
| 5,278,126 | 1/1994 | Katano et al. | 503/201 |
| 5,335,001 | 8/1994 | Katano | 347/183 |
| 5,369,421 | 11/1994 | Tomono et al. | 347/172 |
| 5,436,642 | 7/1995 | Oyamaguchi et al. | 347/221 |
| 5,471,234 | 11/1995 | Katano et al. | 347/171 |

FOREIGN PATENT DOCUMENTS

| | | |
|---|---|---|
| 3-178478 | 8/1991 | Japan . |
| 6-286299 | 10/1994 | Japan . |

*Primary Examiner*—N. Le
*Assistant Examiner*—Anh T. N. Vo
*Attorney, Agent, or Firm*—Oblon, Spivak, McClelland, Maier & Neustadt, P.C.

[57] ABSTRACT

A recording body is used which includes a base material and a recording material having characteristics of the wettability change by heating, the recording material being coated on the base material so as to form a recording surface. The image forming method includes the steps of a) heating the recording surface of the recording body in liquid; and b) partially heating the recording surface in air so as to form a latent image.

24 Claims, 29 Drawing Sheets

NEGA-POSI REVERSE IMAGE

IMAGE PORTION

NON-IMAGE PORTION

ORDINARY NEGA-POSI IMAGE

IMAGE PORTION

NON-IMAGE PORTION

DEFINITION OF IMAGE PORTION AND NON-IMAGE PORTION

RECEDING CONTACT ANGLE OF ENTIRE SURFALE DECREASES

RECEDING CONTACT ANGLE PARTIALLY INCREASES

RECORDING BODY ON WHICH NEGA-POSI-REVERSE LATENT IMAGE HAS BEEN FORMED

NON-IMAGE PORTION HAS BEEN DEVELOPED WITH WATER (BY LIQUID APPYING ROLLER)

IMAGE PORTION HAS BEEN DEVELOPED WITH OIL BASED INK (BY DEVELOPING ROLLER)

RECORDING BODY ON WHICH NEGA-POSI-REVERSE LATENT IMAGE HAS BEEN FORMED

NON-IMAGE PORTION HAS BEEN DEVELOPED WITH OIL (BY LIQUID APPYING ROLLER)

IMAGE PORTION HAS BEEN DEVELOPED WITH WATER BASED INK (BY DEVELOPING ROLLER)

HEATING
LIQUID
RECORDING BODY MATERIAL LAYER
BASE PLATE
HOT PLATE
42
40
41
41a
41b

COOLING
42
41a 41b
41

LIQUID ATTRACTION STATE FORMING COMPLETION
41b
41a
41

LATENT IMAGE FORMING
43
41
FIG. 13E2
DEVELOPMENT
41
46
44B
FIG. 13E1
DEVELOPMENT
INK ROLLER
44A
46
41

RECORDING BODY
LIQUID LAYER HOLDING LAYER
41
57

· PPC
· LASER PRINTER
· THERMAL TRANSFER PRINTER
· INK-JET PRINTER
· TONER-JET PRINTER
· OTHERS
FIG. 20C1
FIG. 20C2
BASE PLATE OF ROCORDING BODY: THERMOCHROMIC TRANSPARENT FILM

FIG. 23A1
TRANSPARENT BASE PLATE
LIGHT ABSORBING LAYER
TRANSPARENT FILM
PAPER ORIGNAL IMAGE SHEET
48
41
41a
41c
46
47
60
FIG. 23A2
46
47
60
61
HEATER
FIG. 23A3
46
47
60
62
HEATING ROLLER 48
46
60
41
TRANSPARENT FILM WITH TRANSFERED IMAGE
RECORDING BODY

IMAGE INCLUDING LIGHT ABSORBING MATERIAL (INK, TONER, ETC)
47
46
48
63
PAPER ORIGINAL IMAGE SHEET
THERMOCHROMIC TRANSPARENT FILM
THERMOCHROMIC TRANSPARENT FILM WITH TRANSFERRED IMAGE
48
63
41
RECORDING BODY

FIG.30B1
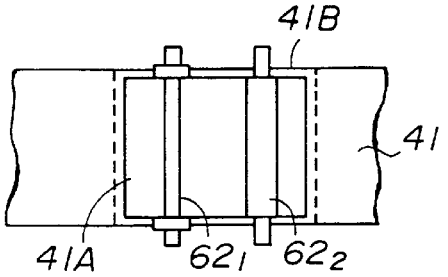
FIG.30B2
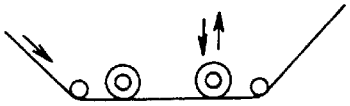
FIG.30C1
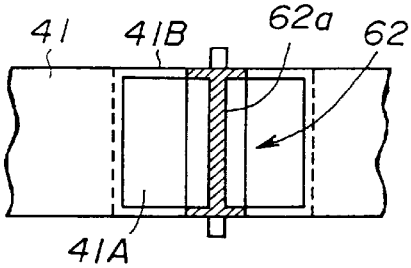
FIG.30C2
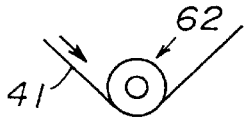
FIG.30A
ALL SURFACE IS IN LQUID ATTRACTION STATE
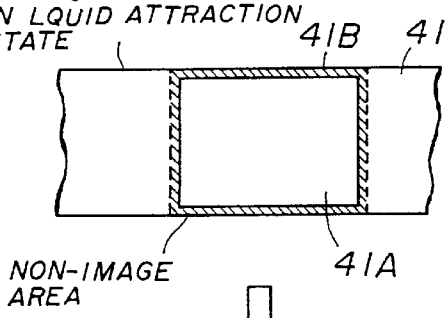
FIG.30D1
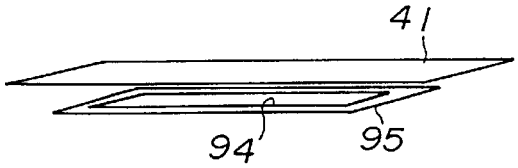
FIG.30D2
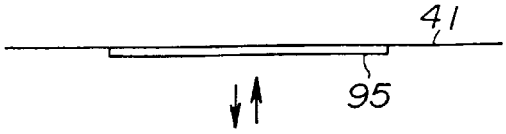
FIG.30E1
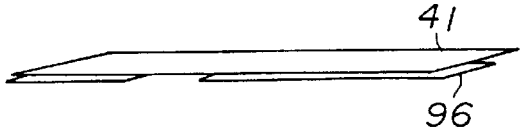
FIG.30E2
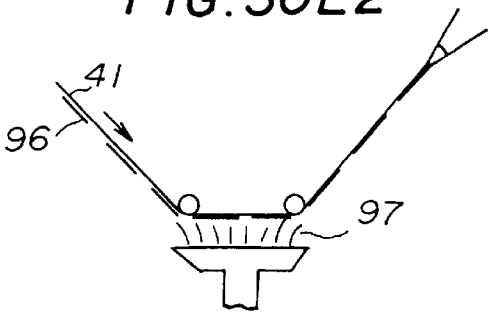

IMAGE FORMING METHOD AND APPARATUS, AND IMAGE RECORDING AND INDICATING APPARATUS

BACKGROUND OF THE INVENTION

1. Field of the Invention

The present invention relates to an image forming method and apparatus, and an image recording apparatus using the principle of the image forming method and apparatus. In detail, the present invention relates to an image forming method and apparatus using the characteristics of the wettability change by heating, and an image recording and indicating apparatus using the principle of the image forming method and apparatus.

2. Description of the Related Art

As a new recording process, an image recording method using the characteristics of the wettability change by heating has been known (for example, Japanese Laid-Open Patent Application No. 3-178478). Such an image recording method uses the property that the receding contact angle of the top surface of a base material, which has polyfluoroalkyl-acrylates applied thereto, increases when the base material is heated in air, and the receding contact angle of the top surface of the base material decreases when the base material is heated in liquid.

FIG. 1 illustrates an outline of a latent image forming method using the above-described characteristics of the wettability change by heating. In this latent image forming method, as shown in FIG. 1, a recording body 110 includes a base material 111 and a recording material 112 coated on the top surface of the base material 111. The recording material is formed of a material (the material having the characteristics of the wettability change by heating). The receding contact angle of this material changes in accordance with a heating temperature when the material is heated in a condition where the material is in contact with liquid, a solid, or a solid which becomes liquid when heated. A contact liquid (contact member) 113 is caused to come into contact with the top surface of the recording body 110, the top surface being the surface on which the above-mentioned recording material 112 has been coated. Then, the thus-coated surface of the recording body 110 is selectively heated by heating means (not shown in FIG. 1). Thus, a latent image is formed on the recording material 112, and this latent image is developed using a developer such as ink.

FIG. 2 shows a method of forming a latent image on the recording material proposed in Japanese Laid-Open Patent Application No. 3-178478. As shown in FIG. 2, in a condition where the outer surface of the recording body 110 is in contact with the contact member 113, using a heating device 114 such as a thermal head, the outer surface of the recording body 110 is selectively heated. Then, the recording body 110 is cooled in a condition in which the contact member 113 is in contact with the outer surface of the recording body 110. Thereby, a condition where only the portions which have been selectively heated get wet (hereinafter, referred to as a liquid attraction state) is formed. Thus, a latent image is formed. This latent image is developed by a developing means 115 and is transferred to a recording paper sheet 120 by a transfer means 116. The recording body 110 is rotated in the direction of the arrow, is cleaned by a cleaning roller 117, the image is cleared by a image removing heater 118, and, then, subsequent recording is performed as described above. Thus, in the recording method in the related art, in latent image formation, it is necessary to heat the recording body in the condition in which liquid, a solid which becomes liquid by steam or heating, or a solid which generates liquid or steam (hereinafter, referred to as a contact member) is in contact with the surface of the recording body. Further, it is also necessary to cool the recording body in the condition where the contact member is in contact with the surface of the recording body.

The arrangement that the surface of the recording body and the heating device are directly in contact with one another consumes little heat energy, and also, the sharpness of an image is high. However, a very fine contact heating device such as a thermal head includes electronic components and electric wiring. Accordingly, durability of the head against liquid is not high, and therefore, the device may be damaged. Further, it is necessary to supply the contact member, such as liquid, in the contact surface between the heating device and the surface of the recording body. A supply mechanism for this purpose is complicated. In order to solve these problems, the inventors of the present invention proposed that heating be performed from the rear side of the recording body in Japanese Laid-Open Patent Application No. 6-286299.

However, even in the proposed method, there are problems that the thickness of the recording body is limited, recording energy increases, and image degradation due to thermal diffusion occurs during heat conduction from the rear side to the front side of the recording body. Further, considering non-contact heating arrangements such as that using laser and so forth, the layer holding the contact member on the recording body needs to transmit light. Accordingly, a mechanism therefor is complicated. Thus, when selective heating is performed based on image information in the condition where the contact member such as liquid is in contact with the recording body, there are problems that the heating device is damaged due to the contact member or a mechanism for supplying the contact member is complicated.

In the above-described related art, the recording body is selectively heated while the contact liquid is being supplied when a latent image is formed. Even when any heating method is used, it is difficult to provide a stable supply of the contact liquid.

SUMMARY OF THE INVENTION

The present invention has been devised in consideration of an actual situation such as that described above. An object of the present invention is to provide an image forming method and apparatus which use a novel principle that a supply of the contact liquid is not needed when a latent image is formed.

An image forming method in a first aspect of the present invention uses a recording body which comprises a base material and a recording material having the characteristics of the wettability change by heating, the recording material being coated on the base material so as to form a recording surface, the method comprising the steps of:

a) heating the entirety of the recording surface of the recording body in liquid; and b) then partially heating the recording surface in air so as to form a latent image.

An image forming apparatus in a second aspect of the present invention uses a recording body which comprises a base material and a recording material having the characteristics of the wettability change by heating, the recording material being coated on the base material so as to form a recording surface, the apparatus comprising:

in-liquid heating means for heating the entirety of the recording surface of the recording body in liquid;

in-air heating mean for heating the recording surface in air, after the in-liquid heating means has heated the entirety of the recording surface in liquid, so as to form a latent image on the recording surface; and developing means for causing a recording agent to come into contact with the recording surface, after the in-air heating means has heated the recording surface, so as to develop the latent image and form a developed image.

The image forming apparatus in the present invention in a third aspect according to the present invention in the second aspect further comprises lighting means which is provided at the rear side of the recording body and lights the developed image from the rear side of the recording body.

An image recording apparatus in the present invention in a fourth aspect uses a recording body which comprises a base material and a recording material having the characteristics of the wettability change by heating, the recording material being coated on the base material so as to form a recording surface, the apparatus comprising:

in-liquid heating means for heating the entirety of the recording surface of the recording body in liquid;

in-air heating mean for heating the recording surface in air, after the in-liquid heating means has heated the entirety of the recording surface in liquid, so as to form a latent image;

developing means for causing a recording agent to come into contact with the recording surface after the in-air heating means has heated the recording surface, so as to develop the latent image and form a developed image; and transferring means for transferring the developed image on the recording surface of the recording body to a recording paper sheet.

The image recording apparatus in the present invention in a fifth aspect according to the present invention in the fourth aspect, wherein:

the recording material of the recording body contains water attraction material;

the apparatus further comprises liquid applying means for applying water or liquid which mainly includes water to the recording surface before developing by the developing means; and the developing means performs developing with oil based ink.

The image recording apparatus in the present invention in a sixth aspect according to the present invention in the fourth aspect, wherein:

the recording material of the recording body contains oil attraction material;

the apparatus further comprises oil applying means for applying oil to the recording surface before developing by the developing means; and the developing means performs developing with water based ink.

An image forming method in the present invention in a seventh aspect uses a recording body which has characteristics that a receding contact angle of a recording surface of the recording body decreases when the recording surface is heated and also is in contact with liquid, and the receding contact angle increases when the recording surface is heated without contact with the liquid, the method also uses a contact member which is selected from among liquid, steam, and solid which becomes liquid or generates liquid or steam in a temperature equal to or less than the receding contact angle decrease starting temperature, the method comprising the steps of:

a) heating the recording surface of the recording body in a condition where the recording surface is in contact with the contact member, or causing the recording surface of the recording body to come into contact with the contact member in a condition where the recording surface is heated, so as to cause the receding contact angle of the entirety of the recording surface of the recording body to decrease and cause the entirety of the recording surface to be in a liquid attraction state; and b) selectively heating a non-image portion of the recording surface of the recording body in a condition where the recording surface is not in contact with the contact member so as to form a latent image In the image recording method in the present invention in an eight aspect according to the present invention in the seventh aspect, the recording body comprises a base plate and a recording layer having the characteristics, and the recording body has a light absorbing layer in or on the base plate when means for heating the recording surface of the recording layer comprises optical means.

In the image recording method in the present invention in a ninth aspect according to the present invention in the seventh aspect, the recording body comprises a base plate and a recording layer having the characteristics, and the recording body has minute particles of a light absorbing member in the recording layer when means for heating the recording surface of the recording layer comprises optical means.

In the image recording method in the present invention in a tenth aspect according to the present invention in the seventh aspect, the recording body removably has the contact member holding layer on the recording surface which is in the liquid attraction state, when the recording body is preserved.

In the image recording method in the present invention in an eleventh aspect according to the present invention in the seventh, eighth or ninth aspect, the step b) comprises the steps of:

b-1) forming a non-light-transmitting image in or on the base plate; and b-2) exposing the recording body from the image side, so as to form a latent image on the recording surface of the recording layer.

In the image recording method in the present invention in a twelfth aspect according to the present invention in the eleventh aspect, the step b) comprises the steps of:

b-1) forming a non-light-transmitting image in or on the base plate; and b-2) exposing the recording body from the image side, in a condition where the recording body removably has the contact member holding layer on the recording surface of the recording layer, so as to form a latent image on the recording surface of the recording layer.

In the image recording method in the present invention in a thirteenth aspect according to the present invention in the seventh, eighth, or ninth aspect, the step b) comprises the steps of:

b-1) placing an original image paper sheet impregnated with liquid on the base plate or on the recording surface of the recording layer; and b-2) exposing the recording body from the original image paper sheet side so as to form a latent image on the recording surface of the recording layer.

In the image recording method in the present invention in a fourteenth aspect according to the present invention in the thirteenth aspect, in the step b-1), a liquid cutting off layer having transparency is inserted between the original image paper sheet and the recording layer.

In the image recording method in the present invention in a fifteenth aspect according to the present invention in the seventh, eighth, or ninth aspect, the step b) comprises the steps of:

b-1) melting and transferring recording agent of an original image sheet to a transparent film;

b-2) placing the transparent film on the recording body;

b-3) exposing the recording body from the transparent film side so as to form a latent image on the recording surface of the recording body.

In the image recording method in the present invention in a sixteenth aspect according to the present invention in the seventh, eighth or ninth aspect, the step b) comprises the steps of:

b-1) placing a thermochromic transparent film, having a thermochromic layer, on an original image sheet;

b-2) exposing the thermochromic transparent film and the original image sheet and thus forming on the thermochromic transparent film the image the same as the image of the original image sheet;

b-3) placing the thermochromic transparent film on the recording body;

b-4) exposing the recording body from the thermochromic transparent film side so as to form a latent image on the recording surface of the recording body.

In the image recording method in the present invention in a seventeenth aspect according to the present invention in the seventh aspect, the step a) comprises the steps of:

a-1) causing the entirety of the recording surface of the recording body, which recording surface is in a liquid repelling state or has an image formed thereon, to be in contact with liquid which has been heated to a temperature equal to or more than the receding contact angle decrease starting temperature; and a-2) cooling the recording body in a condition where the liquid is in contact with the entirety of the recording surface of the recording body.

In the image recording method in the present invention in an eighteenth aspect according to the present invention in the seventeenth aspect, the recording body is heated in a condition where liquid is in contact with the recording surface of the recording body using a removable liquid layer holding means, and then, the recording body is cooled in the same condition.

In the image recording method in the present invention in a nineteenth aspect according to the present invention in the eighteenth aspect, the removable liquid layer holding means has transparency and a heating source for heating the recording surface of the recording body comprises optical means.

In the image recording method in the present invention in an twentieth aspect according to the present invention in the seventeenth aspect, means for cleaning the recording surface of the recording body is commonly used for forming the liquid attraction state on the recording surface of the recording body.

In the image recording method in the present invention in the twenty-first aspect according to the present invention in the seventh or seventeenth aspect, the step a) causes only an image area, excluding the margin area, to be in the liquid attraction state.

The image recording method in the present invention in a twenty-second aspect according to the present invention in the seventh or seventeenth aspect, further comprises the step of c) heating only the margin area of the recording surface of the recording body, in a condition where the margin area is not in contact with the contact member, after the step a) and before the step b).

An image recording and indicating apparatus in the present invention in a twenty-third aspect uses a recording body which has characteristics that a receding contact angle of a recording surface of the recording body decreases when the recording surface is heated and is also in contact with liquid, and the receding contact angle increases when the recording surface is heated without contact with the liquid, the method also using a contact member which is selected from among a liquid, steam, and a solid which becomes liquid or generates liquid or steam at a temperature equal to or less than the receding contact angle decrease starting temperature, the apparatus comprising:

means for heating the recording surface of the recording body in a condition where the recording surface is in contact with the contact member, or causing the recording surface of the recording body to come into contact with the contact member in a condition where the recording surface is heated, so as to cause the receding contact angle of the entirety of the recording surface of the recording body to decrease and cause the entirety of the recording surface to be in a liquid attraction state; and means for selectively heating a non-image portion of the recording surface of the recording body in a condition where the recording surface is not in contact with the contact member so as to form a latent image on the recording surface of the recording body, after the entirety of the recording surface has been in a liquid attraction state;

means for developing the latent image on the recording surface of the recording body with coloring material; and means for removing the coloring material from the recording surface of the recording body.

The image recording and indicating apparatus in the present invention in a twenty-fourth aspect according to the present invention in the twenty-third aspect, further comprises one of a light emitting mechanism or a light reflecting mechanism at the rear side of the recording body.

In the present invention in the first aspect, when a latent image is formed, a contact liquid is not needed.

In the present invention in the second aspect, when a latent image is formed, a contact liquid is not needed and the arrangement of the latent image forming portion can be simplified.

In the present invention in the third aspect, the developed image as it is indicated and is optically emphasized or enhanced as a result of the image portion being lighted from the rear side of the recording body by the light-emitting means or the optical means.

In the present invention in the fourth aspect, the latent image forming portion is simplified and the developed image is transferred to a recording paper sheet.

In the present invention in the fifth aspect, the development is performed using oil based ink. In this method, it is possible to use a nega-posi-reverse latent image and output an ordinary nega-posi image.

In the present invention in the sixth aspect, the development is performed using water based ink. In this method, it is possible to use a nega-posi-reverse latent image and output an ordinary nega-posi image.

In the present invention in the seventh aspect, when a latent image is formed, supply of the contact member is not needed. Thus, a simple arrangement of a dry latent image formation is possible. Thus, the arrangement is simplified, and the operation is very simplified. Further, printing energy can be reduced.

In the present invention in the eighth aspect, an inexpensive flash exposing device can be used in the seventh aspect. Thus, the costs of the apparatus can be reduced, and the arrangement of the apparatus can be simplified.

In the present invention in the ninth aspect, in comparison to the present invention in the eighth aspect, light dispersion in the base plate can be reduced when the exposure is performed. Thereby, image quality can be improved In the present invention in the tenth aspect, the entirety of the recording surface wet state of the recording body (master printing plate) in the seventh aspect can be kept when the recording body (master printing plate) is transported or preserved.

In the present invention in the eleventh aspect, light dispersion occurring between the original image sheet and the recording body (master printing plate) can be eliminated in the seventh, eighth and ninth aspects. Thereby, a high-quality image can be obtained.

In the present invention in the twelfth aspect, because the liquid attraction state of the recording surface of the recording body is protected, a heating mechanism can be used for forming an image in the base plate or on the rear surface of the base plate in the eleventh aspect. Thereby, it is possible to form a fine image in the base plate or the rear surface of the base plate. Thus, image quality can be improved.

In the present invention in the thirteenth aspect, an original image paper sheet itself can be used in the present invention in the seventh, eighth and ninth aspects.

In the present invention in the fourteenth aspect, light dispersion occurring inside the paper sheet and adhering of liquid to the recording surface of the recording body can be prevented in the thirteenth aspect. Thereby, a latent image in accordance with the original image can be formed, and thus, a high-quality image can be obtained.

In the present invention in the fifteenth aspect, an original image paper sheet can be used in a dry condition in the seventh, eighth and ninth aspects.

In the present invention in the sixteenth aspect, an original image paper sheet can be used in a dry condition without damaging the original image of the original image paper sheet in the seventh, eighth and ninth aspects.

In the present invention in the seventeenth aspect, it is possible to produced and renew a large amount of the recording body (master printing plate) with the entire recording surface in the liquid attraction state, at high speed, in the seventh aspect. Further, a seamless master printing plate in a machine can be caused to be in the liquid attraction state without removing the seamless master printing plate from the machine.

In the present invention in the eighteenth aspect, a small amount of liquid is needed, and heating and cooling can be performed within a short time in the seventeenth aspect. Accordingly, the present invention in the eighteenth aspect can efficiently renew a small master printing plate, and thus, it suitable for a private-use master printing plate manufacturing method.

In the present invention in the nineteenth aspect, a flash used for forming a latent image is also used for forming the liquid attraction state (for renewing the recording body (master printing plate)) in the eighteenth aspect.

In the present invention in the twentieth aspect, the process of manufacturing and renewing the recording body original printing sheet can be simplified in the seventeenth aspect.

In the present invention in the twenty-first aspect, heating of the non-image area (margin area) is prevented in the seventh and seventeenth aspects. Thereby, heat energy can be reduced. Further, when printing, ink does not adhere to the margin area. Thereby, when the printing plate is again used, a work load of by a cleaning mechanism can be reduced.

Also in the present invention in the twenty-second aspect, heating of the non-image area (margin area) is prevented in the seventh and seventeenth aspects. Thereby, heating energy can be reduced. Further, when printing, ink does not adhere to the margin area. Thereby, when the printing plate is again used, a load of a cleaning mechanism can be reduced, and manufacturing and renewing of the original printing sheet can be accurately and easily performed.

In the twenty-third aspect of the present invention, after developing a latent image on the recording surface of the recording body with coloring material, the coloring material on the recording surface is removed. Thereby, it is possible to repeat different image indication one by one. Further, the arrangement of the apparatus is simple.

In the twenty-fourth aspect of the present invention, indication performance in the twenty-third aspect can be improved (contrast of the image can be improved).

Other objects and further features of the present invention will become more apparent from the following detailed description when read in conjunction with the accompanying drawings.

BRIEF DESCRIPTION OF THE DRAWINGS

FIGS. 13A, 13B, 13C, 13D, 13E1 and 13E2 show a process for illustrating the present invention in the seventh aspect;

FIGS. 20A, 20B, 20C1 and 20C2 illustrate the present invention in a twelfth aspect;

FIGS. 23A1, 23A2, 23A3 and 23B illustrate the present invention in a fifteenth aspect;

FIGS. 29A, 29B1, 29B2, 29C1, 29C2, 29D1 and 29D2 illustrate the present invention in a twenty-first aspect;

FIGS. 30A, 30B1, 30B2, 30C1, 30C2, 30D1, 30D2, 30E1 and 30E2 illustrate the present invention in a twenty-second aspect;

DETAILED DESCRIPTION OF THE PREFERRED EMBODIMENTS

Figure 3B:
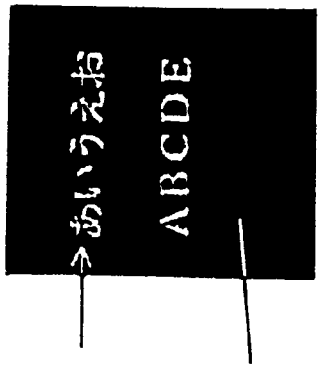
FIGS. 3A and 3B define an image portion and a non-image portion in an image.
Figure 3A:
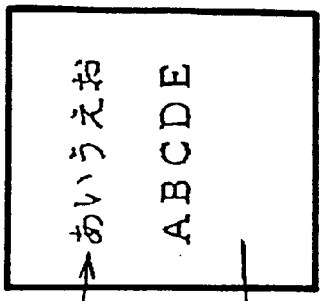

Each embodiment of the present invention will now be described. In each embodiment, the recording body is formed by diluting poly-fluoroalkyl-acrylates TG-702 (made by Daikin Industries Ltd.) with freon, and coating the resulting substance on a matted polyimide film (in embodiments 1-2 and 1-4, carbon (C) is contained in the polyimide film so as to improve laser absorbability). The above-mentioned polyimide film is transparent or semitransparent (in the embodiments 1-2 and 1-4) and the thickness thereof is 20 $\mu$m. An image portion and a non-image portion will now be defined. Whether letters are white letters or black letters, a letter portion is referred to as an image portion and a background portion is referred to as a non-image portion. The image shown in FIG. 3A is referred to as a nega-posi image, and the image shown in FIG. 3B is referred to as a nega-posi-reverse image.

Description of the Present Invention in the First Aspect

Figure 4A:
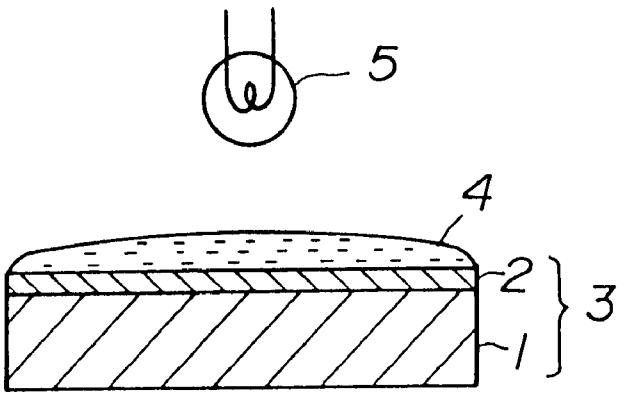
FIGS. 4A and 4B illustrate a partial arrangement of the present invention in a first aspect.
Figure 4B:
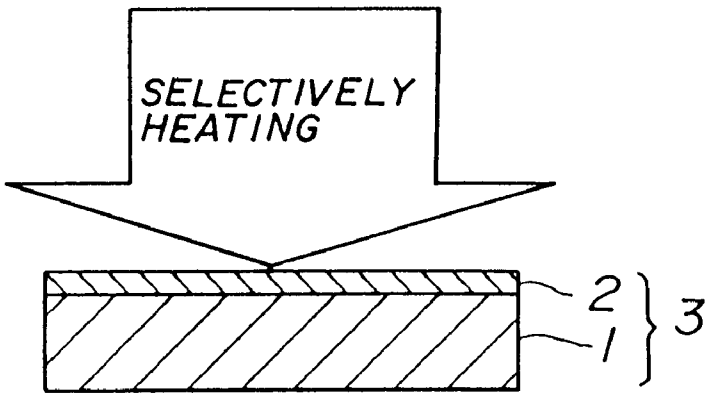

FIGS. 4A and 4B illustrate a first aspect of the latent image forming method of the present invention. In the first aspect, when forming a latent image, as shown in FIG. 4A, the contact liquid 4 is in contact with the recording surface (the surface on which the recording material 2 has been coated) of the recording body 3 which includes the base material 1 and recording material 2. In this condition, the entire top surface of the recording body 3 is heated by a heat source 5, and, thus, the receding contact angle of the recording material 2 is reduced through the entire top surface. Then, as shown in FIG. 4B, using heating means, the top surface of the recording body 3 is selectively heated in air, the receding contact angle of the recording material 2 is partially increased, and a desired latent image is obtained. Thus, the contact liquid is not needed when a latent image is formed (when selective heating is performed).

When a thermal head or the like is used as the heating means when performing heating in air, as an image forming signal, the following two signals can be considered:

1. an ordinary nega-posi signal (forming the nega-posi-reverse image); and
2. a nega-posi-reverse signal (forming the ordinary nega-posi image).

For each case, embodiments of actual latent image formation and development using the latent image will now be described.

Nega-Posi Signal Cases

FIG. 3B shows the image which is formed using the nega-posi signal. In this case, the image is formed as a result of developing the latent image which is obtained as a result of the image portion (letter portion) being heated in air. Accordingly, the image portion is in the ink repelling state and the non-image portion is in the ink attraction state, and the nega-portion and the posi-portion are reversed. In this case, heating in the latent image formation is performed on the image portion. Accordingly, power consumption is the same as in the related art.

<Embodiment 1-1>

Figure 5A:
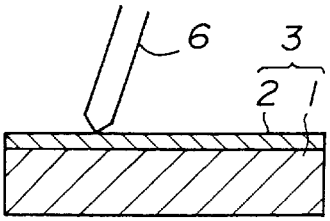
FIGS. 5A, 5B and 5C illustrate heating in air in the present invention in the first aspect.

FIG. 5A illustrates an embodiment 1-1. In this embodiment, first, the entire top surface of the recording body 3 is heated in liquid (see FIG. 6). Then, as shown in FIG. 5A, using a soldering iron 6 as the heating means in air, the top surface of the recording body 3 is partially (image portion) heated in air in a freehand manner. Thus, a latent image is formed. In this embodiment, a latent image is formed in a freehand manner and the nega-posi signal is not used. However, because the output image is reversed, this embodiment is included in the nega-posi signal cases.

Figure 6:
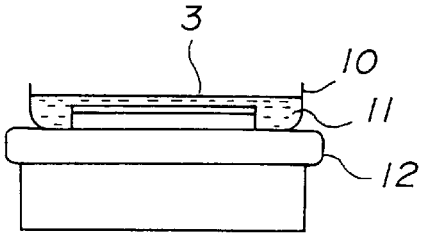
FIG. 6 illustrates heating in liquid in the present invention in the first aspect.

When heating in liquid is performed, as shown in FIG. 6, the recording body 3 and glycerin 11 are provided in a box-shaped aluminum foil 10. Then, the box-shaped aluminum foil 10 is put on a hot plate 12. As the temperature setting of the hot plate 12 is 130° C., heating is performed. Actually, it is sufficient that heat equal to or more than 80° C. is provided to the recording body 3 for several milliseconds. Then, it is necessary to cool the recording body 3 in a condition where the recording body 3 is in contact with the liquid. For this purpose, the box-shaped aluminum foil 10 containing the recording body 3 and the liquid is removed from the hot plate 12, and water is provided in the aluminum foil 10 for cooling the recording body 3. This method is also used as the entire-top-surface in-liquid heating in each of <embodiment 1-2> through <embodiment 1-5> which will be described.

The above-mentioned heating in air is performed with the soldering iron 6, the temperature of which is set to be 90° C. using a temperature controller (not shown in the figure). Then, image development using a roller (development speed: 30 mm/sec) is performed using ink which has the following components:

| | |
|---|---|
| BSK-207 (dye, made by Ricoh Co., Ltd.) | 25%; |
| polyvinylpyrrolidone | 40%; and |
| ethylene glycol | 35%. |

Then, the latent image is evaluated by observing the condition of ink adherence to the recording body 3 and the condition of stains in the background. This evaluation method is also used in each of <embodiment 1-2> through <embodiment 1-5>.

The result of the evaluation of this embodiment is that an image without stains in the background has been obtained on the recording body 3.

<Embodiment 1-2>

Figure 5B:
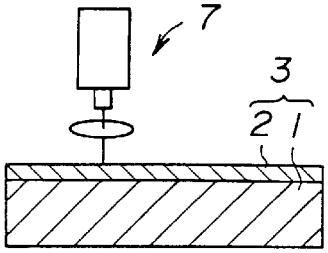

FIG. 5B illustrates an embodiment 1-2. In this embodiment, first, the entire top surface of the recording body 3 is heated in liquid (see FIG. 6). Then, using a laser device 7, the top surface of the recording body 3 is partially (image portion) heated in air (the spot diameter being 10 μm), and thus, a latent image is formed. For this type of heating in air, a semiconductor laser (made by Matsushita Electronics Corp., LN9830) is used. The driving condition thereof is a wavelength of 830 nm and electric power of 30 mW. The base material 1 of the recording body 3 is made of polyimide film containing carbon.

The result of the evaluation of this embodiment is that an image without stains in the background has been obtained on the recording body 3.

<Embodiment 1-3>

Figure 5C:
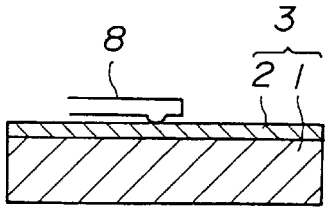

FIG. 5C illustrates an embodiment 1-3. In this embodiment, first, the entire top surface of the recording body 3 is heated in liquid (see FIG. 6). Then, using a thermal head 8, the top surface of the recording body 3 is partially (image portion) heated in air (applied voltage pulse: 22 V, 0.4 msec; resistance: 1000 Ω; and recording speed: 10 mm/sec), and thus, a latent image is formed. The thermal head for the heating in air is made by Toshiba Corp., TPH217R5 (200 dpi).

The result of the evaluation of this embodiment is that an image without stains in the background has been obtained on the recording body 3.

Nega-Posi-Reverse Signal Cases

FIG. 3A shows the image formed by using the nega-posi-reverse signal. In this case, the non-image portion is heated and the latent image is formed. Accordingly, the non-image portion is in an ink repelling state and the image portion is in an ink attraction state, and thus, the posi-portion and the nega-portion of the output image are not reversed. In this case, for example, in the case of the latent image of FIG. 3A, power consumption of the thermal head or the like is larger than that in the above-described nega-posi signal case.

<Embodiment 1-4>

In this embodiment, similar to the embodiment 1-2 (FIG. 5B), first, the entire top surface of the recording body 3 is heated in liquid (see FIG. 6). Then, using a laser device 7, the top surface of the recording body 3 is partially (non-image portion) heated in air (the spot diameter being caused to be 10 μm), and thus, a latent image is formed. For this heating in air, a semiconductor laser (made by Matsushita Electronics Corp., LN9830) is used. The driving condition thereof is a wavelength of 830 nm and a power of 30 mW. The base material 1 of the recording body 3 is made of polyimide film containing carbon.

The result of the evaluation of this embodiment is that an image without stains in the background has been obtained on the recording body 3.

<Embodiment 1-5>

In this embodiment, similar to the embodiment 1-3 (FIG. 5C), first, the entire top surface of the recording body 3 is heated in liquid (see FIG. 6). Then, using a thermal head 8, the top surface of the recording body 3 is partially (non-image portion) heated in air (applied voltage pulse: 22 V, 0.4 msec; resistance: 1000 Ω; and recording speed: 10 mm/sec), and thus, a latent image is formed. The thermal head for this type of the heating in air is made by Toshiba Corp., TPH217R5 (200 dpi).

The result of the evaluation of this embodiment is that an image without stains in the background has been obtained on the recording body 3.

Description of the Present Invention in the Second Aspect

Figure 7A:
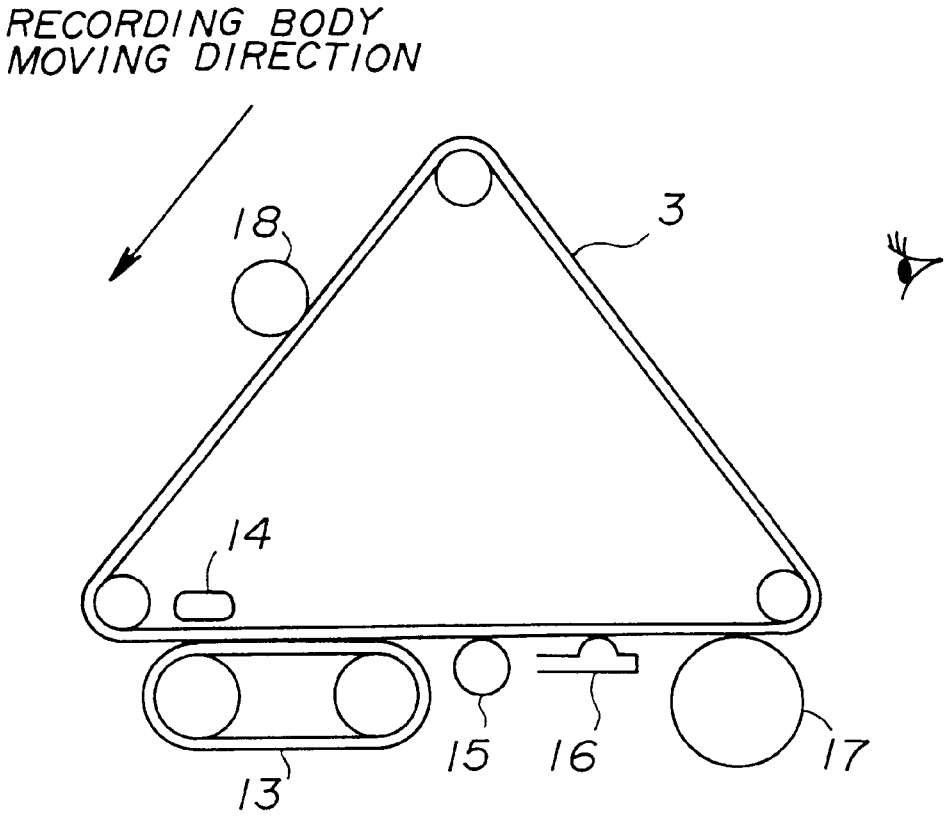
FIGS. 7A and 7B show an arrangement for illustrating the present invention in a second aspect.
Figure 7B:
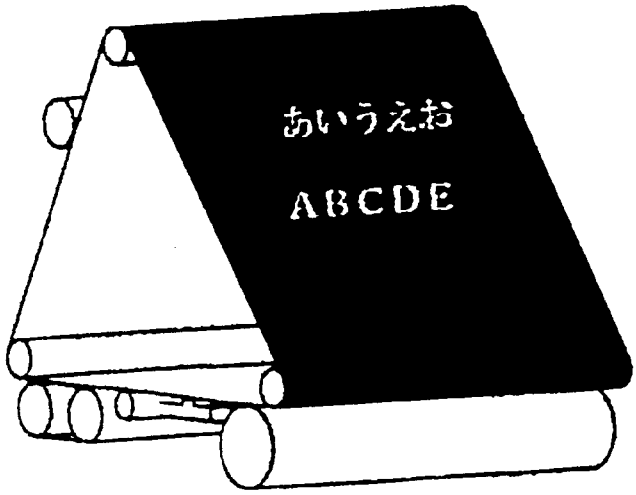

FIGS. 7A and 7B illustrate the present invention in the second aspect. As show in FIG. 7A, first, in a condition where a sponge belt 13 impregnated with water or a silicon rubber belt is in contact with the recording surface of the recording body 3, a ceramic heater 14 is used for heating the recording body 3 so as to heat the entire outer surface of the recording body 3. When the sponge belt 13 impregnated with water is in contact with the recording body 3 and the heating is performed, water drops adhering to the recording body 3 are wiped off by a roller 15. Then, a thermal head 16 is used for partially heating the outer surface of the recording body 3 in air, and thus, a latent image is formed. Then, a developing roller 17 which has ink applied thereto is used for developing the latent image. Then, a cleaning roller 18 impregnated with water is used for wiping off the developed image. Then, by repeating the above-described operation, new images are formed on the recording body 3. FIG. 7B shows a state of indication of an image which has been developed as described above.

<Embodiment 2>

Each of the wiping roller 15 and cleaning roller 18 is a sponge (hardness: 30°) roller, and the developing roller 17 is a rubber (propylene rubber, hardness: 80°) roller. The thermal head 16 is TPH217R5(200 dpi) made by Toshiba Corp. In this case, a sponge belt (hardness: 30°) impregnated with water is used as the contact member (sponge belt 13) when the entire outer surface of the recording body 3 is heated.

The development speed is 30 mm/sec. The development liquid components are as follows:

| | |
|---|---|
| BSK-207 (dye, made by Ricoh Co., Ltd.) | 25%; |
| polyvinylpyrrolidone | 40%; and |
| ethylene glycol | 35%. |

The result of this embodiment is that no stains in the background are present. In the embodiment 2, the non-image portion is developed. That is, as shown in FIG. 7B, the resulting image includes white letters and black background. However, because the recording body 3 is transparent, the image portion is transparent, and seems bright as a result of transmitting natural light.

Description of the Present Invention in the Third Aspect

Figure 8:
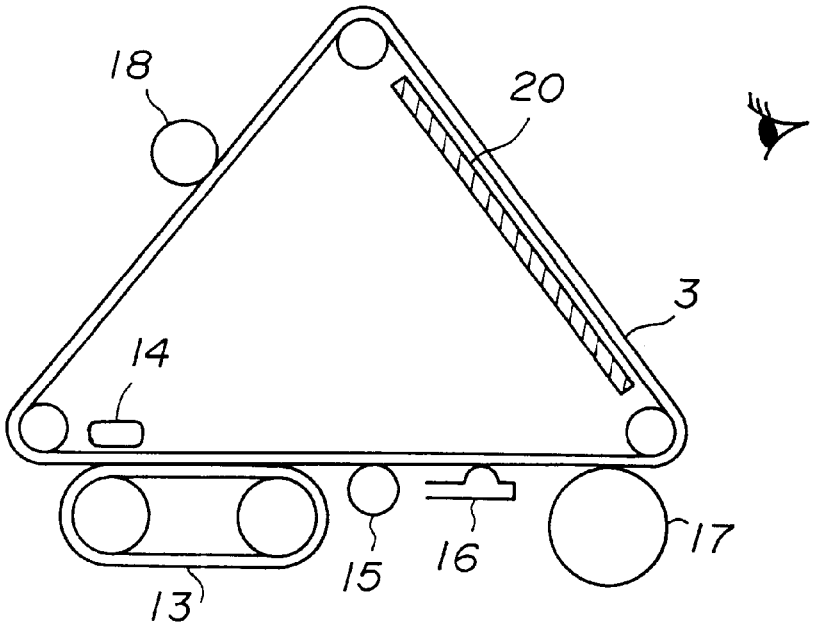
FIG. 8 shows an arrangement for illustrating one example of the present invention in the third aspect.

FIG. 8 illustrates one example of the present invention in the third aspect. First, in a condition where a sponge belt 13 impregnated with water or a silicon rubber belt is in contact with the recording surface of the recording body 3, a ceramic heater 14 is used for heating the recording body 3 so as to heat the entire outer surface of the recording body 3. When the sponge belt 13 impregnated with water is in contact with the recording body 3 and the heating is performed, water drops adhering to the recording body 3 are wiped off by a roller 15. Then, a thermal head 16 is used for partially heating the outer surface of the recording body 3 in air, and thus, a latent image is formed. Then, a developing roller 17 which has ink applied thereto is used for developing the latent image. A light emitting layer 20 is provided at the rear side of the recording body 3 which has undergone the development process. Then, a cleaning roller 18 impregnated with water is used for wiping off the developed image. Then, by repeating the above-described operation, new images are formed on the recording body 3.

In the arrangement shown in FIG. 8, the non-image portion is developed as a result of developing a latent image obtained using the nega-posi signal. That is, the resulting image includes white letters and black background. However, because the base material 2 is transparent, the image portion is transparent. Accordingly, when the light emitting layer (lighting means) 20 is caused to emit light, the image portion (transparent letter portion) shines brightly. Thus, in comparison to the case where the light emitting layer 20 is not provided, the indication capability is improved in the arrangement of FIG. 8.

<Embodiment 3-1>

The light emitting layer is made of a plastic box having a fluorescent lamp or fluorescent lamps provided therein.

The development speed is 30 mm/sec. The development liquid components are as follows:

| | |
|---|---|
| BSK-207 (dye, made by Ricoh Co., Ltd.) | 25%; |
| polyvinylpyrrolidone | 40%; and |
| ethylene glycol | 35%. |

The result of this embodiment is that no stains in the background are present and the image portion is optically emphasized or enhanced. Thereby, the image portion can be seen easily.

Figure 9:
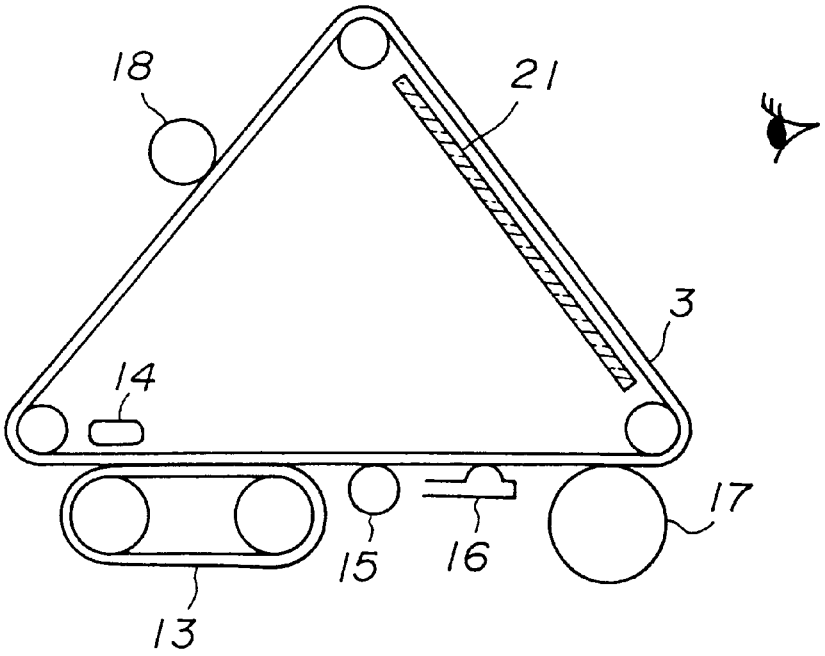
FIG. 9 shows an arrangement for illustrating another example of the present invention in the third aspect.

FIG. 9 illustrates another example of the invention of the third aspect. In this example, first, in a condition where a sponge belt 13 impregnated with water or a silicon rubber belt is in contact with the recording surface of the recording body 3, a ceramic heater 14 is used for heating the recording body 3 so as to heat the entire outer surface of the recording body 3. When the sponge belt 13 impregnated with water is in contact with the recording body 3 and the heating is performed, water drops adhering to the recording body 3 are wiped off by a roller 15. Then, a thermal head 16 is used for partially heating the outer surface of the recording body 3 in air, and thus, a latent image is formed. Then, a developing roller 17 which has ink applied thereto is used for developing the latent image. An optical reflecting plate 21 (lighting means) is provided at the rear side of the recording body 3 which has undergone the development process. Then, a cleaning roller 18 impregnated with water is used for wiping off the developed image. Then, by repeating the above-described operation, new images are formed on the recording body 3.

In the arrangement shown in FIG. 9, the non-image portion is developed as a result of developing a latent image obtained using the nega-posi signal. That is, the resulting image includes white letters and black background. However, because the base material 2 is transparent, the image portion is transparent. Accordingly, light reflected by the optical reflecting plate 21 (lighting means) 20 passes through only the image portion (transparent letter portion). As a result, the image portion shines brightly. Thus, without needing a special light source, the high-indication-capability indicating device can be provided.

<Embodiment 3-2>

The optical reflecting plate 21 is made of an aluminum sheet, the thickness of which is 150 $\mu$m.

The development speed is 30 mm/sec. The development liquid components are as follows:

| | |
|---|---|
| BSK-207 (dye, made by Ricoh Co., Ltd.) | 25%; |
| polyvinylpyrrolidone | 40%; and |
| ethylene glycol | 35%. |

The result of this embodiment is that no stains in the background are present and the image portion is optically emphasized or enhanced. Thereby, the image portion can be seen easily.

Description of the Present Invention in the Fourth Aspect

Figure 10:
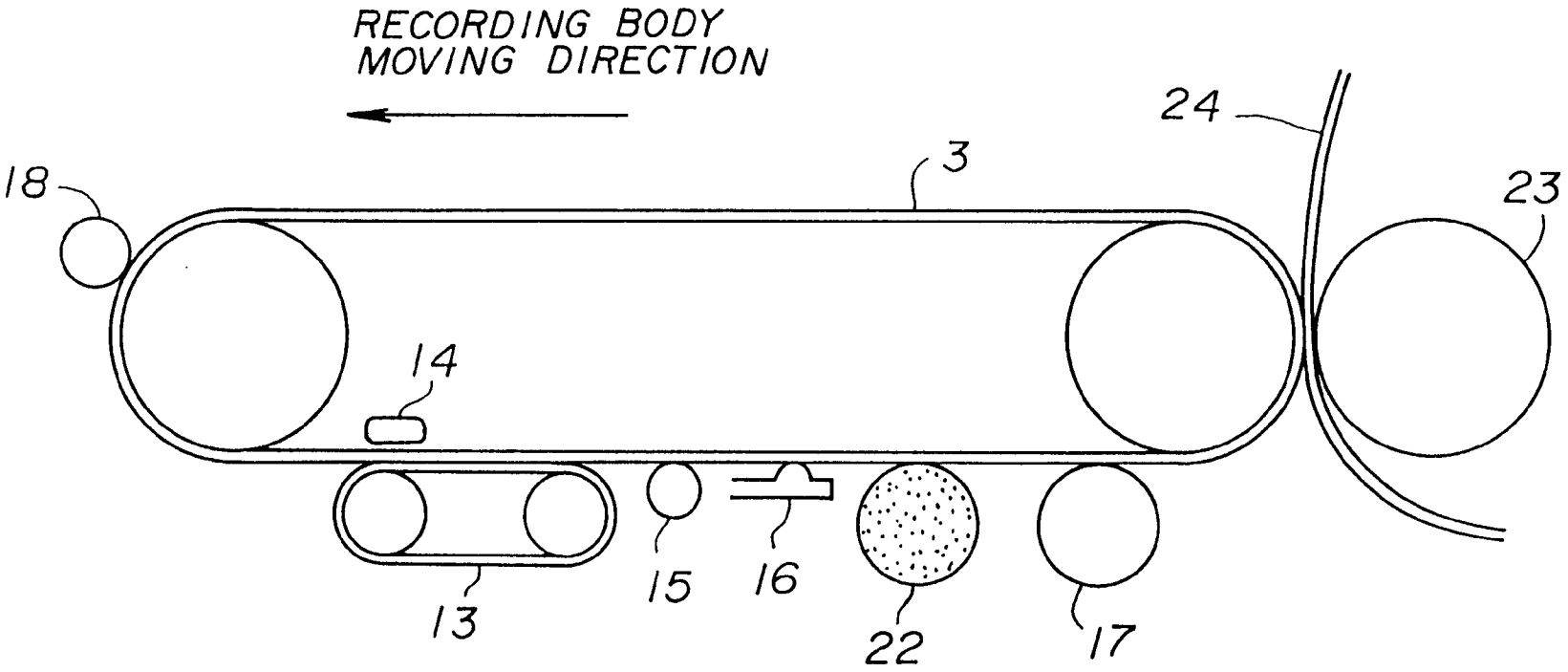
FIG. 10 shows an arrangement for illustrating the present invention in a fourth aspect.

FIG. 10 illustrates the present invention in the fourth aspect (a liquid applying roller 22 is used in the fifth aspect and in the sixth aspect, but is not used in the fourth aspect). As show in FIG. 10, first, in a condition where a sponge belt 13 impregnated with water or a a silicon rubber belt is in contact with the recording surface of the recording body 3, a ceramic heater 14 is used for heating the recording body 3 so as to heat the entire outer surface of the recording body 3. When the sponge belt 13 impregnated with water is in contact with the recording body 3 and the heating is performed, water drops adhering to the recording body 3 are wiped off by a roller 15. Then, a thermal head 16 is used for partially heating the outer surface of the recording body 3 in air, and thus, a latent image is formed. Then, a developing roller 17 which has ink applied thereto is used for developing the latent image. Then, a transfer roller 23 is used for transferring the thus-developed image on the recording body 3 to a recording paper sheet 24 by causing the recording body 3 to come into contact with the recording paper sheet and pressing the recording paper sheet 24 to the recording body 3. When the transfer roller 23 is heated when the image is transferred, the transferring performance can be improved. Then, a cleaning roller 18 impregnated with water is used for wiping off the image remaining on the recording body 3. Then, by repeating the above-described operation, new images are formed on the recording body 3.

<Embodiment 4>

Each of the wiping roller 15 and cleaning roller 18 is a sponge (hardness: 30°) roller, and the developing roller 17 is a rubber (propylene rubber, hardness: 80°) roller. The thermal head 16 is TPH217R5(200 dpi) made by Toshiba Corp. The transfer roller 23 is made of a stainless steel pipe. In this case, a sponge belt (hardness: 30°) impregnated with water is used as the contact member (sponge belt 13) when the entire outer surface of the recording body 3 is heated. The transfer roller 23 is not heated.

The development speed is 30 mm/sec. The development liquid components are as follows:

| | |
|---|---|
| BSK-207 (dye, made by Ricoh Co., Ltd.) | 25%; |
| polyvinylpyrrolidone | 40%; and |
| ethylene glycol | 35%. |

The result of this embodiment is that, although a slight transfer remainder is present, the image on the recording paper sheet 24 is approximately the same as the image on the recording body 3. However, because the non-image portion is developed, the output image is the nega-posi-reverse image such as that shown in FIG. 3B.

Description of the Present Invention in the Fifth Aspect

Figure 11A:
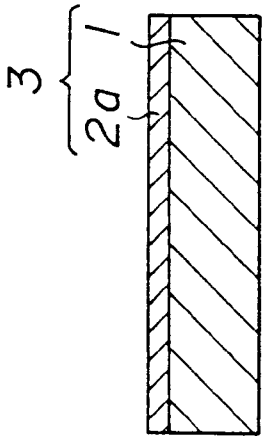
FIGS. 11A, 11B and 11C show a process for illustrating the present invention in a fifth aspect.
Figure 11B:
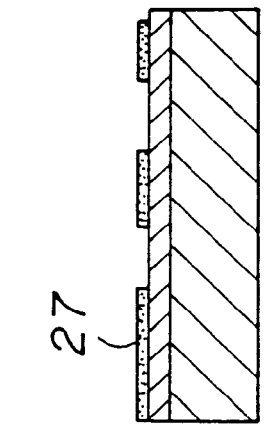
Figure 11C:
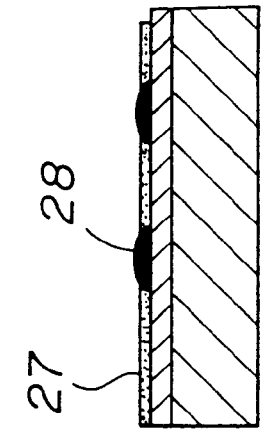

FIGS. 11A, 11B and 11C illustrate the present invention in the fifth aspect. As shown in FIG. 10, the liquid applying roller 22 is provided between the thermal head 16 and the developing roller 17. Thereby, a nega-posi-reverse latent image on the recording body 3 is developed so as to provide an ordinary nega-posi image. In this case, as the recording material, a recording material 2*a* containing water attraction members (minute particles of titanium oxide, magnesium oxide, etc.) is used. First, in a condition where a sponge belt 13 impregnated with water or a silicon rubber belt is in contact with the recording surface of the recording body 3, a ceramic heater 14 is used for heating the recording body 3 so as to heat the entire outer surface of the recording body 3. When the sponge belt 13 impregnated with water is in contact with the recording body 3 and heating is performed, water drops adhering to the recording body 3 are wiped off by a roller 15. Then, a thermal head 16 is used for forming the nega-posi-reverse latent image.

Thereby, the nega-posi-reverse latent image is present on the recording body 3 (shown in FIG. 11A). Then, liquid 27, water or a liquid having a main component of water, is applied to the entire outer surface of the recording body 3, on which the nega-posi-reverse latent image has been formed, using the liquid applying roller 22 shown in FIG. 10. Thereby, as shown in FIG. 11B, a film of the liquid 27 covers the non-image portion. Then, this surface is developed using oil based ink 28. Thereby, as shown in FIG. 11C, the ink 28 adheres only to the image portion and no stains are present on the background. However, the ink is not likely to adhere to the image portion without performing the following processes:

i. fluorosurfactants are contained in the oil based ink; and ii. the development speed is set to be slow.

Then, the transfer roller 23 is used for transferring the ink on the recording body 3 to the recording paper sheet 24 by causing the recording paper sheet 24 to come into contact with the recording body 3 and pressing the recording paper sheet 24 to the recording body 3. Thereby, the ordinary nega-posi image is obtained on the recording paper sheet 24. Thus, in the invention in the fifth aspect, the ordinary nega-posi image is obtained from the nega-posi-reverse latent image.

<Embodiment 5>

The development speed: 5 mm/sec.

The water attraction members: minute particles of magnesium oxide.

The recording paper: Type 6200 (made by Ricoh Co., Ltd.).

The oil based ink components:

| | |
|---|---|
| BSK-207 (dye, made by Ricoh Co., Ltd.) | 24%; |
| polyvinylpyrrolidone | 30%; |
| linseed oil | 45%; and |
| surflon (registered trade mark, made by Asahi Glass Corporation) surfactant | 1%. |

The result of this embodiment is that, although a slight transfer remainder is present, the image on the recording paper sheet 24 is approximately the same as the image on the recording body 3. The output image is the nega-posi image such as that shown in FIG. 3A.

Description of the Present Invention in the Sixth Aspect

Figures 12A, 12B, 12C:
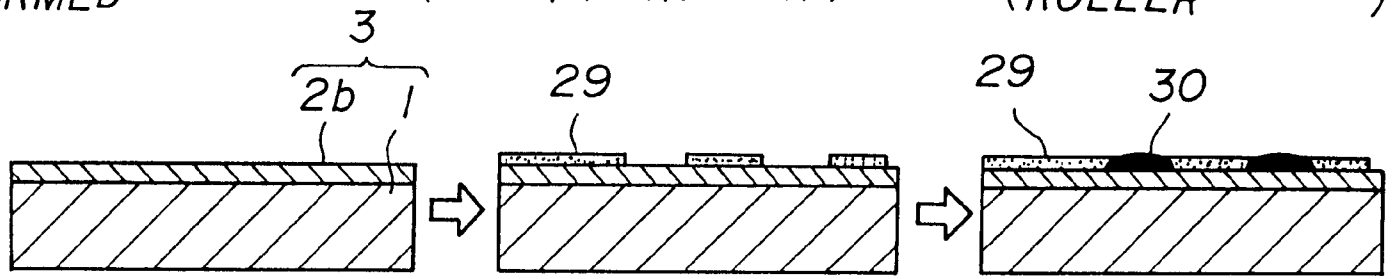
FIGS. 12A, 12B and 12C show a process for illustrating the present invention in a sixth aspect.

FIGS. 12A, 12B and 12C illustrate the present invention in the sixth aspect. As shown in FIG. 10, the liquid applying roller 22 is provided between the thermal head 16 and the developing roller 17. Thereby, a nega-posi-reverse latent image on the recording body 3 is developed so as to provide the ordinary nega-posi image. In this case, as the recording material, a recording material 2*b* containing an oil attraction member (polyolefine family (polyethylene, polypropylene, polystyrene, etc.)) is used. First, in a condition where a sponge belt 13 impregnated with water or a silicon rubber belt is in contact with the recording surface of the recording body 3, a ceramic heater 14 is used for heating the recording body 3 so as to heat the entire outer surface of the recording body 3. When the sponge belt 13 impregnated with water is in contact with the recording body 3 and heating is performed, water drops adhering to the recording body 3 are wiped off by a roller 15. Then, a thermal head 16 is used for forming the nega-posi-reverse latent image.

Thereby, the nega-posi-reverse latent image is present on the recording body 3 (shown in FIG. 12A). Then, oil 29 (linseed oil, tung oil, mineral oil, fatty acid, fatty acid ester, N-alcane, etc) is applied to the entire outer surface of the recording body 3, on which the nega-posi-reverse latent image has been formed, using the liquid applying roller 22 shown in FIG. 10. Thereby, as shown in FIG. 12B, a film of oil 29 covers the non-image portion. Then, this surface is developed using water based ink 30. Thereby, as shown in FIG. 12C, the ink 30 adheres only to the image portion and no stains are present on the background at all. However, the ink is not likely to adhere to the image portion without performing the following processes:

i. surfactant is contained in the water based ink; and ii. the development speed is set to be slow.

Then, the transfer roller 23 is used for transferring the ink on the recording body 3 to the recording paper sheet 24 by pressing the recording paper 24 to the recording body 3. Thereby, the ordinary nega-posi image is obtained on the recording paper sheet 24. Thus, in the invention in the sixth aspect, the ordinary nega-posi image is obtained from the nega-posi-reverse latent image.

In the invention in the sixth aspect, because oil is used as liquid to be applied before development, the film of the oil covering on the non-image portion does not dry. Accordingly, when a plurality of output images are obtained, once the oil is applied to the non-image portion, it is not necessary to apply the oil to the non-image portion again.

<Embodiment 6>

The development speed: 5 mm/sec.

The oil attraction member: polyethylene.

The oil: linseed oil.

The recording paper: Type 6200 (made by Ricoh Co., Ltd.).

The water based ink components:

| | |
|---|---|
| BSK-207 (dye, made by Ricoh Co., Ltd.) | 24%; |
| polyvinylpyrrolidone | 30%; |
| ethylene glycol | 45%; and |
| surfactant | 1%. |

The result of this embodiment is that, although a slight transfer remainder is present, the image on the recording paper sheet 24 is approximately the same as the image on the recording body 3. The output image is the nega-posi image such as that shown in FIG. 3A.

Figure 1:
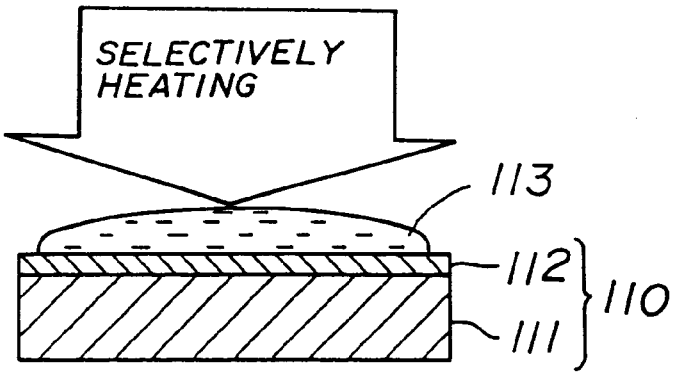
FIG. 1 Related Art
FIGS. 1 and 2 illustrate a principle of latent image formation in the related art using the characteristics of wettability change by heating.
Figure 2:
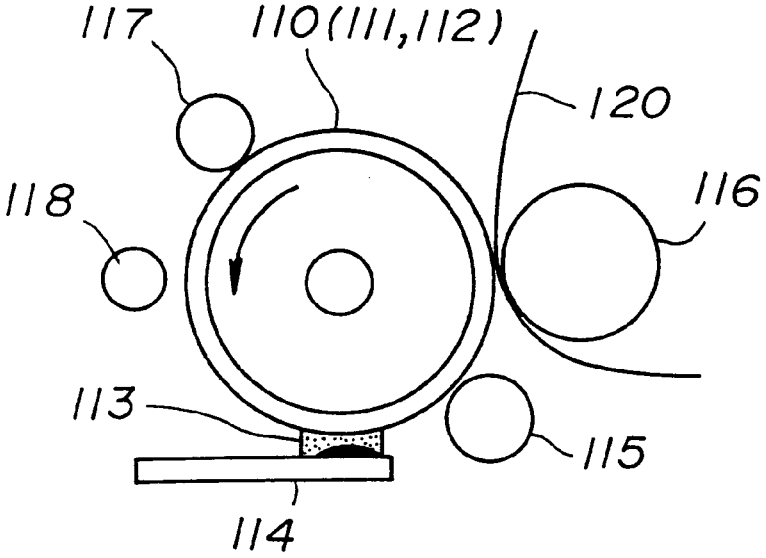
FIG. 2 Related Art
Figures 13A, 13B, 13C, 13D:
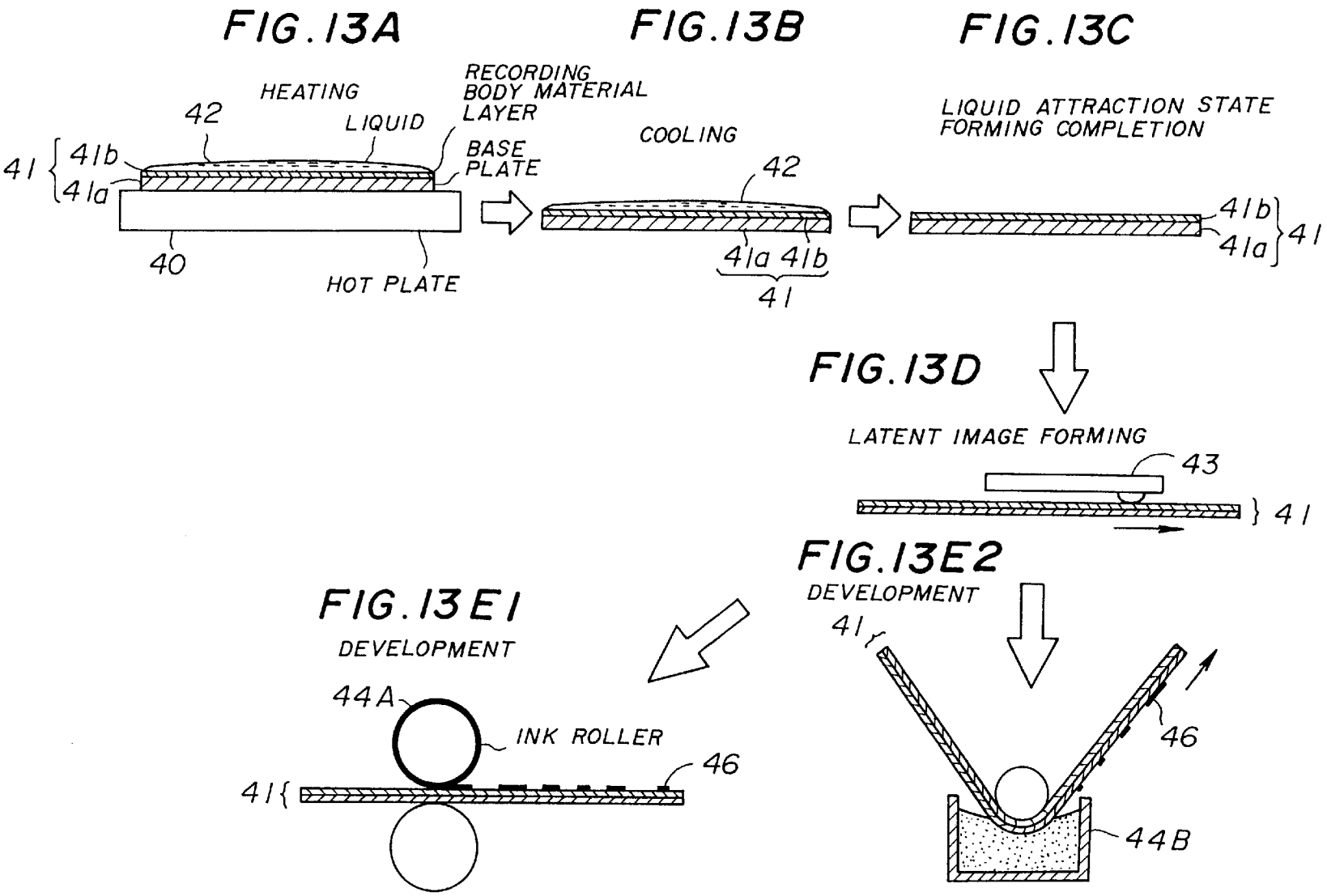

An image recording method has been described in which the entire recording surface of the recording body is provided in a liquid attraction state, only the image portion is heated in air, and, thus a latent image in accordance with image information is formed. Another image recording method will now be described. In the other image recording method, the entire recording surface of the recording body is provided in a liquid attraction state so as to attract liquid such as ink or the like, only the non-image portion is selectively heated where the contact member is not present, and, thus, image information is recorded on the recording surface of the recording body Description of the Present Invention in the Seventh Aspect FIGS. 13A through 13E2 illustrate the present invention in the seventh aspect. As shown in the figures, a hot plate 40 and a recording body 41 which includes a base plate 41*a* and a recording body material layer 41*b*, a contact member (liquid) 42, a thermal head 43 are used. Further, either an ink roller 44A or an ink container 44B is used in a development process. In the development process, a recording agent adheres to the image portion 46 as shown in FIG. 13E1 or FIG. 13E2.

FIGS. 13A through 13C show an example of a process for causing the entire recording surface of the recording body to be in a liquid attraction state. FIG. 13D shows an example of a process for forming a latent image. FIG. 13E1 or 13E2 shows an example of the development process. A procedure of the recording method of the invention in the seventh aspect will now be described. However, there are many combinations of the following respective processes ((1) through (5)).

In a process (1), the recording body 41 is heated in a condition where the contact member 42 is in contact with the top surface of the recording body 41, or the top surface of the recording body 41 comes into contact with the contact member 42 in a condition where the top surface of the recording body 41 is heated (FIG. 13A). Then, in the condition where the contact member 42 is in contact with the top surface of the recording body 41, the recording body 41 is cooled until the temperature of the recording body 41 is equal to or less than the temperature at which the receding contact angle of the top surface of the recording body 41 starts to decrease (FIG. 13B). Then, by wiping off the contact member 42, the entire top surface of the recording body 41 is in the liquid attraction state (FIG. 13C).

In a process (2), without applying the contact member (liquid) to the top surface of the recording body 41, that is, in a condition where the top surface of the recording body 41 is not in contact with the contact member, the recording body area corresponding to the non-image portion is selectively heated (in the example of the figures, the thermal head 43 is used as a heating source). Thereby, the portion which has not been heated (image portion) remains in the liquid attraction state. The heated portion is in the liquid repelling state so that a latent image is formed (FIG. 13D).

In a process (3), a recording agent containing coloring material is supplied to the latent image area, and, thus, development is performed (FIG. 13E1 or 13E2).

In a process (4), the recording agent on the recording surface of the recording body 41 is transferred to a recording paper sheet.

In a process (5), the remaining recording agent on the top surface of the recording body 41 is removed.

The shape of the recording body 41 in the present invention in the seventh aspect can be arbitrarily determined. The shape of the recording body 41 shown in FIGS. 13A through 13E2 is sheet-shaped. However, as long as the recording surface of the recording body has the coating film provided thereon, which has the above-mentioned characteristics, the shape of the recording body 41 may have any several shapes such as a film shape, an appropriate supporting-body shape, an appropriately formed body shape and so forth. An appropriately formed body itself can be the recording body as long as the recording surface thereof has the above-mentioned characteristics. Specifically, a rigid-body cylinder shape, a rigid-body plate shape, or flexible sheet-shaped or seamless-roll-shaped film is easy to use. The material of the base plate of the recording body should have a resistance to heat. As long as the above-mentioned condition is fulfilled, the material of the base plate may be resin, metal, rubber, plastic, cloth, synthetic paper, or the like.

The liquid-repelling-state area on the recording body 41 has the characteristics to repel each of oil based ink and water based ink. Similarly, the liquid-attraction-state area on the recording body 41 has the characteristics to be wet by each of oil based ink and water based ink. Accordingly, the recording agent to be used can be used by selecting one, appropriate to the above-described recording processes, from recording agents, which have been used in writing and printing in the prior art, such as ink for writing, ink for ink-jet printing, ink for ordinary printing and so forth. Specifically, for example, as a water based recording agent, water soluble ink which mainly includes water, wetting agent and dye, dispersion ink which mainly includes water, pigment, high molecular compound for dispersion and wetting agent, emulsion ink obtained from causing pigment or dye to disperse in water using surfactant, or the like may be used. Similarly, as an oil based recording agent, substances obtained from dissolving oil soluble dye in organic liquid compounds, substances obtained from causing pigment to disperse in organic liquid compounds, and substances obtained from emulsifying pigment or dye in oil or the like may be used. The viscosity of the water based or oil based recording agent to be used is selected, in accordance with development conditions, from the range from low viscosity like water to very high viscosity on the order of $10^5$ poises.

Figure 14:
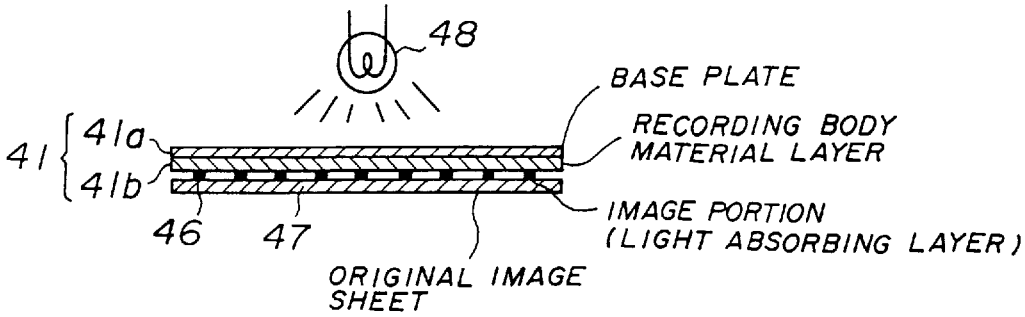
FIG. 14 illustrate the present invention in a seventh aspect.

The heating means when a latent image is formed is preferably a contact heating source such as a thermal head such as that shown in FIG. 13D or a non-contact heating source such as a laser when image forming is performed in accordance with an image signal from an information processing apparatus such as a computer. When, an original image sheet 47 is used for forming an image, as shown in FIG. 14, heating by an exposing means (light source) 48 is preferable. In this case, it is necessary that the original image sheet has the nega-posi-reverse image (such as that shown in FIG. 3B) printed thereon. Light absorbing members contained in ink or toner which forms the non-image portion 45 of the original image sheet 47 generates heat as a result of being exposed by the exposing means 48. Thereby, the recording body 41 is selectively heated and a latent image is formed. Accordingly, as the exposing means 48, an LED array, a lamp such as a halogen lamp, a xenon lamp, a strobe using a xenon discharge tube, a one-time flash or the like is suitable. With regard to the heating temperature, it is preferably that the recording surface of the recording body is heated in the range of from 80° C. to 200° C. It is further preferable that the recording surface of the recording body is heated in the range of from 100° C. to 180° C. The heating time is on the order of 0.1 msec through 1 sec, preferably, 0.3 msec through 2 msec.

With regard to the heating means for causing the entire recording surface of the recording body to be in the liquid attraction state, contact and non-contact heating sources such as an infrared heater, a heating roller, an ultrasonic-wave heating apparatus, a dielectric heating apparatus, an induction heating apparatus, a laser and so forth are considered. In any case, the recording body is heated in the condition where the contact member is in contact with the recording body recording surface, or the contact member is caused to come into contact with the recording body recording surface in the condition where the recording body recording surface is heated, and then, the recording body is cooled in the condition where the contact member is in contact with the recording body recording surface. With regard to the heating temperature, the recording body is heated on the order of 80° C. to 200° C., preferably, in the order of 80° C. to 150° C. The heating time is on the order of 1 msec through 10 sec, preferably, 10 msec through 1 sec.

Various recording methods will now be described with reference to the above-described processes (1) through (5).

<Recording Method 1>

This method is a combination of the above-described process (1)→process (2)→process (3). In this method, image information recorded on the recording body recording surface is fixed on the recording surface and the recording body itself is used (direct recording method). This method can be applied to plane substances and solid substances such as, for example, a card, a memo card, pasting produces such as a seal, a label, a poster, wallpaper, ornament produces such as curtains, a carpet, objects, an art object, and so forth. Each of these things is used as the base plate of the recording body, and image information is recorded on the recording body recording surface.

<Recording Method 2>

This method is a combination of the above-described process (1)→process (2)→process (3)→process (5) (including returning to the process (1) from the process (5)). Similar to the recording method 1, image information recorded on the recording body recording surface is fixed on the recording surface and the recording body itself is used.

This recording method can also be applied to the above-mentioned produces to which the recording method 1 can be applied. However, in this method, image information is rewritten. That is, after image information is recorded on the recording body, the recording agent adhering to the recording body recording surface is removed in the process (5). Then, the latent image is erased in the process (1). Thereby, it is possible to record different image information on the same recording body again.

<Recording Method 3>

This method is a combination of the above-described process (1)→process (2)→process (3)→process (4)→process (5) (including returning to the process (1) from the process (5) is included). In this method, image information (recording agent) recorded on the recording body recording surface is transferred to a recording paper sheet (indirect recording method). This method is suitable to a case such as printer, where frequency of image information rewriting is high.

<Recording Method 4>

This method is a combination of the above-described process (1)→process (2)→process (3)→process (4) (including returning to the process (3) from the process (4) is included). In this method, similar to the recording method 3, image information (recording agent) recorded on the recording body recording surface is transferred to a recording paper sheet (indirect recording method). This method is a printing method in which the recording body is used as a printing plate. Further, after the printing plate is produced and printing is performed, the printing plate can be used again as a result of performing the processes (5) and (1). Thereby, different image information can be recorded on the printing plate again. Accordingly, in this method, recording such as that of an on-demand short-run printer can be possible.

In these indirect recording methods, a recording paper sheet is used. As the recording paper sheet, a transparent resin film, an ordinary paper sheet, a paper sheet for ink jet printing, a paper sheet for type writing, a synthetic paper sheet and so forth are suitable. However, a rough-textured paper sheet such as a Japanese paper sheet, a recycled paper sheet or the like can also be used by preparing an appropriate recording agent.

In the recording methods 2 through 4, it is necessary to remove the recording agent adhering to the recording body recording surface so that the recording body can be used again. As methods therefor, ink may be sliced off using a blade, ink may be rubbed using a sponge roller or a file, a cleaning liquid for liquefying ink may be applied using a sponge roller or a brush, ink may be rubbed as the cleaning liquid is applied, or an adhesive is used for peeling off the ink.

<Embodiment 7-1>

The recording body:

the recording body material layer (41*b*): poly-fluoroalkyl-acrylates (LS317 of Asahi Glass Corporation); and the recording body base plate (41*a*): PET film, a sheet of a size of 100 mm by 200 mm and a thickness of 125 μm.

The recording agent:

oil based ink: waterless ink (Aqualess Super (registered trademark) KB black M of Toyo Ink Mfg. Co., Ltd.);

water based ink: coloring material (black pigment 5% by weight, average particle diameter: equal to or less than 1 μm)+a solvent (ethylene glycol 20% by weight)+ water soluble resin (polyvinylpyrrolidone 75% by weight).

The heating means: a thermal head (300 dpi, F2459A of Toshiba Corp.);

pulse width=0.5 (ms), pulse height=18 (V);

The liquid-attraction-state forming liquid: ethylene glycol.

The developing means: an ink roller of rubber (hardness: 60°) (the arrangement shown in FIG. 13E1).

The development speed: 500 mm/s when the oil based ink is used; 600 mm/s when the water based ink is used.

The recording paper: PPC paper.

In the above-mentioned conditions, first, the recording body having ethylene glycol applied to the recording surface thereof is heated for 1 minute on a hot plate which has been heated to 110° C. Then, the recording body, with the ethylene glycol applied on the recording body thereof, is cooled by tap water. Thus, the recording surface is in the ink attraction state. Then, according to the procedure of FIGS. 13D and 13E1, the thermal head is used for heating only the non-image portion of the recording surface of the recording body based on the nega-posi-reverse signal. As a result of performing the development without performing the cleaning process and latent image erasing process, a clear image can be obtained on the recording body in each case of using oil based ink and using water based ink in the development.

<Embodiment 7-2>

The recording body:

the recording body material layer (41*b*): poly-fluoroalkyl-acrylates (LS317 of Asahi Glass Corporation); and the recording body base plate (41*a*): a PET film, a sheet of a size of 80 mm by 100 mm and a thickness of 125 μm.

The recording agent:

oil based ink: waterless ink (Aqualess Super (registered trademark) KB black M of Toyo Ink Mfg. Co., Ltd.);

water based ink: water based dye ink (containing polyvinyl alcohol (PVA) 5% by weight).

The heating means:

a strobe for a camera (PE565IN of Matsushita Electric Industrial Co., Ltd.); and an original image sheet: output to an ordinary paper sheet by a laser printer (nega-posi-revsese image: the image portion is white and the non-image portion is black).

The liquid-attraction-state forming liquid: polyethylene glycol.

The developing means: an ink roller of rubber (hardness: 60°) (the arrangement shown in FIG. 13E1) when the oil based ink is used; and the recording body recording surface is directly contact with the recording agent (the arrangement shown in FIG. 13E2) when water based ink is used.

The development speed:

500 mm/s when the oil based ink is used;

20 mm/s when the water based ink is used.

The recording paper: coated paper.

In the above-mentioned conditions, similar to the method of the embodiment 7-1, the recording body recording surface is caused to be in the liquid attraction state. Then, as shown in FIG. 14, flash exposure is performed, and thus, a latent image is formed. As a result of performing the development without performing the cleaning process and latent image erasing process, a clear image can be obtained on the recording body in each case of using oil based ink and using water based ink in the development. Further, As a result of transferring the developed image to the coated paper, a good image is obtained.

Description of the Present Invention in the Eighth Aspect

FIGS. 15A through 15D illustrate the present invention in the eighth aspect. FIGS. 15A through 15D show the recording bodies, which can be used in the present invention in the seventh aspect, for example, the recording body including a light absorbing layer formed in the base plate and the recording body including the light absorbing layer formed on the base plate. In the recording body 41 shown in FIG. 15A and 15D, the recording material layer 41*b* is formed on the base plate 41*a* containing light absorbing members such as carbon particles. In the recording body 41 shown in FIGS. 15B and 15C, the light absorbing layer 41*c* containing light absorbing members such as carbon particles is formed on the base plate 41*a*, and the recording body material layer 41*b* is formed on the light absorbing layer 41*c*. As the shape of the recording body, a rigid-body cylinder shape, a rigid-body plate shape, or flexible sheet-shaped or seamless-roll-shaped film is easy to use. Basically, as long as the above-mentioned arrangement condition is fulfilled, the shape of the recording body may be any shape.

Latent image forming methods will now be described. By selectively irradiating the light absorbing layer of the recording body, the light absorbing layer is selectively heated. The thus-generated heat is used for forming a latent image. Accordingly, different from the heat-mode latent image formation such as latent image formation by directly causing a heat generating body such as a thermal head to come into contact with the recording body, it is possible to perform latent image formation in a light mode. Accordingly, latent image unevenness occurring due to contact unevenness between the recording body recording surface and the heat generating body can be prevented. Thereby, the quality of a latent image can be improved.

Figure 15A:
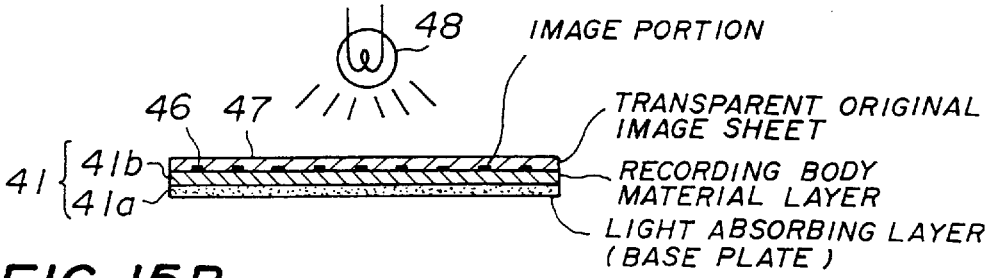
FIGS. 15A, 15B, 15C and 15D illustrate the present invention in an eighth aspect.
Figure 15B:
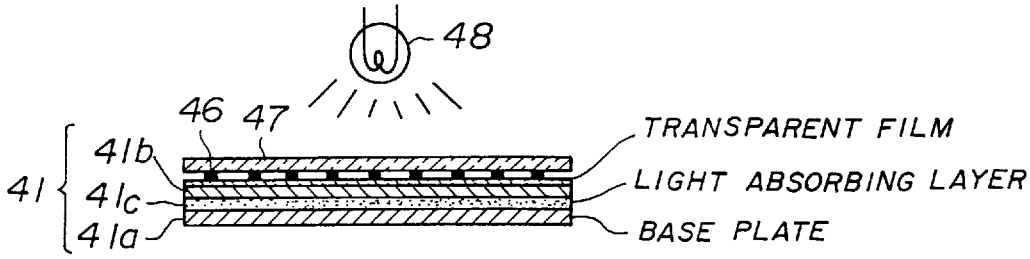
Figure 15C:
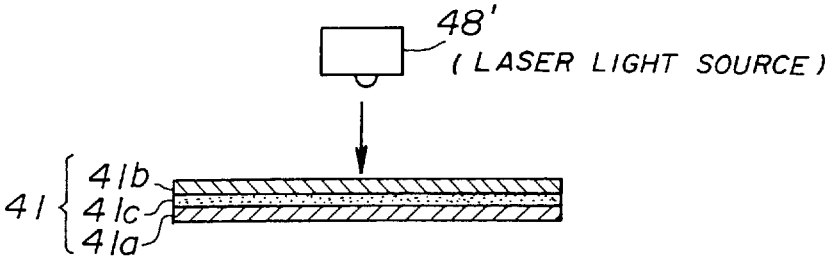
Figure 15D:
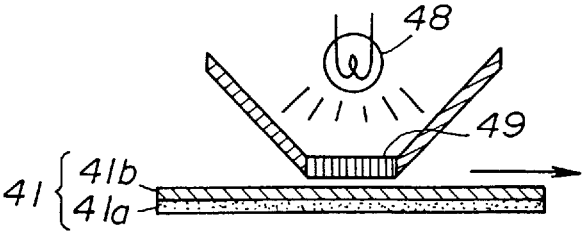

Methods of selectively exposing the recording body will now be described. For example, as shown in FIGS. 15A and 15B, a halogen lamp, a xenon lamp, a strobe using a xenon discharge tube or the like, a one-time flash or the like 48 is used for irradiating the recording body 41 through the transparent original image sheet 47. (The transparent original image sheet 47 has been obtained as a result of recording an original image on a recording sheet having transparency (such as OHP film or the like).) Thereby, the recording body 41 is selectively exposed. As anther method, as shown in FIGS. 15C, a laser light source 48' is used and the recording body 41 is selectively exposed based on an image signal as a result of a laser light scanning the recording body. As further another method, as shown in FIG. 15D, a halogen lamp, a xenon lamp, a strobe using a xenon discharge tube or the like, a one-time flash or the like 48 is used for irradiating the recording body 41 through a light shutter 49 which includes a liquid crystal or is a mechanical shutter. By controlling the light transmitting state of the light shutter, the recording body 41 can be selectively exposed. Any other methods for selectively exposing the recording body can be used for this invention.

As described above, in the methods of FIGS. 15A and 15B, a latent image can be formed merely by providing the original image sheet without using high-cost heating means such as a thermal head. Accordingly, the costs of latent image formation can be reduced, and the arrangement can be simplified. With regard to the original image sheet 47, FIG. 15A shows a case where an image is present inside the original image sheet such as a photograph nega film. FIG. 15B shows a case where an image is present on the original image sheet such as a case where a toner image is formed on the OHP sheet.

Figure 16A:
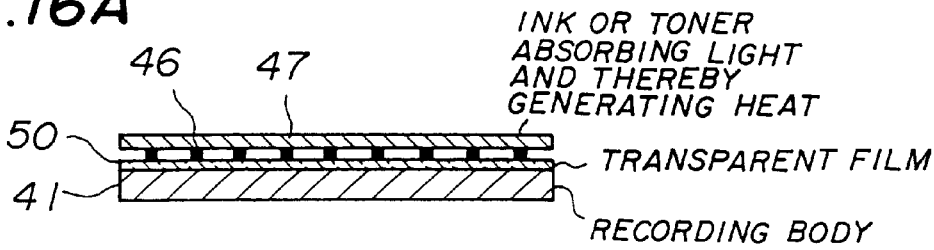
FIGS. 16A, 16B, 16C and 16D illustrate the present invention in the eighth aspect.
Figure 16B:
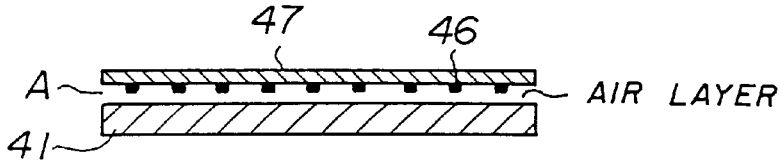
Figure 16C:
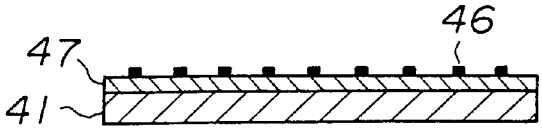
Figure 16D:
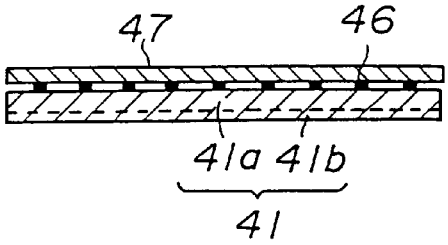

In a case where the recording agent on the original image sheet 47 absorbs light and generates heat, such as toner or ink containing carbon particles, when the image recorded surface of the original image sheet is in contact with the recording body material layer of the recording body, as shown in FIG. 15A, the area of the recording body material layer which corresponds to the image portion is heated. Accordingly, it is not possible to form a good latent image. Therefore, in a case where such an original image sheet is used, for example, one of the methods shown in FIGS. 16A through 16D may be used. Specifically, as shown in FIG. 16A, a heat insulating transparent film 50 is inserted between the original image sheet 47 and the recording body 41. As another method, as shown in FIG. 16B, a spacer (not show in the figure) is provided to the original image sheet and thereby an air gap A is provided between the original image sheet 47 and the recording body 41. As another method, as shown in FIG. 16C, the surface of the original image sheet 47 opposite to the image recorded surface is in contact with the recording body 41. As another method, as shown in FIG. 16D, the image recorded surface of the original image sheet 47 is in contact with the rear surface (opposite to the surface on which the recording body material layer 41*b* is formed) of the recording body 41. In the method of FIG. 16D, it is necessary that the recording body base plate 41*a* has a property to insulate heat occurring from the original image sheet. Further, when the contact between the original image sheet 47 and the recording body 41 is improved, light dispersion can be reduced. Accordingly, it is preferable to applying a pressure when exposure is performed.

<Embodiment 8>

The recording body:

the recording body material layer (41*b*): poly-fluoroalkyl-acrylates (LS317 of Asahi Glass Corporation);

the recording body base plate (41*a*)+the light absorbing layer (41*c*) for the recording body shown in FIGS. 15B and 15C: a PET film+a paint layer containing carbon particles (size: 80 mm by 100 mm, thickness: 125 $\mu$m).

the recording body base plate (41*a*) for the recording body shown in FIGS. 15A and 15D: a polyimide film containing carbon particles (size: 80 mm by 100 mm, thickness: 15 $\mu$m).

The recording agent: oil based ink: waterless ink (Aqualess Super (registered trademark) KB black M of Toyo Ink Mfg. Co., Ltd.);

The heating means: a flash for Print Gocco (registered trademark) (PG-10 of Riso Kagaku Corp.).

The original image sheet: output to an OHP paper sheet by a laser printer (ordinary nega-posi image: the image portion is black and the non-image portion is transparent).

The liquid-attraction-state forming liquid: polyethylene glycol.

The developing means: an ink roller of rubber (hardness: 60°).

The development speed: 700 mm/s.

The recording paper: woodfree paper.

In the above-mentioned conditions, in a method similar to the method of the embodiment 7-1, each recording body recording surface is caused to be in the ink attraction state. Then, for the recording body 41 shown in FIGS. 15A and 15D, the latent image formation is performed as shown in FIG. 15A. For the recording body 41 shown in FIGS. 15B and 15C, the latent image formation is performed as shown in FIG. 15B. Then, the development is performed using the ink roller with the oil based ink. As a result, a clear image can be obtained on the recording body in each case of using the base plate containing the light absorbing members and the case of the light absorbing layer formed on the base plate. Further, as a result of transferring the developed image to the woodfree paper, a good image is obtained.

Description of the Present Invention in the Ninth Aspect

Figure 17A:
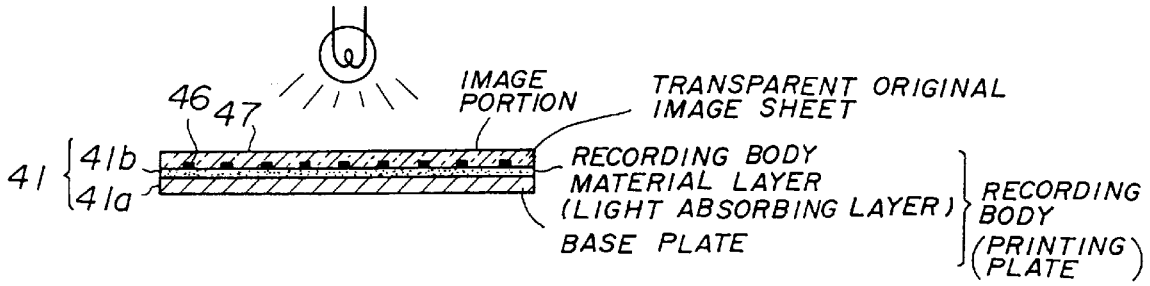
FIGS. 17A and 17B illustrate the present invention in a ninth aspect.
Figure 17B:
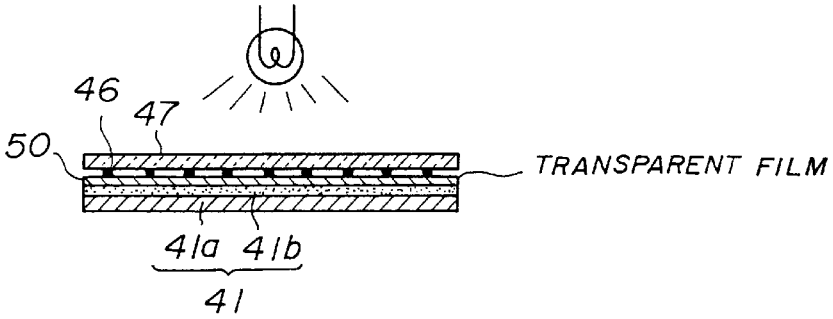

FIGS. 17A and 17B illustrate the present invention in the ninth aspect. The figures show the recording body 41, which can be used in the invention in the seventh aspect. A light absorbing layer is formed in the recording body material layer 41*b* of this recording body 41. Specifically, the recording body material layer 41*b* of this recording body 41 contains minute particles of materials, which absorbs light, such as carbon particles. FIG. 17B shows an example in which a transparent film 50 is provided on the recording body 41. Shapes of the recording body and methods of forming a latent image to the recording body may be the same as the shapes and methods described in the description of the present invention in the eighth aspect. In comparison to the invention in the eighth aspect, the light absorbing members are present in the recording body material layer in the recording body in the present invention in the ninth aspect. Accordingly, heat dispersion does not greatly occur when the surface of the recording body material layer is heated. As a result, a finer latent image can be formed.

<Embodiment 9>

The recording body:

the recording body material layer (41*b*): poly-fluoroalkyl-acrylates (LS317 of Asahi Glass Corporation), light absorbing minute particles (carbon black) are dispersed by 10% in the stock solution;

the recording body base plate (41*a*): a PET film (size: 80 mm by 100 mm, thickness: 125 μm).

The recording agent: oil based ink: waterless ink (Aqualess Super (registered trademark) KB black M of Toyo Ink Mfg. Co., Ltd.);

The heating means: a flash for Print Gocco (registered trademark) (PG-10 of Riso Kagaku Corp.).

The original image sheet: a transparent test chart film for printing (ordinary nega-posi image: the image portion is black and the non-image portion is transparent).

The liquid-attraction-state forming liquid: glycerine.

The developing means: an ink roller of rubber (hardness: 60°).

The development speed: 700 mm/s.

The recording paper: woodfree paper.

In the above-mentioned conditions, in a method similar to the method of the embodiment 7-1, the recording body recording surface is in the ink attraction state. Then, a latent image is formed in the arrangement shown in FIG. 17A. Then, the development is performed using the ink roller with the oil based ink. As a result, a clear image can be obtained on the recording body. Further, as a result of transferring the developed image to the woodfree paper, a good image is obtained.

Description of the Present Invention in the Tenth Aspect

Figure 18A:
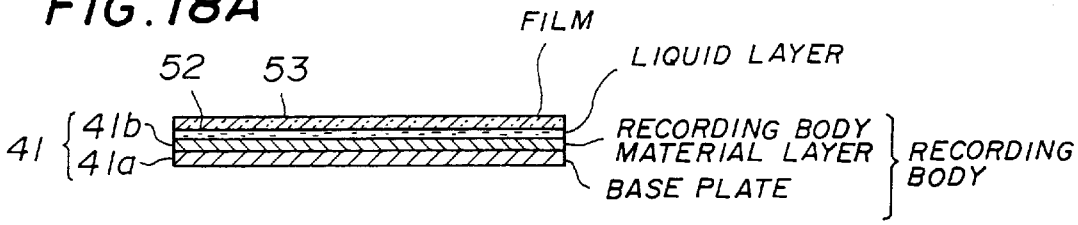
FIGS. 18A, 18B, 18C and 18D illustrate the present invention in the tenth aspect.
Figure 18B:
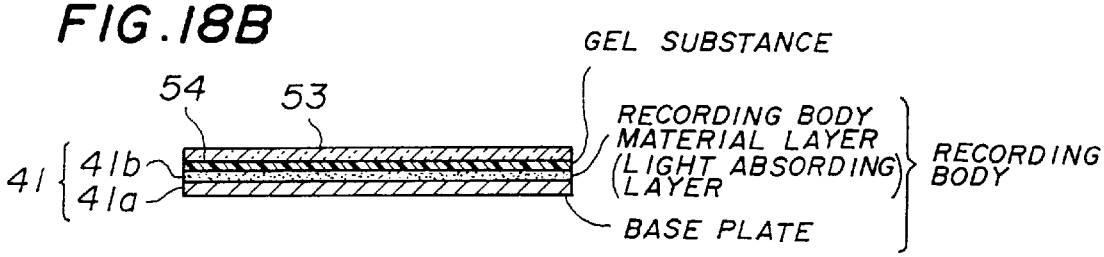
Figure 18C:
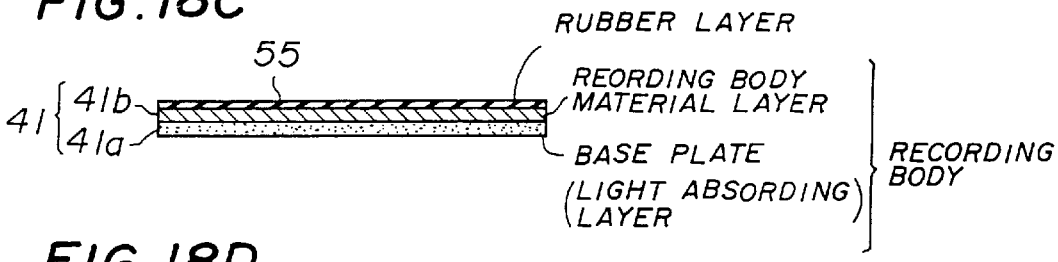
Figure 18D:
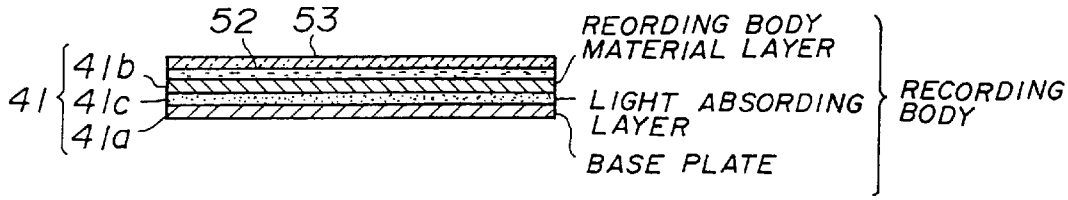

FIGS. 18A through 18D illustrate the present invention in the tenth aspect. The figures show that a removable contact member holding layer (a liquid layer with a film) 52 and 53 is provided on the recording surface of the recording body 41, which surface is in the liquid attraction state. For example, as shown in FIGS. 18A and 18D, the liquid may be inserted between the recording body 41 and a film 53, or, as shown in FIG. 18B, a gel substance 54 is inserted between the recording body 41 and the film 53. Further, it is also possible that a solid which has a superior adhesion is used other than the contact member. As shown in FIG. 18C, a high-adhesion solid (rubber layer) such as a silicon rubber or the like may be in contact with the recording surface of the recording body 41. The liquid holding member is not limited to such a film. Instead, a porous substance can be used. Further, it is also possible to put the contact member and the recording body into a bag. Although not shown in the figures, in order to improve liquid holding, the periphery of the film may be caused to adhere to the recording body in a state in which the adhered periphery of the film can be removed. By providing the contact member holding layer on the recording surface of the recording body, even if the recording body is heated when the recording body is preserved, the liquid attraction state of the recording surface of the recording body is not degraded. Further, mechanical damage of the recording body material layer can be prevented. Accordingly, preservation of the recording body can be positively performed.

<Embodiment 10>

The recording body:

the recording body material layer (41*b*): poly-fluoroalkyl-acrylates (LS317 of Asahi Glass Corporation);

the recording body base plate (41*a*): a PET film (size: 100 mm by 200 mm, thickness: 125 μm).

The contact member holding layer:

the contact member (52): glycerine;

the holding member (53): a PET film (size: 110 mm by 210 mm, thickness: 70 μm).

The recording agent: oil based ink: waterless ink (Aqualess Super (registered trademark) KB black M of Toyo Ink Mfg. Co., Ltd.);

The heating means: a thermal head (300 dpi, F2459A of Riso Kagaku Corp.);

a pulse width=0.5 (ms), a pulse height=18 (V).

The liquid-attraction-state forming liquid: ethylene glycol.

The developing means: an ink roller of rubber (hardness: 60°).

The development speed: 700 mm/s.

In the above-mentioned conditions, in a method similar to the method of the embodiment 7-1, the recording body recording surface is caused to be in the ink attraction state. Then, the arrangement shown in FIG. 18A is left at 80° C. for one hour. Then, at room temperature, the contact member holding layer is removed and the contact member is removed. Then, a latent image is formed in the arrangement shown in 13D. Then, the development is performed using the ink roller with the oil based ink. As a result, the ink attraction state of the recording body recording surface is not degraded and a clear image can be obtained on the recording body.

Description of the Present Invention in the Eleventh Aspect

Figure 19A:
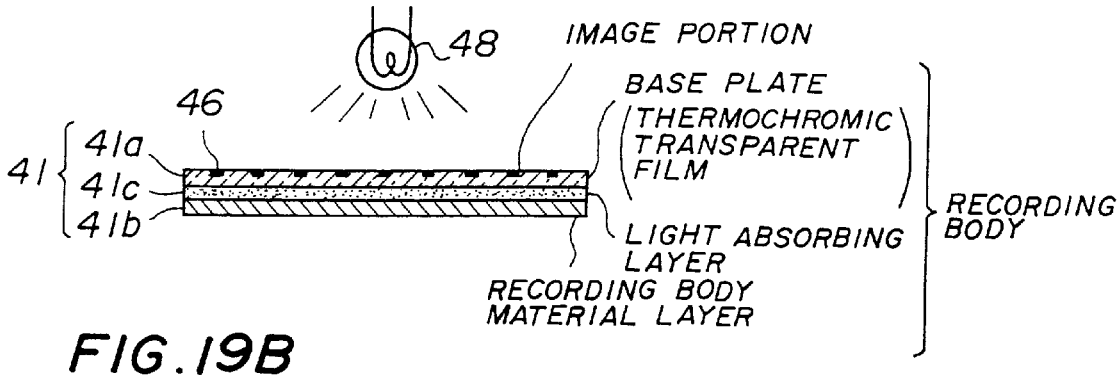
FIGS. 19A, 19B, 19C and 19D illustrate the present invention in an eleventh aspect.
Figure 19B:
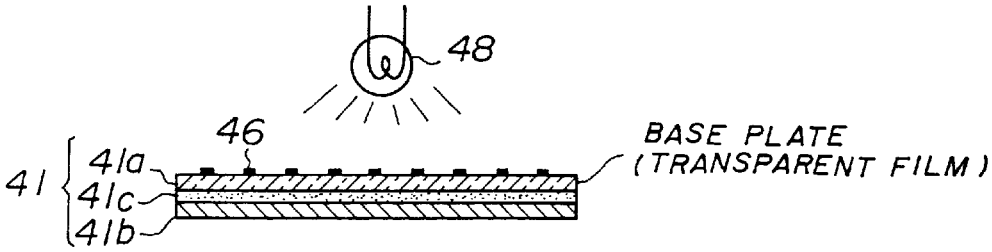
Figure 19C:
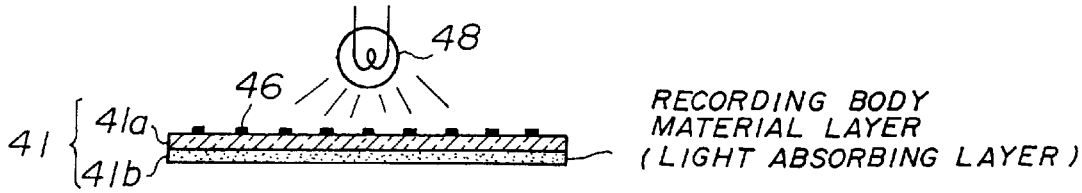
Figure 19D:
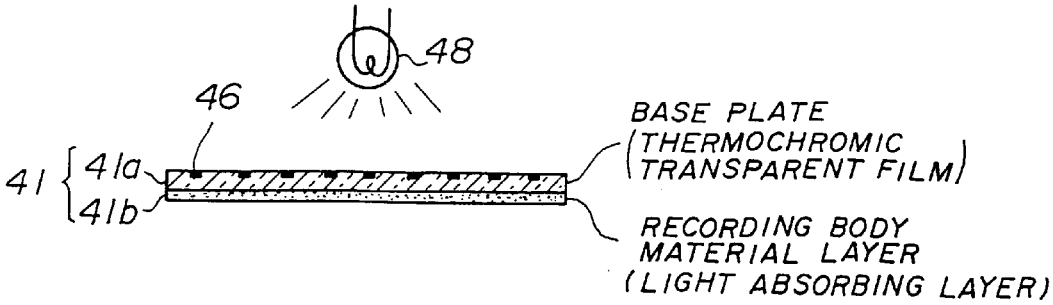

FIGS. 19A through 19D illustrate the present invention in the eleventh aspect. The figures show methods that an original image is directly formed on the recording body base plate and a latent image is formed as a result of exposing the recording body. It is necessary that a portion at which an original image is formed has a no-light-transmission property or a light-attenuation property. As the method of forming an original image on the recording body base plate, for example, as shown in FIGS. 19B and 19C, an original image 46 may be formed on the rear surface of the recording body (the surface opposite to the surface on which the recording body material layer 41*b* is formed) with a writing material using non-light-transmission paint, or, as shown in FIGS. 19A and 19D, a thermochromic transparent film may be used as the recording body base plate 41*a*, and an original image may be formed on the recording body recording surface using a thermal head, thermal pen or the like. The surface of the recording body on which the original image has been formed is exposed. Thus, the recording medium can be selectively exposed.

The material of the base plate of the recording body used in the methods of the present invention in the eleventh aspect is transparent and preferably has heat resistance. For this purpose, PET, Teflon (brand name), polyimide, other resins, plastic, and transparent rubber such as silicon rubber are suitable.

Further, the thermochromic transparent film may be a type for which only one thermochromic reaction is possible, and also, may be of a reversible type for which a thermochromically colored portion is erased and thereby writing can be repeated.

By forming an original image on the recording body base plate as described above, light dispersion occurring in a gap between an original image sheet and the recording body can be prevented. Accordingly, a high-quality latent image can be formed.

<Embodiment 11>

The recording body:

the recording body material layer (41*b*): poly-fluoroalkyl-acrylates (LS317 of Asahi Glass Corporation);

the recording body base plate (41*a*): a PET film+a paint layer containing carbon particles (size: 80 mm by 100 mm, thickness: 125 $\mu$m).

The recording agent: oil based ink: waterless ink (Aqualess Super (registered trademark) KB black M of Toyo Ink Mfg. Co., Ltd.);

The heating means: a strobe for a camera (PE565IN of Matsushita Electric Industrial Co., Ltd.).

The liquid-attraction-state forming liquid: polyethylene glycol.

The developing means: an ink roller of rubber (hardness: 60°).

The developing speed: 700 mm/s.

The recording paper: PPC paper.

In the above-mentioned conditions, in a method similar to the method of the embodiment 7-1, the recording body recording surface is in the ink attraction state. Then, a latent image is formed in the arrangement shown in FIG. 19B. Then, the development is performed using the ink roller with the oil based ink. As a result, a clear image can be obtained on the recording body. Further, as a result of transferring the developed image to the PPC paper, a good image is obtained in each of a direct transfer and an offset transfer.

Description of the Present Invention in the Twelfth Aspect

Figures 20A, 20B:
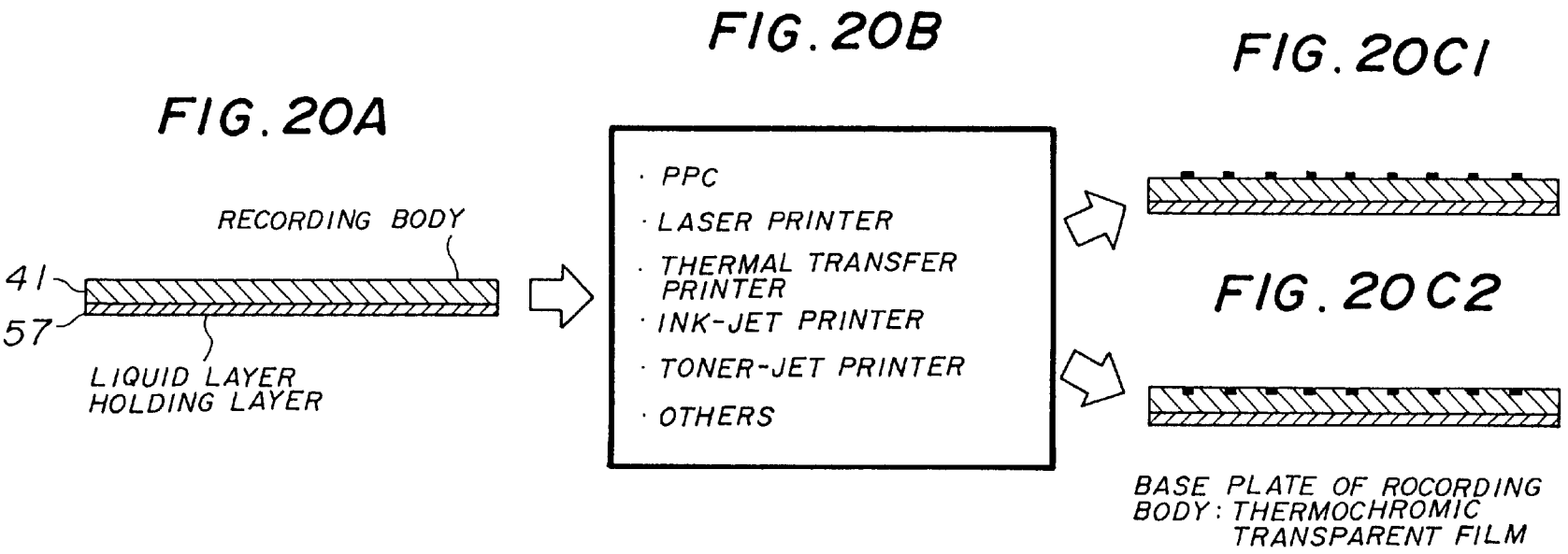
Figure 21A:
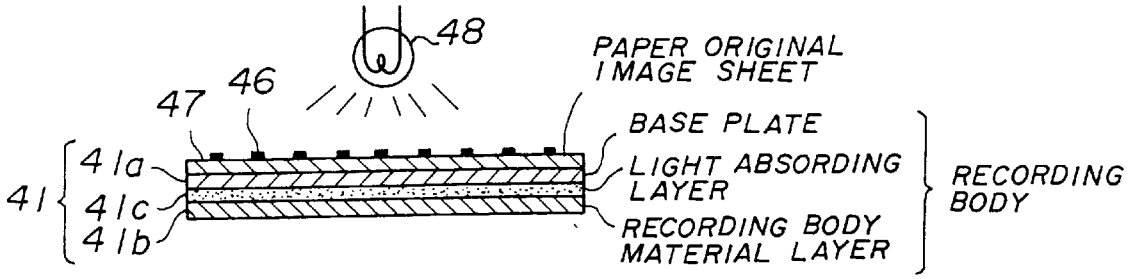
FIGS. 21A, 21B, 21C and 21D illustrate the present invention in a thirteenth aspect.
Figure 21B:
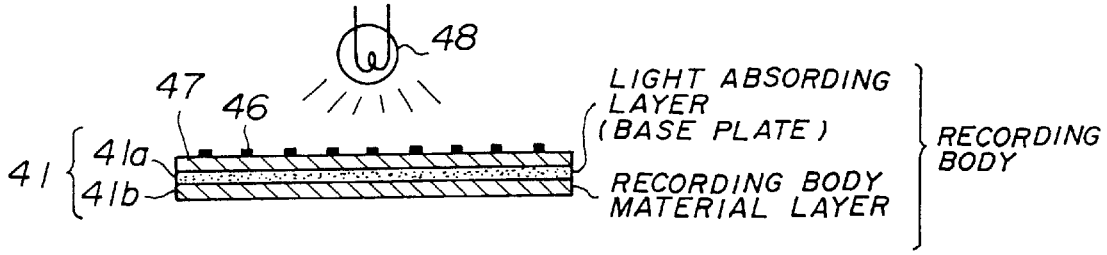
Figure 21C:
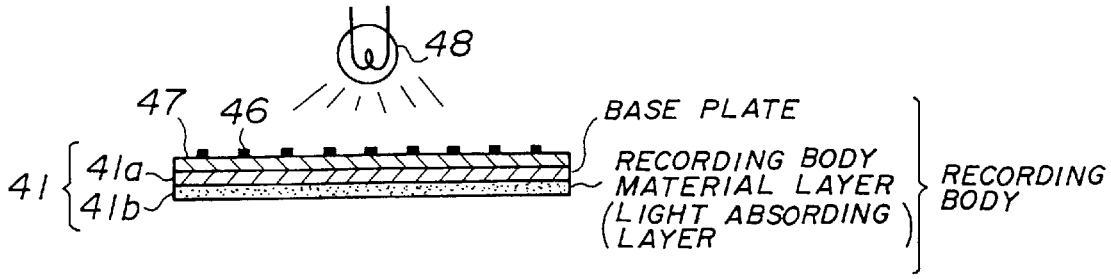
Figure 21D:
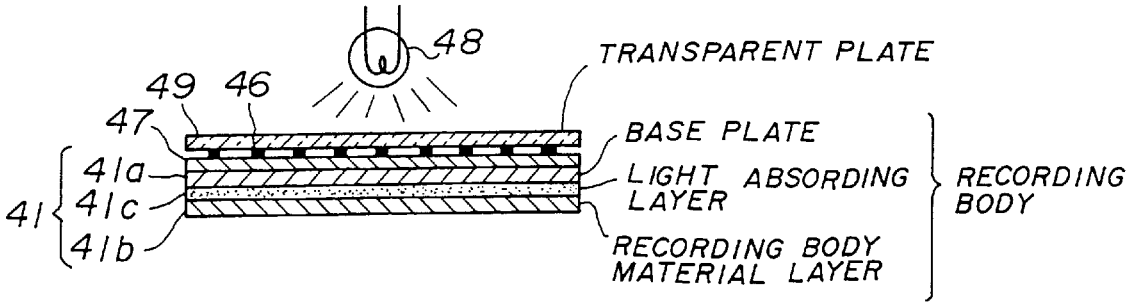
Figure 22A:
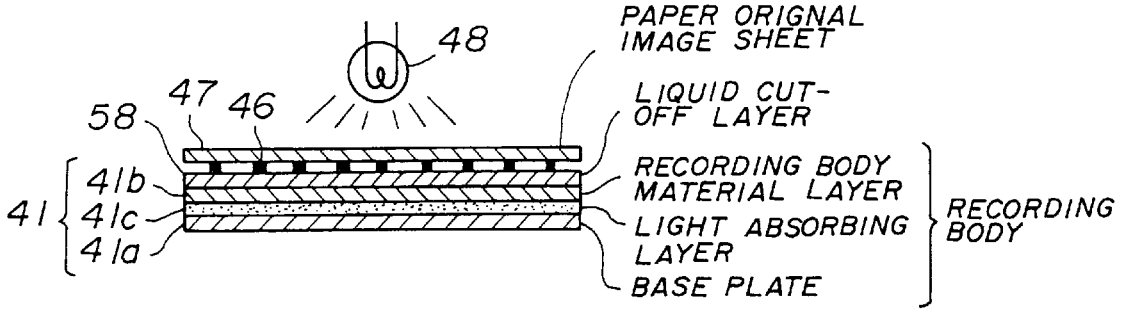
FIGS. 22A, 22B, 22C and 22D illustrate the present invention in a fourteenth aspect.
Figure 22B:
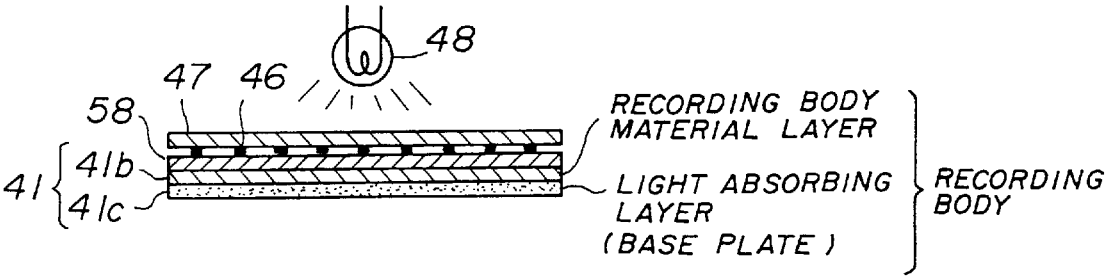
Figure 22C:
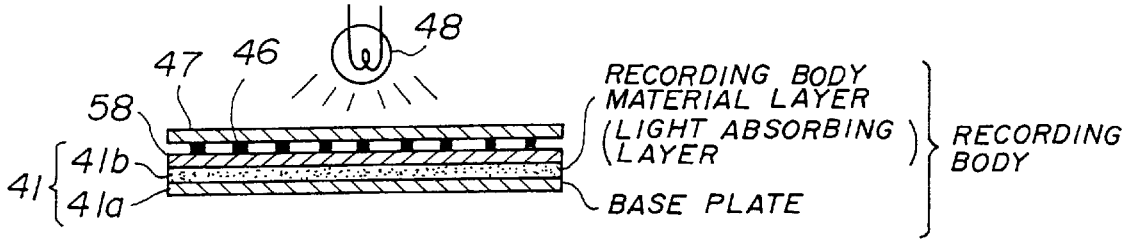
Figure 22D:
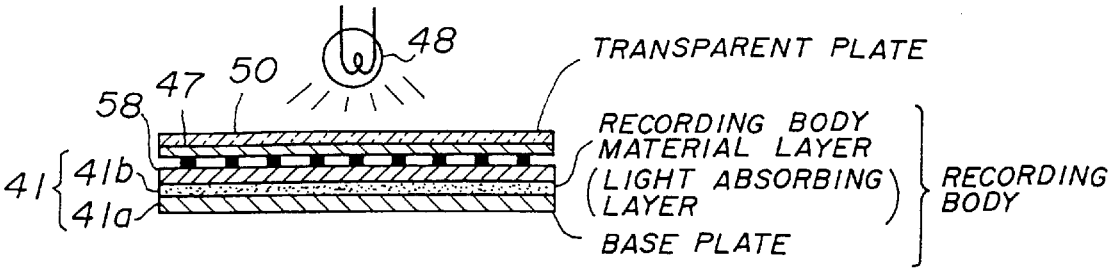

FIGS. 20A, 20B, 20C1 and 20C2 illustrate the present invention in the twelfth aspect. FIG. 20A shows the recording body used in the recording method in the present invention in the tenth aspect. Specifically, a removable contact member holding layer 57 (for holding wettability and protecting the recording body material layer and so forth) is provided on the recording surface of the recording body 41, which surface is in the liquid attraction state. The contact member holding layer 57 may be the same as that of the present invention in the tenth aspect. However, it is necessary that the shape and material of the contact member holding layer 57 is such that the recording body 41 with the contact member holding layer 57 can be used in a recording apparatus which is used for forming an original image on the surface of the recording body opposite to the recording surface. For example, in a case where an original image is formed on the surface of the recording body opposite to the recording surface using a printer, it is necessary that the thickness of the recording body 41 with the contact member holding body 57 is such that the printer can be used for the recording body 41 with the contact member holding body 57. Further, in a case where an original image is formed using an apparatus, using toner, such as a laser printer, it is necessary that the contact member holding body 57 is made of materials which is heating temperature proof when the toner is fixed to the recording body 41.

By providing the contact member holding layer 57, which fulfills the above-mentioned conditions, on the recording surface of the recording body 41, it is possible to use a recording apparatus, having a heating mechanism in a recording process, such as a PPC, a laser printer, thermal transfer printer or the like, as shown in FIG. 20B. Thereby, an original image can be formed using the thermochromic transparent film. Further, a finer original image can be formed. Further, when an original image is formed on the recording body 41, the contact member holding layer 57 prevents the recording surface of the recording body 41 from being damaged by rollers and/or other parts/components while the recording body is carried in a recording apparatus.

<Embodiment 12>

The recording body (41):

the recording body material layer: poly-fluoroalkyl-acrylates (LS317 of Asahi Glass Corporation), light absorbing minute particles (carbon black) are dispersed by 5% in the stock solution;

the recording body base plate: a PET film (size: 80 mm by 100 mm, thickness: 125 $\mu$m).

The contact member holding layer (57):

the contact member: polyethylene glycol;

the holding member: a PET film (size: 110 mm by 210 mm, thickness: 70 $\mu$m).

The recording agent: oil based ink: waterless ink (Aqualess Super (registered trademark) KB black M of Toyo Ink Mfg. Co., Ltd.);

The heating means: a flash for Print Gocco (registered trademark) (PG-10 of Riso Kagaku Corp.);

The liquid-attraction-state forming liquid: polyethylene glycol.

The developing means: an ink roller of rubber (hardness: 60°).

The development speed: 700 mm/s.

The recording paper: PPC paper.

In the above-mentioned conditions, in a method similar to the method of the embodiment 7-1, the recording body recording surface is in the ink attraction state. Then, a toner image is formed on the surface of the recording body 41 opposite to the recording surface, the recording body 41 having the contact member holding layer 57 provided on the recording layer. Then, after removing the contact member holding layer 57 from the recording body 41, a flash is used for exposing the entire recording surface of the recording body from the surface opposite to the recording surface. Thus, a latent image is formed. Then, the development is performed using the ink roller with the oil based ink. As a result, a clear image can be obtained on the recording body. Further, as a result of transferring the developed image to the PPC paper, a good image is obtained in each of a direct transfer and an offset transfer.

Description of the Present Invention in the Thirteenth Aspect

FIGS. 21A through 21D illustrate the present invention in the thirteenth aspect. The figures show methods for forming a latent image using a paper original image sheet 47 by exposing the recording body 41 in each of the recording bodies used in the present invention in the eighth and ninth aspects. When a latent image is formed, as shown in FIGS. 21A through 21D, a halogen lamp, a xenon lamp, a strobe using a xenon discharge tube or the like, a one-time flash or the like 48 is used for irradiating the recording body 41 through an original image paper sheet. The original image paper sheet is obtained as a result of recording an original image using recording agent having a non-light-transmission property on a recording paper sheet having light-transmission property. Thereby, the recording body is selectively exposed and a latent image is formed.

However, generally speaking, light is dispersed by an air layer which the paper original image sheet 47 includes when the paper sheet is dry. Thereby, light absorbed by the light absorbing layer results in a border between the image portion and the non-image portion being blurred. Further, because light intensity is much reduced, it is not possible to form a good latent image. In order to prevent such a situation, an original image sheet, including an air layer, such as a paper sheet, is damped by liquid so that the air in the original image sheet is removed. Thereby, light dispersion is reduced. Liquid for dampening an original image sheet may be any one as long as the liquid does not damage the original image sheet and does not dissolve recording agent forming an original image of the original image sheet. For example, ethanol, ethylene glycol, glycerine or the like can be used for this purpose.

When the damped original image sheet is placed on the recording body material layer and the recording body is exposed, the liquid of the original image sheet adheres to the recording body material layer. Thereby, the non-image portion also comes to be in the liquid attraction state. In order to prevent such a situation, it is preferable that the exposure of the recording body is performed after the damped original image sheet is placed on the surface of the recording body opposite to the recording surface. Further, when the contact between the original image sheet 47 and the recording body 41 is improved, light dispersion can be reduced well. Accordingly, it is preferable to applying a pressure when exposure is performed.

Thus, by using a damped original image sheet, it is possible to use a paper original image sheet in the latent image method using exposure. As a result, the method in the invention in the thirteenth aspect is convenient especially for private easy printing.

<Embodiment 13>

The recording body (41):

the recording body material layer (41*b*): poly-fluoroalkyl-acrylates (LS317 of Asahi Glass Corporation)+light absorbing members (black pigment containing carbon);

the recording body base plate (41*a*): a PET film (size: 100 mm by 150 mm, thickness: 125 $\mu$m).

The recording agent: oil based ink: waterless ink (Aqualess Super (registered trademark) KB black M of Toyo Ink Mfg. Co., Ltd.);

The heating means:

a flash for Print Gocco (registered trademark) (PG-10 of Riso Kagaku Corp.);

an original image sheet (47): obtained from printing an original image using a PPC on a paper sheet.

The original-image-sheet dampening liquid: ethanol.

The liquid-attraction-state forming liquid: polyethylene glycol.

The developing means: an ink roller of rubber (hardness: 60°).

The development speed: 700 mm/s.

The recording paper: PPC paper.

In the above-mentioned conditions, in a method similar to the method of the embodiment 7-1, the recording body recording surface is in the ink attraction state. Then, using a paper original image sheet which is impregnated with ethanol, in the arrangement shown in FIG. 21C, a latent image is formed. Then, the development is performed using the ink roller with the oil based ink. As a result, a clear image can be obtained on the recording body. Further, as a result of transferring the developed image to the PPC paper, a good image is obtained in each of a direct transfer and an offset transfer.

Description of the Present Invention in the Fourteenth Aspect

FIGS. 22A through 22D illustrate the present invention in the fourteenth aspect. The figures show a liquid cut-off layer 58 between the original image sheet dampened with liquid and the recording body 41 in the methods used in the invention in the thirteenth aspect. In the arrangement of the present invention in the thirteenth aspect, the original image sheet is placed on the surface of the recording body opposite to the recording surface. Accordingly, light dispersion occurring during light transmission from the surface of the recording body opposite to the recording surface to the light absorbing layer may degrade latent image quality. In comparison to this, in the invention in the fourteenth aspect, by inserting the liquid cut-off layer 58, which is thin, such as a transparent film, between the original image sheet 47 and recording body 41, the exposure can be performed from the recording body recording surface side. Thereby, it is possible to reduce light dispersion occurring during light transmission to the light absorbing layer. Thereby, it is possible to improve the latent image quality. However, it is necessary that the thickness of the liquid cutting off layer 58 is smaller than the recording body base plate, and also, the liquid cut-off layer 58 cuts off heat generated from the original image sheet. Further, it is necessary that the liquid cutting off layer 58 has heat resistance and transmits light. Accordingly, it is preferable that the material of the liquid cut-off layer 58 is transparent and has heat resistance. For example, PET, fluororesin, other resins, transparent rubber such as silicon rubber, and so forth are suitable for this purpose.

<Embodiment 14>

The recording body (41):

the recording body material layer (41*b*): poly-fluoroalkyl-acrylates (LS317 of Asahi Glass Corporation);

the recording body base plate (41*a*): a PET film+a paint layer including carbon (size: 100 mm by 150 mm, thickness: 125 μm).

The recording agent: oil based ink: waterless ink (Aqualess Super (registered trademark) KB black M of Toyo Ink Mfg. Co., Ltd.);

The heating means:

a flash for Print Gocco (registered trademark) (PG-10 of Riso Kagaku Corp.); and an original image sheet (47): obtained from printing an original image using a PPC on a paper sheet.

The original-image-sheet dampening liquid: polyethylene glycol.

The liquid cutting off layer (58): a transparent PET film having a thickness of 125 μm.

The liquid-attraction-state forming liquid: ethylene glycol.

The developing means: an ink roller of rubber (hardness: 60°).

The development speed: 700 mm/s.

The recording paper: PPC paper.

In the above-mentioned conditions, in a method similar to the method of the embodiment 7-1, the recording body recording surface is caused to be in the ink attraction state. Then, using a paper original image sheet which is impregnated with ethanol, in the arrangement shown in FIG. 22A, a latent image is formed. Then, the development is performed using the ink roller with the oil based ink. As a result, a clear image can be obtained on the recording body. Further, as a result of transferring the developed image to the PPC paper, a good image is obtained in each of a direct transfer and an offset transfer.

In the invention of the thirteenth and fourteenth aspects, it is advantageous that an original image sheet such as a paper sheet can be directly used. However, a paper sheet or the like is dampened by the liquid, a user may stain his or her hands.

Description of the Present Invention in the Fifteenth Aspect

Figure 23B:
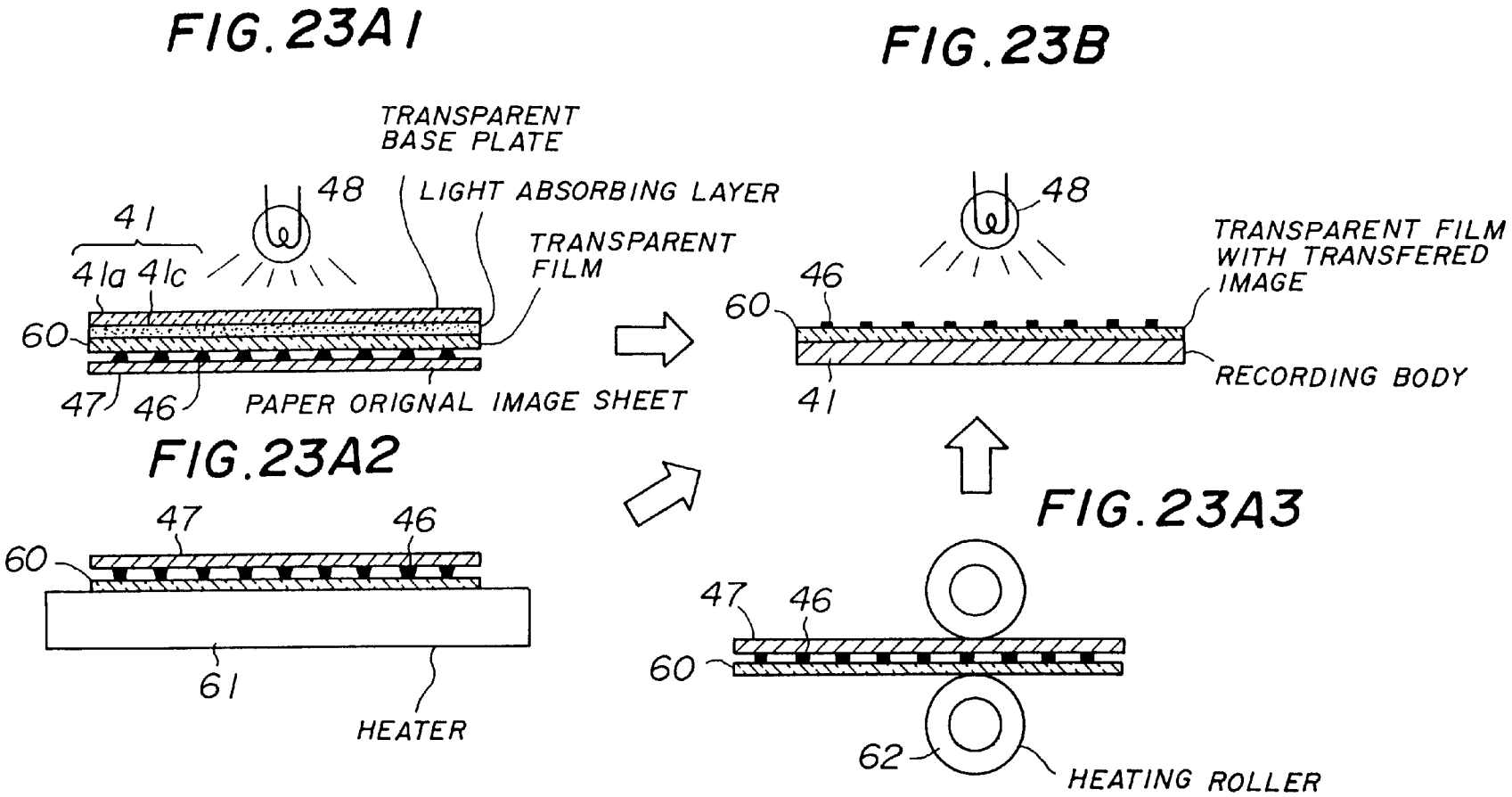

The present invention in the fifteenth aspect solves the above-mentioned problem. FIGS. 23A1, 23A2, 23A3 and 23B illustrate the invention in the fifteenth aspect. In the invention in the fifteenth aspect, the recording agent on the paper original image sheet 47 is melted by heat and is transferred to a transparent film 60. The image-formed transparent film 60 is placed on the recording body 41. Then, the recording body is exposed from the transparent film side. Thereby, using heat thus generated by the light absorbing layer or the light absorbing member which the recording body has, a latent image is formed on the recording body 41. As methods of transferring the recording agent on the original image sheet to the transparent sheet 60, for example, as shown in FIG. 23A1, the transparent film (to be transferred to) 60 is placed on the image surface of the original image sheet 47 (to be transferred from). Then, the base plate made of the light absorbing member or the transparent base plate having the light absorbing member are placed on the transparent film 60. Then, exposure is performed from the base plate made of the light absorbing member side or the transparent base plate having the light absorbing member side, a halogen lamp, a xenon lamp, a strobe using a xenon discharge tube or the like, a one-time flash or the like 48. Thereby, the light absorbing layer is heated, the heat is used for melting the recording agent on the original image sheet 47, and the recording agent is transferred to the transparent film 60. In another method, as shown in FIG. 23A2, a transparent film 60 is placed on a hot plate 61, then, the original image sheet 47 is placed on the transparent film 60 so that the image surface of the original image sheet 47 comes in contact with the transparent film 60. Thereby, the heat generated by the hot plate 61 is used for melting the recording agent on the original image sheet 47, and the recording agent is transferred to the transparent film 60. In another method, as shown in FIG. 23A3, the original image sheet 47 is placed on the transparent film 60 so that the image surface of the original image sheet 47 comes in contact with the transparent film 60. Then, the original image sheet 47 and the transparent film 60 together are caused to pass between a heating roller 62 and an auxiliary roller. Thereby, the heat generated by the heating roller 62 is used for melting the recording agent on the original image sheet 47, and the recording agent is transferred to the transparent film 60.

It is preferable that the material of the transparent film 60 is transparent and has heat resistance. For example, PET, fluororesin, other resins, transparent rubber such as silicon rubber, and so forth are suitable for this purpose. The heating temperature depends on a particular recording agent. In a case where toner, using in an electrophotographic recording apparatus, is used as the recording agent, the heating temperature on the order of 100 through 180° C. is suitable. However, if the heating temperature is higher than this temperature range, as long as the transparent film and the original image sheet are not damaged, the higher heating temperature can be used.

Thus, by transferring the recording agent to the transparent film and using the transparent film instead of the original image sheet, the paper original image sheet can be used without dampening it and thus use of the original image sheet is convenient.

<Embodiment 15>

The recording body (41):

the recording body material layer: poly-fluoroalkyl-acrylates (LS317 of Asahi Glass Corporation);

the recording body base plate (41*a*): a PET film+a paint layer including carbon (size: 100 mm by 150 mm, thickness: 125 μm).

The recording agent: oil based ink: waterless ink (Aqualess Super (registered trademark) KB black M of Toyo Ink Mfg. Co., Ltd.);

The heating means (for forming a latent image): a flash for Print Gocco (registered trademark) (PG-10 of Riso Kagaku Corp.);

The heating means (for melting ink on the original image sheet): the heating roller (62) (a roller made of aluminum with a built-in ceramic heater, 150° C. fixed).

The transparent film: a PET film (size: 100 mm by 150 mm, 100 μm thickness)

The original image sheet (47): obtained from printing an original image using a PPC on a paper sheet.

The liquid-attraction-state forming liquid: ethylene glycol.

The developing means: an ink roller of rubber (hardness: 60°).

The development speed: 700 mm/s.

The recording paper: PPC paper.

In the above-mentioned conditions, in the arrangement shown in FIG. 23A3, the toner on the original image sheet is transferred to the PET film. In a method similar to the method of the embodiment 7-1, the recording body recording surface is in the ink attraction state. Then, using the PET film and the recording body, a latent image is formed in the arrangement shown in FIG. 23B. Then, the development is performed using the ink roller with the oil based ink. As a result, a clear image can be obtained on the recording body. Further, as a result of transferring the developed image to the PPC paper, a good image is obtained in each of a direct transfer and an offset transfer.

Description of the Present Invention in the Sixteenth Aspect

The present invention in the sixteenth aspect also solves the above-mentioned problem that a user may stain his or her hands.

Figures 24A, 24B:
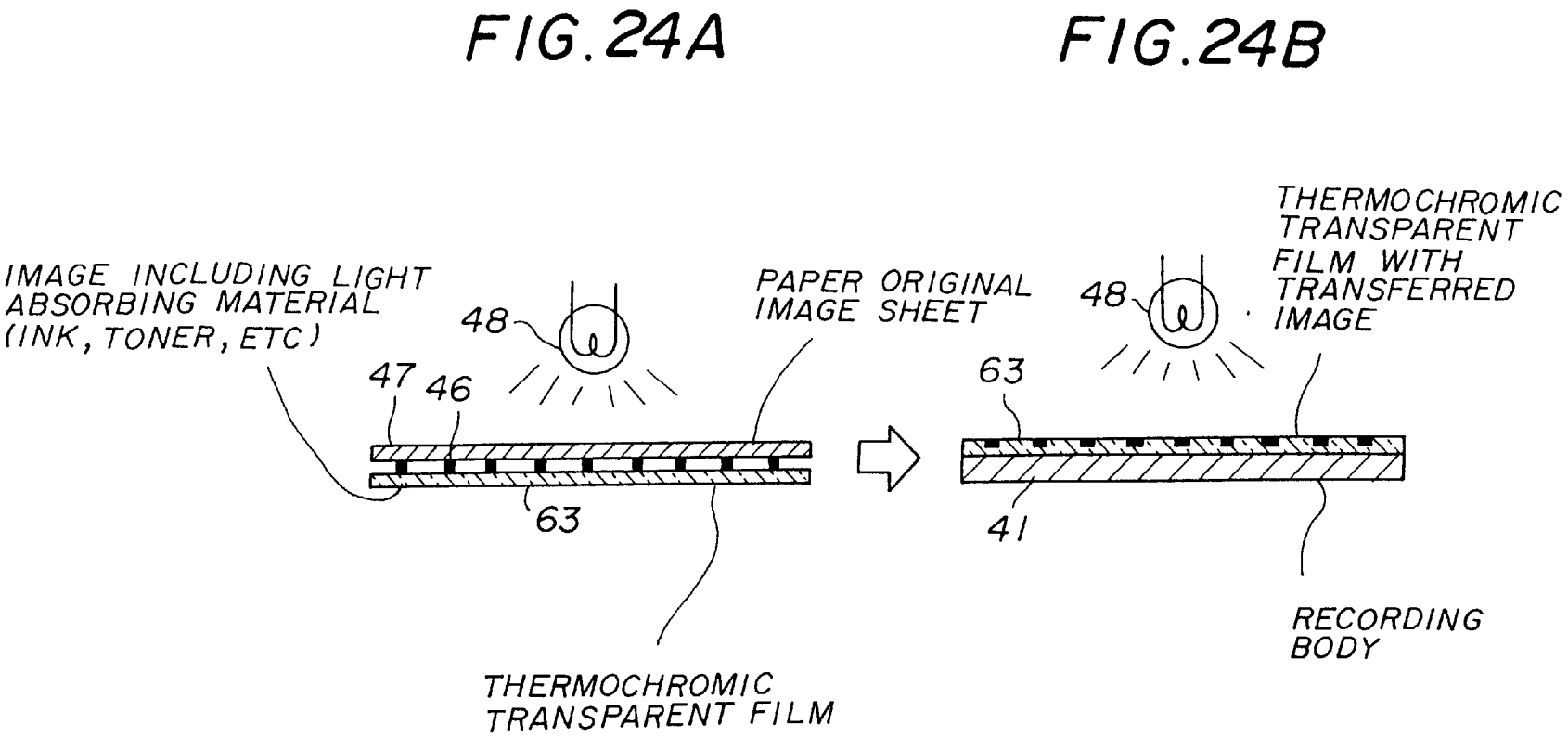
FIGS. 24A and 24B illustrate the present invention in a sixteenth aspect.

FIGS. 24A and 24B illustrate the present invention in the sixteenth aspect. The figures show a method for forming a latent image. In the method, the paper original image sheet 47 is placed on a thermochromic transparent film 63 so that the image surface of the paper original image sheet 47 comes into contact with the thermochromic transparent film 63. Then exposure is performed from the original image sheet side, and thereby, light absorbing members contained in the recording agent 46 are heated. Thereby, the same image as that of the original image sheet 47 is formed in the thermochromic transparent film 63. The thus-obtained film 63 is used instead of the transparent original image sheets shown in FIGS. 15A and 17A for forming a latent image on the recording body 41. The thermochromic transparent film used may be a type for which only one thermochromic reaction is possible, and also, may be of a reversible type for which a thermochromically colored portion is erased and thereby writing can be repeated.

Thus, by transferring the original image to the thermochromic transparent film and using the film instead of the original image sheet, the paper original image sheet is prevented from being damaged, the paper original image sheet can be used without dampening it and thus use of the original image sheet is convenient.

<Embodiment 16>

The recording body (41):

the recording body material layer: poly-fluoroalkyl-acrylates (LS317 of Asahi Glass Corporation); and the recording body base plate: a PET film+a paint layer including carbon (size: 100 mm by 150 mm, thickness: 125 $\mu$m).

The recording agent: oil based ink: waterless ink (Aqualess Super (registered trademark) KB black M of Toyo Ink Mfg. Co., Ltd.).

The heating means (for forming a latent image): a flash for Print Gocco (registered trademark) (PG-10 of Riso Kagaku Corp.).

The heating means (for transferring the original image to the thermochromic transparent film): a flash for Print Gocco (registered trademark) (PG-10 of Riso Kagaku Corp.).

The thermochromic transparent film: Thermochromic OHP film (black coloring type of NBS Ricoh Co., Ltd.).

The original image sheet (47): obtained from printing an original image using a PPC on a paper sheet.

The liquid-attraction-state forming liquid: water.

The developing means: an ink roller of rubber (hardness: 60°).

The development speed: 700 mm/s.

The recording paper: woodfree paper.

In the above-mentioned conditions, in the arrangement shown in FIG. 24A, the original image of the original image sheet 47 is transferred to the thermochromic transparent film 63. In a method similar to the method of the embodiment 7-1, the recording body recording surface is in the ink attraction state. Then, using the film 63 and the recording body 41, a latent image is formed in the arrangement shown in FIG. 24B. Then, the development is performed using the ink roller with the oil based ink. As a result, a clear image can be obtained on the recording body. Further, as a result of transferring the developed image to the woodfree paper, a good image is obtained in each of a direct transfer and an offset transfer.

Description of the Present Invention in the Seventeenth Aspect

Figure 25A:
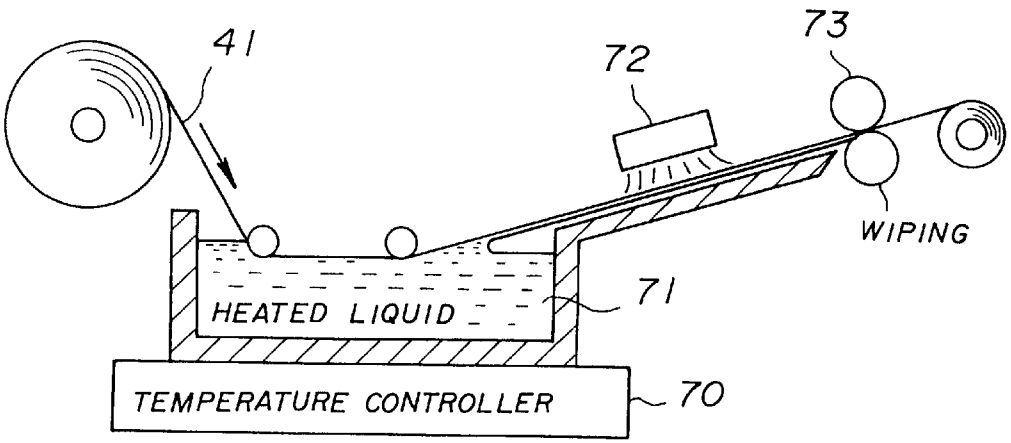
FIGS. 25A and 25B illustrate the present invention in a seventeenth aspect.
Figure 25B:
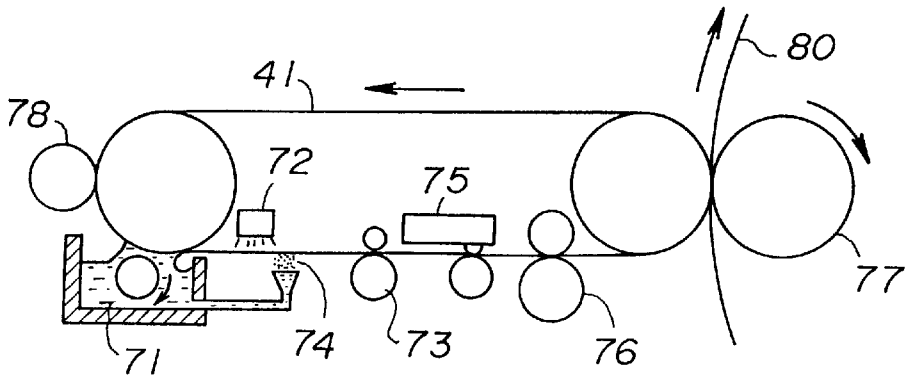

FIGS. 25A and 25B illustrate the present invention in the seventeenth aspect. The figures show a temperature controller 70, a heated liquid 71, a cooling device 72, a wiping roller 73, a liquid collecting mechanism 74, a latent-image forming heating portion 75, a latent image developing portion 76, a transfer roller 77, a cleaning roller 78 and a recording paper sheet 80. The figures show methods for manufacturing the recording body (master printing plate) 41, the entire recording surface thereof being in the liquid attraction state or renewing it. It is necessary that the entire recording surface of the recording body used in the invention in the seventh aspect is in the liquid attraction state when a latent image is formed. For this purpose, the entire recording surface of the recording body is made to be in the liquid attraction state in the recording body manufacturing stage, or the entire recording surface of the recording body is made to be in the liquid attraction state inside the recording apparatus.

FIG. 25A shows an example of a method of causing the entire recording surface of the recording body 41 to be in the liquid attraction state before the recording body 41 is shipped from the factory. FIG. 25B shows an example of a method of and thus causing the entire recording surface of the recording body 41 to be in the liquid attraction state so as to renew it inside the recording apparatus.

In the method shown in FIG. 25A, the recording body 41 is drawn from a roll of the recording body 41, and the drawn recording body 41 is caused to pass through the heated liquid 71. Then, the recording body 41 and the liquid adhering to the recording body recording surface are is cooled by the cooling device 74. Merely thereby, the recording surface of the recording body which includes a liquid repelling area can be changed to be in the liquid attraction state. Thus, a large amount of the recording body can be in the liquid attraction state.

In the method of FIG. 25B, a mechanism for causing the heated liquid 71 to come into contact with the recording body recording surface is provided inside the apparatus. Accordingly, it is not necessary to take out the recording body from the apparatus each time when a latent image of a different image is formed on the recording body 41. It is possible to easily repeat latent image formation to the recording body 41.

In each method, it is preferable that, after the recording body is heated, the recording body having the liquid adhering thereto is forcibly cooled, and, after cooling, the liquid adhering to the recording body is wiped off. However, when wiping off the liquid, in order to prevent the recording body recording surface from being damaged, it is preferable to use a material which is a soft and is superior in liquid absorbing property, and also, it is preferable to perform the wiping without rubbing the recording body recording surface. Further, by returning the wiped liquid to the liquid container, consumption of the liquid can be reduced. Further, it is preferable that the temperature of the liquid is measured, at any time or periodically, by a temperature sensor, a temperature measuring IC, a temperature measuring system and so forth, and thus, the temperature of the liquid is controlled in an appropriate temperature range.

Basically, any kinds of liquid can be used as the liquid for causing the recording body recording surface to be in the liquid attraction state as long as the liquid does not damage the recording body, and does not evaporate and maintains the liquid state in the heating temperature (the temperature by which the receding contact angle of the recording body sufficiently decreases). For example, water, ethylene glycol, polyethylene glycol, glycerine or the like can be used for this purpose.

The methods in the present invention in the seventeenth aspect can be applied to mass production of the recording body in a factory and also to repeating renewal of the recording body inside the apparatus.

<Embodiment 17-1>

The recording body (41):

the recording body material layer: poly-fluoroalkyl-acrylates (LS317 of Asahi Glass Corporation and TG702 of Daikin Industries Ltd.); and the recording body base plate: a PET film (size: a sheet of 100 mm by 1000 mm, thickness: 125 μm).

The recording agent:

oil based ink: waterless ink (Aqualess Super (registered trademark) KB black M of Toyo Ink Mfg. Co., Ltd.);

water based ink: coloring material (black pigment 5% by weight, average particle diameter: equal to or less than 1 μm)+solvent (ethylene glycol 20% by weight)+water soluble resin (polyvinylpyrrolidone 75% by weight).

The heating means (for forming a latent image): a thermal head (300 dpi, F2459A of Toshiba Corp.);

The heating means (for forming the ink attraction state): a thermostatic chamber (110° C. fixed).

The recording body carrying speed when the master printing plate (41) is produced: 30 mm/s.

The liquid-attraction-state forming liquid: ethylene glycol.

The developing means: an ink roller of rubber (hardness: 60°) (the arrangement of FIG. 13E1).

The development speed:

500 mm/s when the oil based ink is used;

600 mm/s when the water based ink is used.

The recording paper: woodfree paper.

In the above-mentioned conditions, as shown in FIG. 25A, the recording body 41 is carried in a thermostatic chamber containing ethylene glycol heated to 110° C. in a manner in which the recording surface of the recording body 41 comes into contact with the heated liquid 71. Then, a fan 72 cools the recording body which has been carried out from the thermostatic chamber and has the liquid adhering thereto. Then, a sponge-made wiping roller 73 absorbs the liquid which adheres to the recording body 41. Thereby, the recording body master printing plate with the recording surface in the liquid attraction state can be produced efficiently within a short time. Then, using the recording body master printing plate produced in this method, in accordance with the procedure of FIG. 13D and then FIG. 13E1, image recording is performed in an arrangement without the cleaning portion and the latent image erasing portion. As a result, a clear image can be obtained on the recording body. Further, as a result of transferring the developed image to the woodfree paper, a good image is obtained in each of a direct transfer and an offset transfer. Further, as a result of performing this procedure in a condition where the combination of the material of the recording body material layer and the recording agent is changed, a good image is obtained in any combination.

<Embodiment 17-2>

The recording body (41):

the recording body material layer: poly-fluoroalkyl-acrylates (LS317 of Asahi Glass Corporation); and the recording body base plate: polyimide film of Toray-Dupont Co., Ltd. (size: a ϕ-110-mm seamless film, thickness: 20 μm).

The recording agent: water based ink: coloring material (black pigment 5% by weight, average particle diameter: equal to or less than 1 μm)+solvent (ethylene glycol 20% by weight)+water soluble resin (polyvinylpyrrolidone 75% by weight).

The heating means (for forming a latent image): a thermal head (75) (300 dpi, F2459A of Toshiba Corp.);

The heating means (for forming the ink attraction state): a thermostatic chamber (120° C. fixed).

The recording body carrying speed when the master printing plate is produced: 30 mm/s.

The liquid-attraction-state forming liquid: ethylene glycol.

The cleaner (78): a sponge impregnated with water.

The developing means: an ink roller (76) of rubber (hardness: 60°) (the arrangement shown in FIG. 25B).

The development speed: 5 mm/s.

The recording paper: coated paper.

In the above-mentioned conditions, as shown in FIG. 25B, the recording body 41 is carried in the thermostatic chamber containing ethylene glycol heated to 120° C. in a manner in which the recording surface of the recording body 41 comes into contact with the heated liquid 71. Then, a fan 72 cools the recording body which has been carried out from the thermostatic chamber and has the liquid adhering thereto. Then, a sponge-made wiping roller 73 absorbs the liquid which adheres to the recording body 41. Thereby, the recording body master printing plate with the recording surface in the liquid attraction state can be obtained by renewal efficiently within a short time. Then, the thermal head 75 is used for forming a latent image and the ink roller 76 is used for developing the latent image. As a result, a clear image can be obtained on the recording body. Further, as a result of transferring the developed image to the coated paper 80, a good image is obtained.

Further, as a result of repeating the same process a plurality of times, renewal of the recording body master printing plate is performed well. Further, as a result of transferring the developed image to a recording paper sheet 80, no stains appear in the background and no residual image of latent images, which have been formed and erased a plurality of times, is present. As a result, high-quality images are obtained.

Description of the Present Invention in the Eighteenth Aspect

Figure 26B:
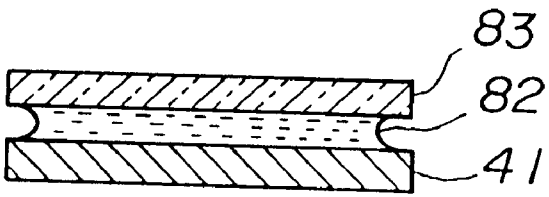
FIGS. 26A and 26B illustrate the present invention in an eighteenth aspect.
Figure 26A:
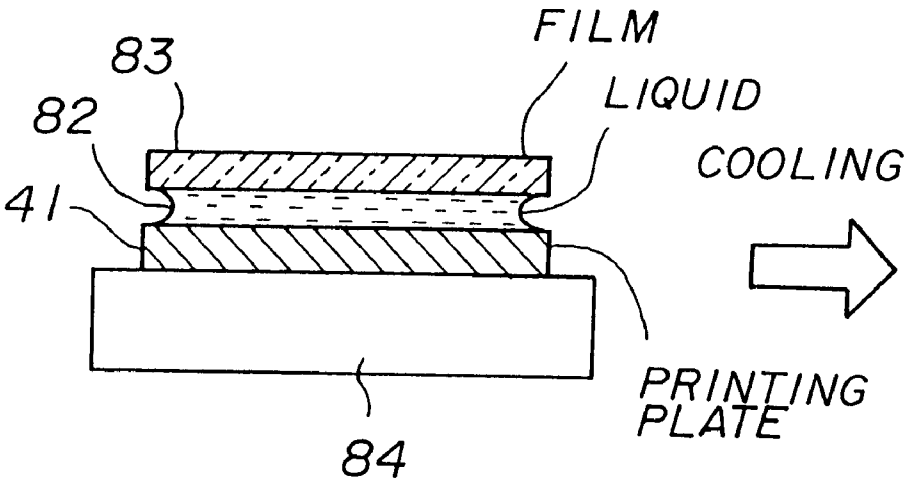

FIGS. 26A and 26B illustrate the present invention in the eighteenth aspect. The figures show a method of causing the recording surface of the recording body 41 to be in the liquid attraction state as a result of heating and cooling the recording body (printing plate) 41 in a condition where the recording body 41 holds a thin layer of a liquid (ethylene glycol, polyethylene glycol, of the like) 82 on the recording surface thereof. Basically, any material, such as resin, metal, rubber, plastic, cloth, synthetic paper sheet and so forth, can be used as a member 83 which holds the thin layer of the liquid 82, as long as the material does not absorb so as to remove the liquid layer and has a liquid resistance and heat resistance. Any method, such as using a hot plate 84 or an iron, and so forth, can be used as the method for heating the recording body 41 with the thin layer of the liquid 82 and the holding film 83, as long as the method is a method of heating the recording body to a temperature appropriate so that the receding contact angle of the recording body sufficiently decreases. Any method, such as leaving the recording body 41 with the layer 82 and member 83 alone after turning off the heating means, cooling by pouring tap water from the top, cooling by causing air to blow, putting on a cold good heat conductor such as a metal or the like, cooling by putting in a refrigerator or a freezer, and so forth, can be used as the method of cooling the recording body 41 with the thin layer of the liquid 82 and the holding film 83, as long as the method is a method of cooling the recording body to a temperature equal to or less than the temperature at which decrease of the receding contact angle of the recording body starts.

By using the present invention in the eighteenth aspect, a small recording body can be efficiently caused to be in the liquid attraction state with a small quantity of liquid, with a short time of heating and a short time of cooling.

<Embodiment 18>

The recording body (41):

the recording body material layer: poly-fluoroalkyl-acrylates (LS317 of Asahi Glass Corporation); and the recording body base plate: a PET film+a paint layer including carbon particles (size: 100 mm by 150 mm, thickness: 125 μm).

The recording agent: oil based ink: waterless ink (Aqualess Super (registered trademark) KB black M of Toyo Ink Mfg. Co., Ltd.).

The heating means (for forming a latent image): a flash for Print Gocco (registered trademark) (PG-10 of Riso Kagaku Corp.).

The original image sheet: obtained from printing an original image using a PPC on a OHP film.

The heating means (for forming the ink-attraction-state): a hot plate (84) (110° C. fixed).

The liquid layer holding member (83): a PET film (size: 110 mm by 160 mm, thickness: 70 μm).

The liquid-attraction-state forming liquid: ethylene glycol.

The developing means: an ink roller (76) of rubber (hardness: 60°) (the arrangement shown in FIG. 25B).

The development speed: 700 mm/s.

The recording paper: coated paper.

In the above-mentioned conditions, ethylene glycol 82 is placed on the recording surface of the recording body 41, and the PET film 83 is placed on the ethylene glycol 82. The recording body 41 with the ethylene glycol 82 and the PET film 83 is heated for 10 minutes by the hot plate 84 which has been heated to 110° C. Then, the recording body 41 is cooled by tap water in a condition where the recording body 41 holds the liquid on the recording surface thereof. Thus, it is possible to produce the recording body master printing plate, the recording surface of which is in the liquid attraction state. After drying the produced recording body master printing plate, using it, latent image formation is performed by exposure with the flash, and development of the latent image is performed by the ink roller. As a result, a clear image can be obtained on the recording body. Further, as a result of transferring the developed image to the coated paper, a good image is obtained.

Description of the Present Invention in the Nineteenth Aspect

Figure 27A:
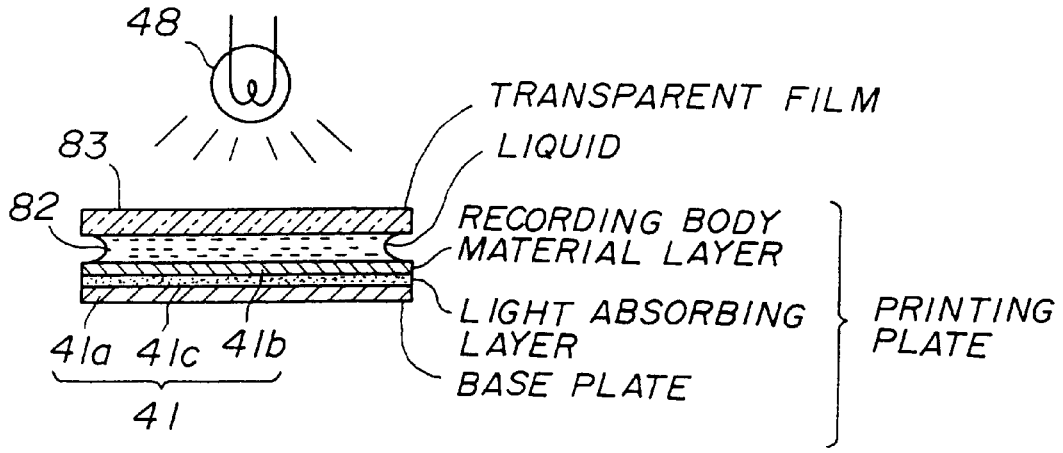
FIGS. 27A and 27B illustrate the present invention in a nineteenth aspect.
Figure 27B:
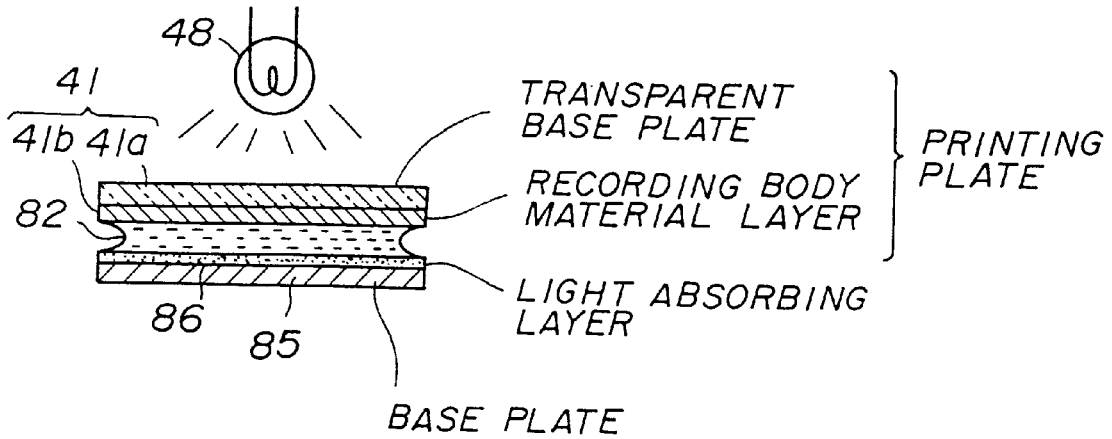

FIGS. 27A and 27B illustrate the present invention in the nineteenth aspect. The figures shows methods of heating of the recording body, which methods can be used for manufacture and renewal of the recording body master printing plate in the present invention in the eighteenth aspect. Specifically, in a case where the recording body 41 includes the light absorbing layer 41*c*, liquid (ethylene glycol, polyethylene glycol, of the like) 82 is placed on the recording body material layer 41*b* of the recording body 41, and then, a transparent film 83 is placed on the liquid 82. Then, from the top of the film 83, exposure is performed using a halogen lamp, a xenon lamp, a strobe using a xenon discharge tube or the like, a one-time flash or the like 48. Thereby, the light absorbing layer 41*c* of the recording body 41 is heated, and, by the heat, the liquid 82 is heated and the recording body material layer 41*b* is heated. Then, in a method similar to the method described in the description of the invention in the eighteenth aspect, cooling is performed, and thereby, the recording surface of the recording body 41 is in the liquid attraction state.

Basically, any material can be used as the transparent film 83, such as resin, rubber, plastic and so forth, as long as the material transmits light, does not absorb and remove the liquid layer and has a liquid resistance and heat resistance.

In a case where the recording body 41 does not include the light absorbing layer 41*c*, as shown in FIG. 27B, the liquid 82 is placed on a base plate 85 made of a light absorbing member or on the light absorbing layer surface of a transparent base plate 85 which has a light absorbing layer 86. Then, the recording body material layer 41*b* of the recording body 41 is placed on the liquid 82. Then, the above-described exposure is performed on the surface of the recording body 41 opposite to the recording surface. Thus, the liquid 82 is heated. Then, in a method similar to the method described in the description of the invention in the eighteenth aspect, cooling is performed, and thereby, the recording surface of the recording body 41 is in the liquid attraction state.

By using the methods in the invention in the nineteenth aspect, the exposure mechanism which is used for forming a latent image can also be used as the liquid-attraction-state forming means of the recording body recording surface. Accordingly, the apparatus arrangement is simple and costs therefor can be reduced.

<Embodiment 19>

The recording body (41):

the recording body material layer: poly-fluoroalkyl-acrylates (LS317 of Asahi Glass Corporation); and the recording body base plate: a PET film+a paint layer including carbon (size: 100 mm by 150 mm, thickness: 125 μm).

The recording agent: oil based ink: waterless ink (Aqualess Super (registered trademark) KB black M of Toyo Ink Mfg. Co., Ltd.).

The heating means (for forming a latent image): a flash for Print Gocco (registered trademark) (PG-10 of Riso Kagaku Corp.).

The original image sheet: obtained from printing an original image using a PPC on a OHP film.

The heating means (for forming the ink-attraction-state): a flash for Print Gocco (registered trademark) (PG-10 of Riso Kagaku Corp.).

The liquid layer holding member (83): a transparent PET film (size: 110 mm by 160 mm, thickness: 70 μm).

The liquid-attraction-state forming liquid: ethylene glycol.

The developing means: an ink roller (76) of rubber (hardness: 60°) (the arrangement shown in FIG. 25B).

The development speed: 700 mm/s.

The recording paper: coated paper.

In the above-mentioned conditions, ethylene glycol 82 is placed on the recording surface of the recording body 41, and the transparent PET film 83 is placed on the ethylene glycol 82. The exposure by the flash is performed on the recording body 41 with the ethylene glycol 82 and the transparent PET film 83 from the transparent pet film side. Then, the recording body 41 is cooled by tap water in a condition where the recording body 41 holds the liquid on the recording surface thereof. Thus, it is possible to produce the recording body master printing plate, the recording surface of which is in the liquid attraction state. After drying the produced recording body master printing plate, using it, latent image formation is performed by exposure with the same flash, and development of the latent image is performed by the ink roller. As a result, a clear image can be obtained on the recording body. Further, as a result of transferring the developed image to the coated paper, a good image is obtained.

Description of the Present Invention in the Twentieth Aspect

Figure 28:
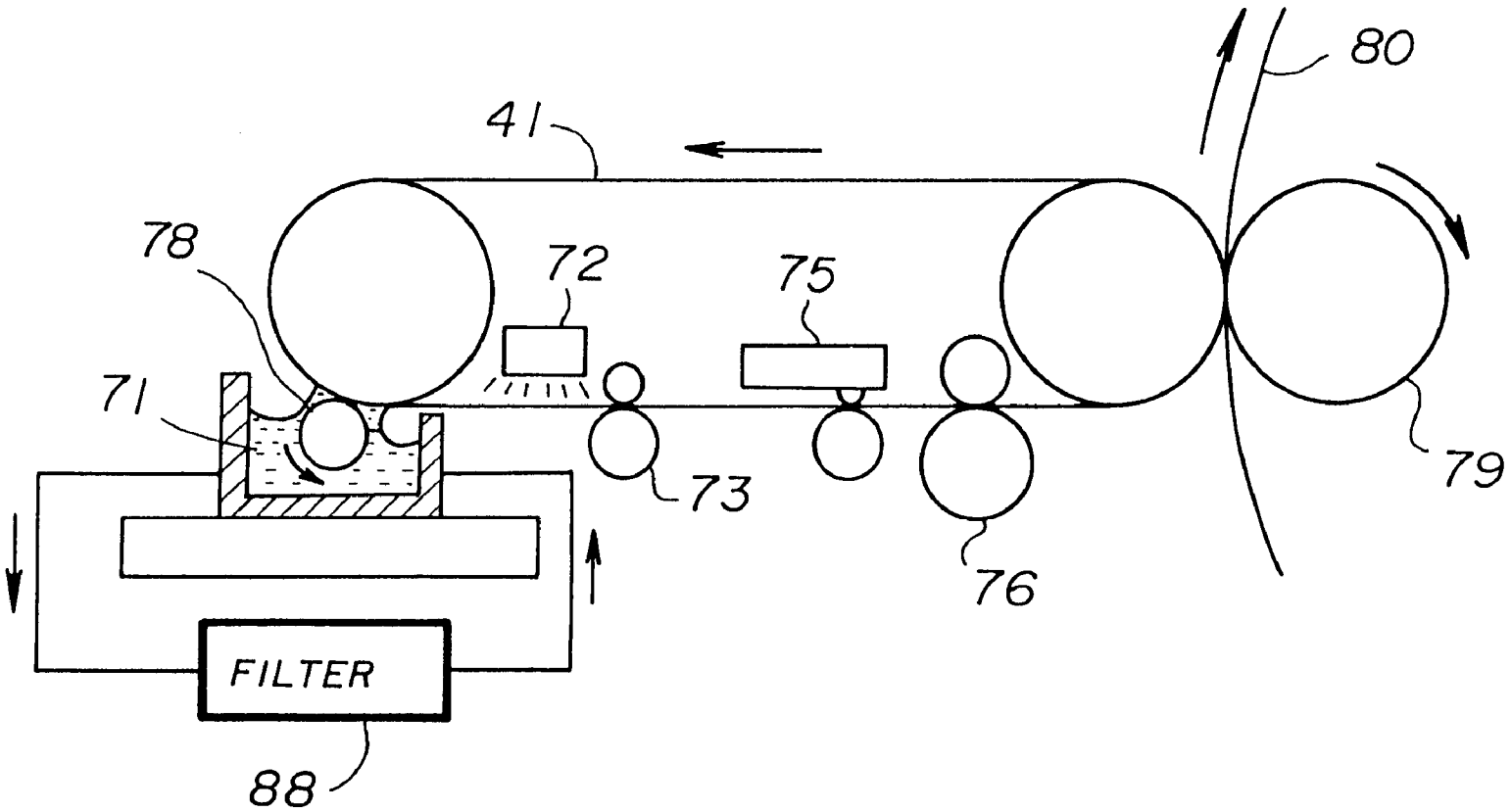
FIG. 28 illustrates the present invention in a twentieth aspect.

FIG. 28 illustrates the present invention in the twentieth aspect. The figure show a method of renewing the recording body master printing plate, which method is suitable for repetitive renewal of the recording body inside the apparatus, in the method in the present invention in the seventeenth aspect. In order to renew the recording body which has been used for having a latent image formed thereon and recording, it is necessary that, first, residual recording agent adhering to the recording body 41 is removed (hereinafter, referred to as 'cleaning'), and then, a latent image is erased.

In the method in the present invention in the twentieth aspect, these two processes are not performed separately, but the two processes are integrated into one process and thus are performed at the same time. For example, as shown in FIG. 28, the cleaning roller 78, which rotates and thus lifts the heated liquid 71, is used. Thereby, it is possible that cleaning of the recording surface of the recording body is performed, and, at the same time, the recording body material layer is heated in a condition where the recording body material layer is in contact with the contact member. In order to improve cleaning performance, it is preferable that the cleaning roller 78 is rotated in the direction reverse to the rotation direction of the recording body 41. The cleaning portion is not limited to the roller shape. Any method may be used as long as the recording body is not damaged, the heated liquid is supplied to the recording body, and cleaning is performed. Therefore, it is necessary that the material of the cleaning portion is such that the cleaning portion does not damage the recording body, can lift the liquid, and can perform cleaning. Accordingly, an elastic porous substance or the like is useful. Basically, any material, such as resin, rubber, plastic, cloth, synthetic paper and so forth, can be used as the cleaning portion as long as the material fulfills the above-mentioned conditions. When cleaning is performed for a long time, the liquid is polluted and the cleaning performance is degraded. Accordingly, it is preferable that the liquid is circulated through a filter 88 or is replaced with a new one periodically. By using the method in the invention in the twentieth aspect, because the processes of the cleaning and latent image erasing are integrated into one process, the apparatus arrangement is simple and the costs therefor can be reduced.

<Embodiment 20>

The recording body (41):

the recording body material layer: poly-fluoroalkyl-acrylates (LS317 of Asahi Glass Corporation); and the recording body base plate: polyimide film of Toray-Dupont Co., Ltd. (size: a ϕ-110-mm seamless film, thickness: 12.5 μm).

The recording agent: water based ink: coloring material (black pigment 5% by weight, average particle diameter: equal to or less than 1 μm)+solvent (ethylene glycol 20% by weight)+water soluble resin (polyvinylpyrrolidone 75% by weight).

The heating means (for forming a latent image): a thermal head (75) (300 dpi, F2459A of Toshiba Corp.);

The heating means (for forming the ink attraction state): a thermostatic chamber (120° C. fixed).

The recording body carrying speed when the master printing plate is produced: 30 mm/s.

The liquid-attraction-state forming liquid: ethylene glycol.

The cleaner (78): a sponge roller.

The developing means: an ink roller (76) of rubber (hardness: 60°).

The development speed: 30 mm/s.

The recording paper: PPC paper.

In the above-mentioned conditions, as shown in FIG. 28, the recording body 41 is carried in the thermostatic chamber containing ethylene glycol heated to 120° C. in a manner in which the recording surface of the recording body 41 comes into contact with the heated liquid 71. At the same time, in the thermostatic chamber, the sponge roller 78 rubs and thus removes residual ink which adheres to the recording surface of the recording body 41. Then, the fan 72 cools the recording body which has been carried out from the thermostatic chamber and has the liquid adhering thereto. Then, the sponge-made wiping roller 73 absorbs the liquid which adheres to the recording body 41. Thus, the cleaning and the forming of the liquid attraction state on the recording surface of the recording body (renewal of the recording body master printing plate) can be performed simultaneously. Thereby, the arrangement is simple. Then, the thermal head 75 is used for forming a latent image and the ink roller 76 is used for developing the latent image. As a result, a clear image can be obtained on the recording body. Further, as a result of transferring the developed image to the PPC paper 80, a good image is obtained. Further, as a result of repeating the same process a plurality of times, renewal of the recording body master printing plate is performed well. Further, as a result of transferring the developed image to a recording paper sheet 80, no stains appear in the background and no residual image of latent images, which have been formed and erased a plurality of times, is present. As a result, high-quality images are obtained.

Description of the Present Invention in the Twenty-first Aspect

An image necessarily has a non-printing area, that is, the margin. The margin has a fixed width independent of image information. Heating the recording body recording surface portion corresponding to the margin when the recording body is heated in accordance with image information results in a large energy loss. In the present invention in the twenty-first aspect, treatment of the margin is considered.

Figure 29A:
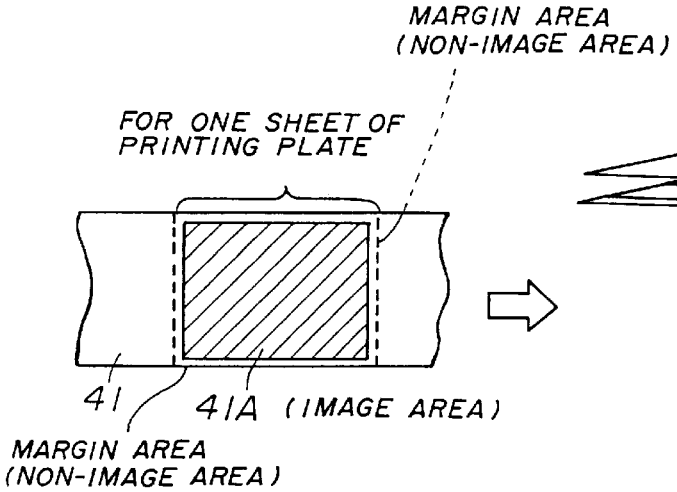
Figure 29A:
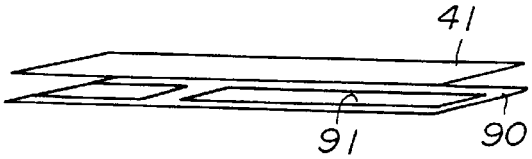
Figure 29A:
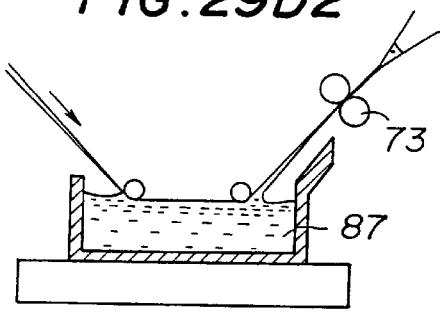
Figure 29A:
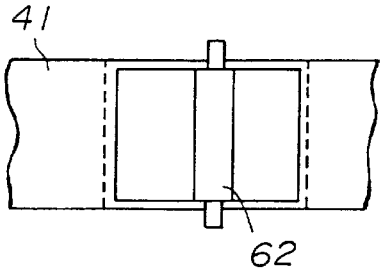
Figure 29A:
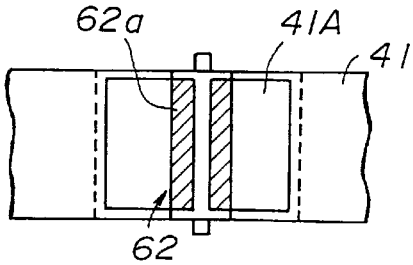
Figure 29A:
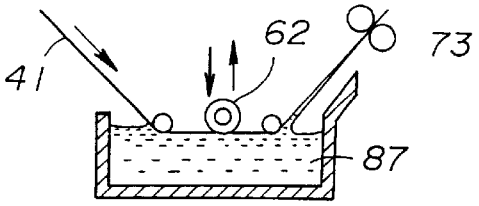
Figure 29A:
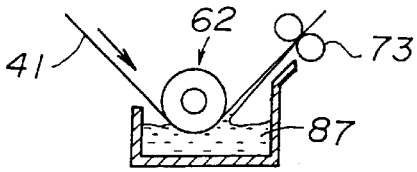

FIGS. 29A through 29D2 illustrate the present invention in the twenty-first aspect. The figures show a method of manufacture and renewal of the recording body master printing plate, in which margin treatment is performed. In the invention in the twenty-first aspect, in recording in which a margin width is previously determined, the liquid attraction state is formed only in the image area excluding the margin portion. Specifically, with reference to FIG. 29A, in each case of a roll-shaped wound recording body, a cut sheet-shaped recording body and a seamless recording body, only the hatched area (image area) 41A is made to be in the liquid attraction state. In each case of the roll-shaped wound recording body and the cut sheet-shaped recording body, the portion (non-image area) obtained as a result of excluding the image area 41A from the printing plate area (defined by the vertical broken lines and the horizontal solid lines in the figure) for one sheet of a printing plate is in the liquid repelling state. In the case of the seamless recording body, the portion excluding the image area is in the liquid repelling state.

A method of causing only the image area to be in the liquid attraction state will now be described. As shown in FIGS. 29B1 and 29B2, a heating roller 62 having the width equal to the vertical length of the image area 41A is used. Another method is that a heating roller which can heat only the width equal to the vertical length of the image area 41A is used. Such a heating roller is caused to come into contact with the surface of the recording body 41 opposite to the recording surface. At the same time, a liquid 87 is caused to come into contact with the recording surface of the recording body 41. In this condition, the recording body 41 is carried and the image area is heated by the heating roller, and then, the image area is cooled in the condition where the recording surface of the recording body 41 is in contact with the liquid 87. For the non-image area, the heating roller is detached from the recording body 41. Thereby, only the image area is caused to be in the liquid attraction state. Another method is shown in FIGS. 29C1 and 29C2. In this method, a heating roller 62, which has a projection portion 62*a* corresponding to the image area 41A, is used. This heating roller 62 has a depression portion corresponding to the non-image area. This heating roller 62 heats only the image area 41A. This heating roller 62 is caused to come into contact with the surface of the recording body 41 opposite to the recording surface. At the same time, the liquid 87 is caused to come into contact with the recording surface of the recording body 41. In this condition , the recording body 41 is carried, and thus, only the image area is made to be in the liquid attraction state. Another method is shown in FIGS. 29D1 and 29D2. In this method, a sheet (a film, a plate, or the like) 90 which has an opening 91 corresponding to the image area 41A. This sheet 90 is caused to come into contact with the recording surface of the recording body 41. In this condition, the heated liquid 87 is caused to come into contact with the recording body 41 from the sheet 90 side. Thereby, only the image area is made to be in the liquid attraction state. It is preferable to manufacture or renew the recording body master printing plate using a method of making only the image area be in the liquid attraction state, such as one of those described above.

In the method shown in FIGS. 29B1 and 29B2, it is necessary that the arrangement is such that bending of the recording body 41 and thereby occurring of position shift of the recording body 41 in response to the heating roller 62 coming into contact with the recording body 41 and being detached from the recording body 41 are prevented. Basically, any material can be used as the heating roller, such as resin, metal, rubber, plastic, and so forth, as long as the material has heat resistance and is not substantially deformed when the roller is caused to come into contact with the recording body. Further, it is convenient that the heating range of the roller is variable for adapting the roller to various recording bodies.

In the method shown in FIGS. 29C1 and 29C2, it is necessary that the depth of the depression portion with respect to the projection portion 62*a* is in a range such that the depression portion does not come into contact with the recording body 41. The projection and depression portions of the roller surface may be made by shaving, molding an entire roller, bonding a molded sheet or a hollow member onto a roller, or the like. Basically, any method may be used as long as the desired projection portion and depression portion are formed on the roller surface. The material may be similar to that of the heating roller of FIGS. 29B1 and 29B2.

In the method of FIGS. 29D1 and 29D2, it is necessary that the liquid does not enter between the recording body 41 and the sheet 90 which has the opening 91. For this purpose, for example, the recording body 41 and the sheet 90 are caused to adhere to one another using an adhesive, such as cold water, which does not damage the recording body material layer, does not change the liquid attraction state on the recording surface of the recording body 41 into the liquid repelling state, doe not change the liquid repelling state of the non-image area into the liquid attraction state, and a removable or soluble. Basically, any material can be used as the sheet 90, such as resin, metal, rubber, plastic, cloth, synthetic paper and so forth, as long as the material has liquid resistance and heat resistance, does not permit liquid penetration to the opposite surface, and maintains the mechanical strength even after forming the opening 91 therein.

Any method can be used as a method of forming the opening 92 in the sheet 90 such as cutting with a cutter or scissors, dies cutting with a cutter having the shape of the opening 92, melting with solvent or heat, molding with a die having an opening corresponding to the opening 92, and so forth, as long as the sheet 90 having the opening 92 therein can be formed.

By using the methods in the present invention in the twenty-first aspect, it is not necessary to heat the portion of the recording body recording surface corresponding to the margin when forming a latent image. Thereby, energy can be saved.

<Embodiment 21>

The recording body (41):

the recording body material layer: poly-fluoroalkyl-acrylates (LS317 of Asahi Glass Corporation); and the recording body base plate: a PET film, a sheet of 100 mm by 1000 mm, a thickness: 125 $\mu$m.

The recording agent: oil based ink: waterless ink (Aqualess Super (registered trademark) KB black M of Toyo Ink Mfg. Co., Ltd.).

The heating means (for forming a latent image): a thermal head (300 dpi, F2459A of Toshiba Corp.);

The heating means (for forming the ink attraction state): the heating roller (62, the shape being shown in FIG. 29B1), a roller made of aluminum with a built-in ceramic heater, 100° C. fixed, size: $\phi$55 mm, width 80 mm, (the image area: 80 mm by 150 mm)

The liquid-attraction-state forming liquid: ethylene glycol.

The recording body carrying speed when the master printing plate is produced: 30 mm/s.

The developing means: an ink roller of rubber (hardness: 60°).

The development speed: 500 mm/s.

The recording paper: PPC paper.

In the above-mentioned conditions, the heating roller 62 shown in FIG. 29B1 is caused to come into contact with the surface of the recording body opposite to the recording surface. At the same time, as shown in FIG. 29B2, the liquid 87 comes into contact with the recording surface of the recording body 41. In this conditions, the recording body 41 is carried in a thermostatic chamber. In the thermostatic chamber, ethylene glycol 87 of room temperature is contained. Thereby, only the portion of the surface of the recording body opposite to the recording surface corresponding to the image area 41A is in contact with the heating roller 62 and thus is heated. Then, the recording body, which has been carried out from the thermostatic chamber and has the liquid adhering thereto, is cooled by a fan, and a sponge-made wiping roller 73 absorbs the liquid which adheres to the recording body. Then, the recording body is cut to obtain a sheet of printing plate. Thus, the recording body master printing plate, only the image area of the recording surface of which is in the liquid attraction state, can be efficiently produced. Further, using the thus-produced recording body master printing plate, in accordance with the procedure of FIG. 13D and then FIG. 13E1, image recording is performed in an arrangement without the cleaning portion and the latent image erasing portion. As a result, a clear image can be obtained on the recording body. Further, as a result of transferring the developed image to the PPC paper, a good image is obtained in each of a direct transfer and an offset transfer.

Description of the Present Invention of the Twenty-second Aspect

FIGS. 30A through 30E2 illustrate the present invention in the twenty-second aspect. The figure shows methods of manufacture and renew of the recording body master printing plate. These methods solve the following problems in the invention in the twenty-first aspect. When the heating roller is used for causing only the image area to be in the liquid attraction state, and when manufacture and renewal of the recording body master printing plate is performed for a long time, the temperature of the liquid increases. Thereby, the portion of the recording body which is not heated by the heating roller, that is, the non-image area comes to be in the liquid attraction state. Further, when the sheet-shaped recording body comes into contact with the liquid, the liquid flows to the surface of the recording body opposite to the recording surface. Accordingly, it is necessary that the heating roller has liquid resistance. Further, because the liquid directly comes into contact with the heating roller, the liquid evaporates and the quality of the liquid changes. When the sheet with the opening is used, many processes, such as manufacturing the sheet, causing the sheet to adhere to the recording body, removing the sheet from the recording body, should be performed. Thus, time and costs are required.

In order to solve these problems, in the present invention in the twenty-second aspect, the entire recording surface of the recording body is previously in the liquid attraction state. Then, the portion excluding the image area is heated in a dry condition. Thereby, only the image area remains in the liquid attraction state. Specifically, the entire recording surface of the recording body 41 is caused to be in the liquid attraction state in either one of the methods of the present invention in the nineteenth and twentieth. Then, only the hatched area (non-image area) 41B in FIG. 30A is heated in a condition where the recording body is not in contact with the contact member.

Methods for heating the non-image area 41B will now be described. In the method shown in FIGS. 30B1 and 30B2, a roller $\mathbf{62}_1$ and a roller $\mathbf{62}_2$ are used. The roller $\mathbf{62}_1$ is used for heating the margin areas which extend in the recording body carrying direction. The roller $\mathbf{62}_2$ is used for heating the margin areas which extend in the direction perpendicular to the recording body carrying direction. The roller $\mathbf{62}_1$ is always in contact with the recording body 41. The roller $\mathbf{62}_2$ is in contact with the margin area of the recording body and is detached from the margin area of the recording body 41. In these conditions, the recording body is carried. Thereby, only the image area remains in the liquid attraction state. Another method is shown in FIGS. 30C1 and 30C2. In this method, a heating roller 62 having a projection portion corresponding to the non-image area and a depression portion corresponding to the image area is used. This heating roller 62 heats only the non-image portion. The recording body 41 is carried in a condition where this 62 roller is in contact with the recording surface of the recording body 41. Thereby, only the image area remains in the liquid attraction state. Another method is shown in FIGS. 30D1 and 30D2. In this method, a heater 95 which has an opening 94 corresponding to the image area 41A is used. Thereby, the heater 95 only heats the non-image area when the heater 95 is placed on the recording surface of the recording area in a condition where the opening 94 is aligned with the image area 41A. The heater 95 is in contact with the recording surface of the recording body 41, and the recording body is carried for one sheet of a printing plate. Thereby, only the non-image area is heated, and thus, only the image area remains in the liquid attraction state. Another method is shown in FIGS. 30E1 and 30E2. In the method, a heat insulating material 96 corresponding to the image area 41A is used. Then, the heat insulating material 96 is caused to adhere to the recording surface or the surface opposite to the recording surface of the recording body 41 or is provided in proximity to the recording surface of the recording body. The position of adhering or providing in proximity corresponds to the image portion. Then, hot air 97 is blown to the recording body 41 from the heat insulating material 96 side. In this condition, the recording body 41 is carried. Thereby, only the non-image area is heated, and thus, only the image area remains in the liquid attraction state. Further, any method can be used as long as only the non-image area is heated. By using such a method, manufacture and renewal of the recording body master printing plate is performed.

In the method shown in FIGS. 30B1 and 30B2, it is necessary that the arrangement is such that bending of the recording body 41 and thereby occurrence of position shift of the recording body 41 in response to the heating roller $\mathbf{62}_2$ coming into contact with the recording body 41 and being detached from the recording body 41 are prevented. Basically, any material can be used as the heating rollers, such as resin, metal, rubber, plastic, and so forth, as long as the material has heat resistance and is not substantially deformed when the rollers are caused to come into contact with the recording body.

In the method shown in FIGS. 30C1 and 30C2, it is necessary that the depth of the depression portion with respect to the projection portion 62*a* is in a range such that the depression portion does not come into contact with the recording body 41. The projection and depression portions of the roller surface may be made by shaving, molding an entire roller, bonding a molded sheet or a hollow member onto a roller, or the like. Basically, any method may be used as long as the desired projection portion and depression portion are formed on the roller surface. The material may be similar to that of the heating roller of FIGS. 30B1 and 30B2.

In the method shown in FIGS. 30D1 and 30D2, it is necessary that the carrying of the recording body is performed in a manner in which the heater 95 and the recording body 41 are not rubbed with one another and thus the recording body recording surface is not damaged. Accordingly, the heater 95 is set so as to be vertically movable, and the position of the heater 95 is controlled in timing of heating and carrying of the recording body. It is preferable that the temperature of the heater 95 is controlled so that the temperature of the recording body recording surface is an appropriate temperature in which the receding contact angle of the recording body recording surface increases. Any heater material can be used as the heater 95, such as ceramic, metal, and so forth, as long as the opening 94 can be formed.

In the methods of FIGS. 30E1 and 30E2, it is necessary an arrangement is made so that the hot air does not enter between the recording body 41 and the heat insulating material 96. When the recording body 41 and the heat insulating material 96 are caused to adhere to one another, an adhesive, such as cold water, which does not damage the recording body material layer, does not change the liquid attraction state of the image area of the recording body 41 into the liquid repelling state, doe not change the liquid repelling state of the non-image area into the liquid attraction state, and a removable or soluble can be used. Basically, any material can be used as the insulating material 96, such as resin, metal, rubber, plastic, cloth, synthetic paper and so forth, as long as the material has heat resistance.

<Embodiment 22>

The recording body (41):

the recording body material layer: poly-fluoroalkyl-acrylates (LS317 of Asahi Glass Corporation); and the recording body base plate: a PET film, a sheet of 100 mm by 1000 mm, a thickness: 125 $\mu$m.

The recording agent: oil based ink: waterless ink (Aqualess Super (registered trademark) KB black M of Toyo Ink Mfg. Co., Ltd.).

The heating means (for forming a latent image): a thermal head (300 dpi, F2459A of Toshiba Corp.);

The heating means (for forming the ink attraction state): the heating roller (62, the shape being shown in FIG. 30C1 having the depression portion), a roller made of aluminum with a built-in ceramic heater, 100° C. fixed, size: $\phi$55 mm, width 100 mm, depression portion: $\phi$50 mm, width 80 mm, the image area (depression portion): 80 mm by 150 mm.

The liquid-attraction-state forming liquid: ethylene glycol.

The recording body carrying speed when the master printing plate is produced: 30 mm/s.

The developing means: an ink roller of rubber (hardness: 60°).

The development speed: 500 mm/s.

The recording paper: PPC paper.

In the above-mentioned conditions, the heating roller 62 shown in FIG. 30C1 having the depression and projection portions formed on the circumference surface thereof corresponding to the image area and non-image area, is caused to come into contact with the surface of the recording body opposite to the recording surface. In this condition, the recording body master printing plate, which has the entire recording surface thereof in the ink attraction state, is carried. Thereby, only the non-image area is heated. Then, the recording body is cut to obtain a sheet of printing plate. Thus, the recording body master printing plate, only the image area of the recording surface of which is in the liquid attraction state, can be efficiently produced. Further, using the thus-produced recording body master printing plate, in accordance with the procedure of FIG. 13D and then FIG. 13E1, image recording is performed in an arrangement without the cleaning portion and the latent image erasing portion. As a result, a clear image can be obtained on the recording body. Further, as a result of transferring the developed image to the PPC paper, a good image is obtained in each of a direct transfer and an offset transfer.

Description of the Present Invention in the Twenty-third Aspect

Figure 31A:
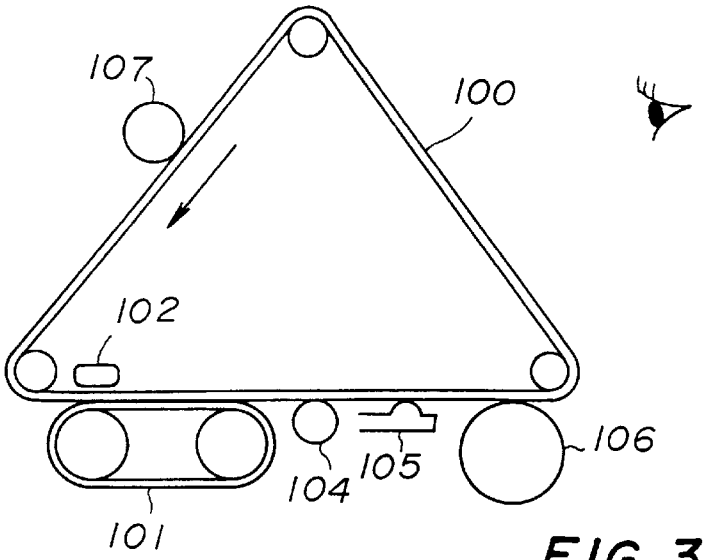
FIGS. 31A, 31B and 31C illustrate the present invention in a twenty-third aspect.

FIG. 31A shows an entire arrangement for illustrating an image recording and indicating apparatus in an embodiment of the present invention in the twenty-third aspect. First, the recording surface of the recording body 100 is heated in a condition where a liquid or a silicon rubber belt is in contact with the recording surface of the recording body 100. Thereby, the entire recording surface of the recording body 100 is in the liquid attraction state. A method of being in contact with the liquid or the silicon rubber belt is that a liquid impregnated sponge belt or a silicon belt 101 is used. Further, as the heating means, a contact heating source such as a ceramic heater, thermal head or the like, or a non-contact heating source such as a halogen lamp, a xenon lamp, a laser or the like is used. In a case where the sponge belt impregnated with liquid is used, droplets of the liquid adhering to the recording body recording surface are removed using a wiping roller 104, in the subsequent process.

Then, only the non-image portion of the recording surface of the recording body 100 is heated in a condition where the recording surface is not in contact with liquid. Thus, a latent image is formed on the recording surface of the recording body 100. As the heating means, a thermal head 105, a ceramic heater, laser or the like is used.

Then, the recording surface of the recording body 100 is developed with a developing roller 106. Thereby, ink adheres to only the image portion.

By performing the above-described processes, an image is formed on the recording surface of the recording body 100. Thus, as shown in FIG. 31C, the image is indicated.

Then, the ink adhering to the image portion of the recording body recording surface is removed using cleaning means 107. Then, again, the entire recording surface of the recording body is caused to be in the liquid attraction state. Thus, different images can be indicated one by one. As the ink removing means, in a case where a water based ink is used, a cleaning roller impregnated with water is used. In a case where an oil based ink is used, a cleaning roller impregnated with solvent such as N-alcane or the like, is used.

Figure 31B:
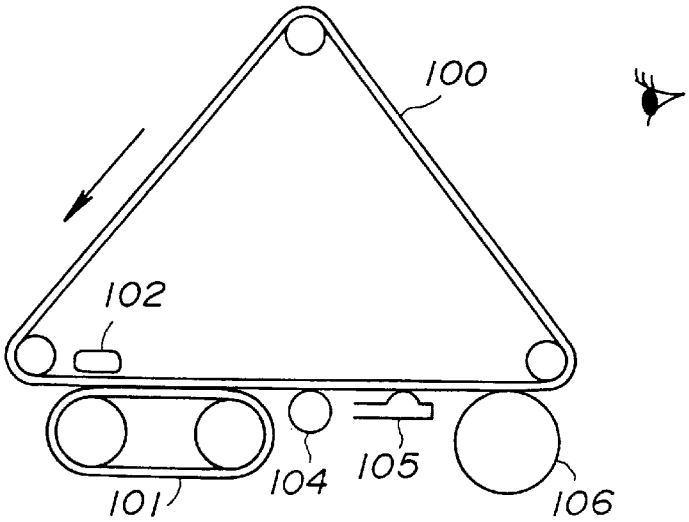
Figure 31C:
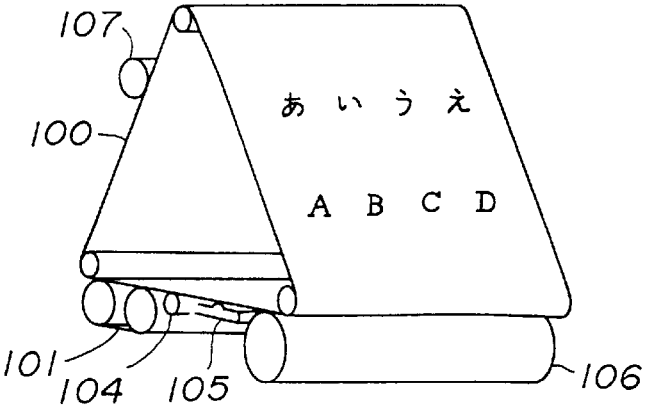

FIG. 31B shows an arrangement in which the sponge belt 101 impregnated with liquid is commonly used as the mechanism for causing the entire recording surface of the recording body to be in the liquid attraction state and used as the mechanism for removing ink from the recording body recording surface.

<Embodiment 23>

In the embodiments which will be described, as the recording body 100, a matted PET (color: transparent, thickness: 125 $\mu$m) with poly-fluoroalkyl-acrylates (LS317 of Asahi Glass Corporation) coated on the matted PET is used. In a case where a laser is used as the latent image forming mechanism, carbon is contained in the recording body in order to improve light absorbing performance thereof.

<Embodiment 23-1>

The apparatus arrangement shown in FIG. 31A is used. When image indication is repeated in the following conditions, different images can be well indicated:

Conditions (1) The recording body recording surface liquid attraction state forming portion:
liquid: water;
liquid supplying means: a sponge roller;
heating means: a ceramic heater.

(2) Droplet wiping portion:
a sponge roller.

(3) Latent image forming portion:
a thermal head.

(4) Developing portion:
ink: i) oil based ink, ii) water based ink;
a developing roller: a fluorine-contained-rubber roller.

(5) Ink removing portion:
liquid: i) tetradecane in the case of the oil based ink;
ii) water in the case of the water based ink.

<Embodiment 23-2>

The apparatus arrangement shown in FIG. 31B is used. When image indication is repeated in the following conditions, different images can be well indicated:

Conditions (1) The recording body recording surface liquid attraction state forming and ink removing portion:
liquid: i) tetradecane heated to 80° C. in the case of oil based ink;
ii) water heated to 80° C. in the case of water based ink;
liquid supplying means: a sponge roller;
heating means: a ceramic heater.

(2) Droplet wiping portion:
a sponge roller.

(3) Latent image forming portion:
a thermal head.

(4) Developing portion:
ink: i) oil based ink, ii) water based ink;
a developing roller: a fluorine-contained-rubber roller.

Description of the Present Invention of the Twenty-fourth Aspect

Figure 32A:
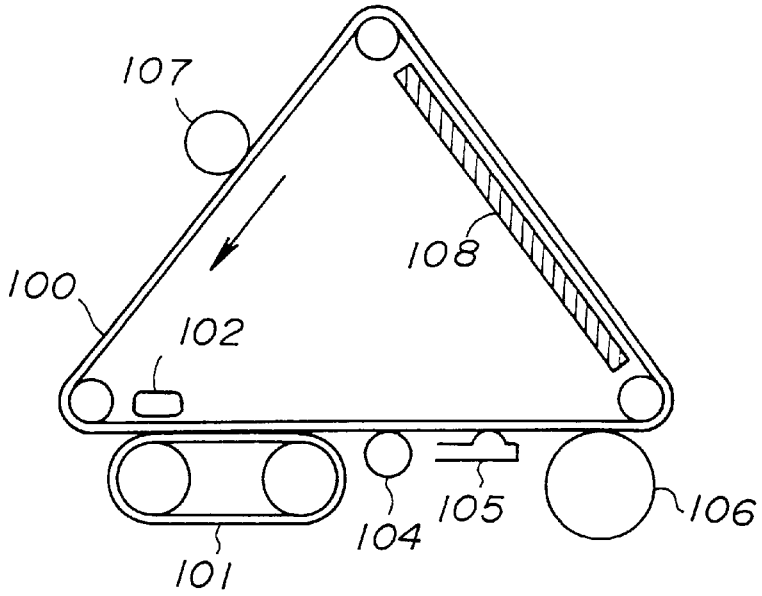
FIGS. 32A and 32B illustrate the present invention in a twenty-fourth aspect.
Figure 32B:
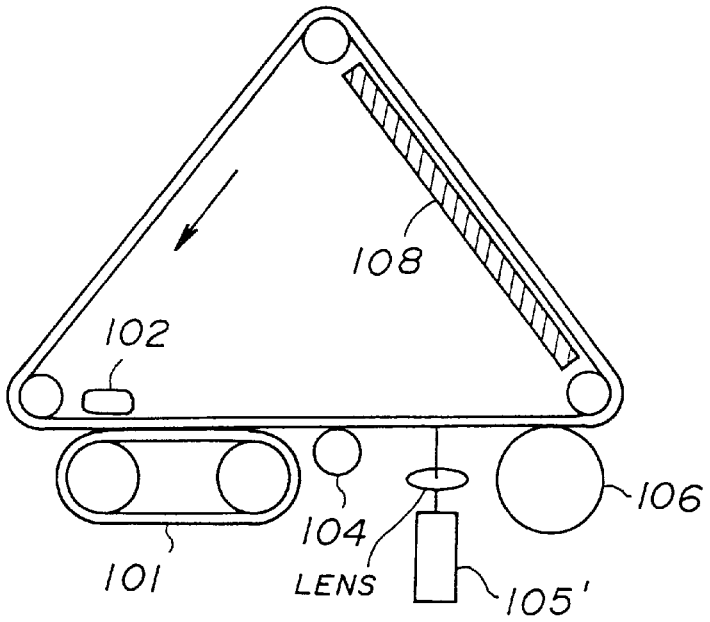
Figure 33A:
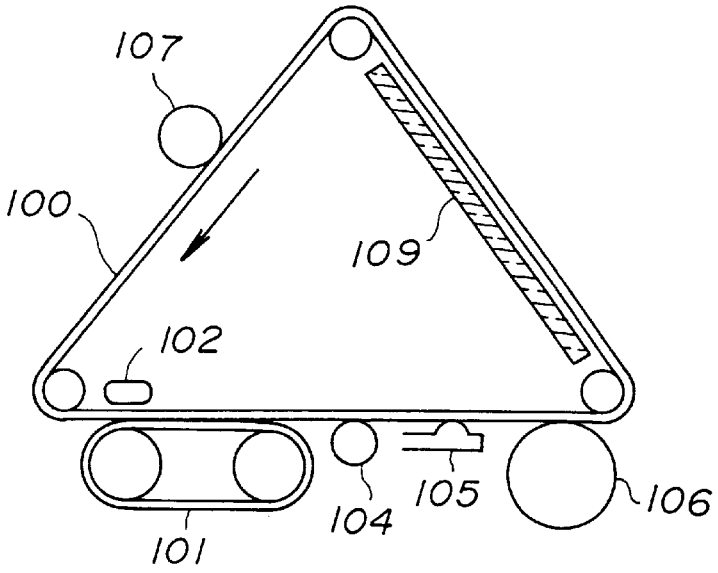
FIGS. 33A and 33B illustrate the present invention in a twenty-fourth aspect.
Figure 33B:
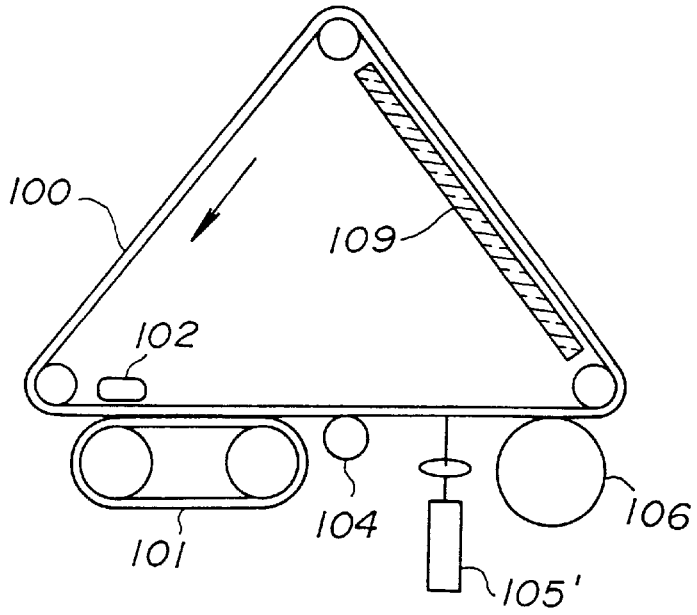

FIGS. 32A and 32B illustrate the present invention in the twenty-fourth aspect. In the present invention in the twenty-fourth aspect, a light emitting mechanism 108 is provided at the rear side of the recording body 100 in the image recording and indicating apparatus in the present invention in the twenty-second aspect shown in FIGS. 31A and 31B. FIGS. 33A and 33B shows the image recording and indicating apparatus in which a reflecting mechanism 109 is provided instead of the light emitting mechanism 108. Further, FIGS. 32A and 33A show examples in which the thermal heater 105 is used. FIGS. 32B and 33B show examples in which the a laser 105' is used. In each of the arrangements shown in FIGS. 32A, 32B and FIGS. 33A, 33B, the transparent non-image portion is bright. Thereby, the contrast between the image portion and the non-image portion is improved. As the light emitting mechanism, a fluorescent tube, a xenon tube, a halogen lamp, an LED, or the like is used. As the reflecting mechanism, a mirror, or a film or a plate on which metal such as aluminum is evaporated and deposited is used.

<Embodiment 24-1>

The apparatus arrangement shown in FIG. 32A is used. When image indication is repeated in the following conditions, different images can be brightly and clearly indicated:

Conditions (1) The recording body recording surface liquid attraction state forming portion:
liquid: ethylene glycol;
liquid supplying means: a sponge roller;
heating means: a ceramic heater.

(2) Droplet wiping portion:
a sponge roller.

(3) Latent image forming portion:
a thermal head.

(4) Developing portion:
ink: i) oil based ink, ii) water based ink;
a developing roller: a fluorine-contained-rubber roller.

(5) Ink removing portion:
liquid: i) tetradecane in the case of the oil based ink;
ii) water in the case of the water based ink.

(6) Light emitting portion:
a fluorescent lamp.

<Embodiment 24-2>

The apparatus arrangement shown in FIG. 32B is used. When image indication is repeated in the following conditions, different images can be brightly and clearly indicated:

Conditions (1) The recording body recording surface liquid attraction state forming and ink removing portion:
liquid: i) tetradecane heated to 80° C. in the case of oil based ink;
ii) water heated to 80° C. in the case of water based ink;
liquid supplying means: a sponge roller;
heating means: a ceramic heater.

(2) Droplet wiping portion:
a sponge roller.

(3) Latent image forming portion:
a semiconductor laser (wavelength: 830 nm, power: 30 mW).

(4) Developing portion:
ink: i) oil based ink, ii) water based ink;
a developing roller: a fluorine-contained-rubber roller.

(5) Light emitting portion:
a fluorescent lamp.

<Embodiment 24-3>

The apparatus arrangement shown in FIG. 33A is used. When image indication is repeated in the following conditions, different images can be brightly and clearly indicated:

Conditions (1) The recording body recording surface liquid attraction state forming portion:
liquid: diethylene glycol;
liquid supplying means: a sponge roller;
heating means: a halogen lamp.

(2) Droplet wiping portion:
a sponge roller.

(3) Latent image forming portion:
a thermal head.

(4) Developing portion:
ink: i) oil based ink, ii) water based ink;
a developing roller: a fluorine-contained-rubber roller.
(5) Ink removing portion:
liquid: i) tetradecane in the case of the oil based ink; ii) water in the case of the water based ink.
(6) Reflecting portion:
an aluminum deposited acrylic polymer plate.

<Embodiment 24-4>

The apparatus arrangement shown in FIG. 33B is used. When image indication is repeated in the following conditions, different images can be brightly and clearly indicated:

Conditions (1) The recording body recording surface liquid attraction state forming and ink removing portion:
liquid: i) tetradecane heated to 80° C. in the case of oil based ink;
ii) water heated to 80° C. in the case of water based ink;
liquid supplying means: a sponge roller;
heating means: a ceramic heater.
(2) Droplet wiping portion:
a sponge roller.
(3) Latent image forming portion:
a semiconductor laser (wavelength: 830 nm, power: 30 mW).
(4) Developing portion:
ink: i) oil based ink, ii) water based ink;
a developing roller: a fluorine-contained-rubber roller.
(5) Reflecting portion:
an aluminum deposited acrylic polymer plate.

The present invention is not limited to the above-described embodiments, and variations and modifications may be made without departing from the scope of the present invention claimed in the following claims.

What is claimed is:

1. An image forming apparatus, using a recording body which comprises a recording layer, which has characteristics such that a receding contact angle of a surface of said recording layer to a liquid decreases when the surface of said recording layer comes into contact with the liquid and is heated, and the receding contact angle of the surface of said recording layer increases when the surface of the recording layer in a condition where the receding contact angle thereof has decreased is heated in air, and a base plate, which supports said recording layer, said apparatus comprising:

in-liquid heating means for previously heating the entire surface of said recording layer in a condition in which the entire surface of said recording layer is in contact with the liquid;

in-air heating means for heating said recording layer in air partially in accordance with image information so as to form a latent image;

developing means for contacting recording agent with the surface of said recording layer, after said in air heating means has heated said recording layer, so as to develop the latent image and form a developed image; and transferring means for transferring the developed image on the surface of said recording layer to a recording paper sheet, wherein:

said recording material of said recording body contains water attraction material;

said apparatus further comprises liquid applying means for applying one of water and liquid which mainly includes water to said recording surface before developing by said developing means; and said developing means performs developing with oil based ink.

2. An image recording apparatus, using a recording body which comprises a recording layer, which has characteristics such that a receding contact angle of a surface of said recording layer to a liquid decreases when the surface of said recording layer comes into contact with the liquid and is heated, and the receding contact angle of the surface of said recording layer increases when the surface of the recording layer in a condition where the receding contact angle thereof has decreased is heated in air, and a base plate, which supports said recording layer, said apparatus comprising:

in-liquid heating means for previously heating the entire surface of said recording layer in a condition in which the entire surface of said recording layer is in contact with the liquid;

in-air heating means for heating said recording layer in air partially in accordance with image information so as to form a latent image;

developing means for contacting recording agent with the surface of said recording layer, after said in air heating means has heated said recording layer, so as to develop the latent image and form a developed image; and transferring means for transferring the developed image on the surface of said recording layer to a recording paper sheet, wherein:

said recording material of said recording body contains oil attraction material;

said apparatus further comprises oil applying means for applying oil to said recording surface before developing by said developing means; and said developing means performs developing with water based ink.

3. An image forming method, using a recording body which comprises a recording layer, which has characteristics such that a receding contact angle of a surface of said recording layer to a liquid decreases when the surface of said recording layer comes into contact with the liquid and is heated, and the receding contact angle of the surface of said recording layer increases when the surface of said recording layer in a condition where the receding contact angle thereof has decreased is heated in air, and a base plate, which supports said recording layer, said method comprising the steps of:

a) previously heating the entire surface of said recording layer in a condition in which the entire surface of said recording layer is in contact with the liquid so that said contact angle decreases; and b) heating a partial area of said recording layer in air, in accordance with image information so as to form a latent image, and so that said contact angle increases in the partial area.

4. An image forming apparatus, using a recording body which comprises a recording layer, which has characteristics such that a receding contact angle of a surface of said recording layer to a liquid decreases when the surface of said recording layer comes into contact with the liquid and is heated, and the receding contact angle of the surface of said recording layer increases when the surface of the recording layer in the condition where the receding contact angle thereof has decreased is heated in air, and a base plate, which supports said recording layer, said apparatus comprising:

in-liquid heating means for previously heating the entire surface of said recording layer in a condition in which the entire surface of said recording layer is in contact with the liquid so that said contact angle decreases;

in-air heating means for heating a partial area of said recording layer in air, in accordance with image information so as to form a latent image, and so that said contact angle increases in the partial area; and developing means for contacting recording agent with the surface of said recording layer, after said in air heating means has heated said recording layer, so as to develop the latent image and form a developed image; and transferring means for transferring the developed image on the surface of said recording layer to a recording paper sheet.

5. An image forming apparatus, using a recording body which comprises a recording layer, which has characteristics such that a receding contact angle of a surface of said recording layer to a liquid decreases when the surface of said recording layer comes into contact with the liquid and is heated, and the receding contact angle of the surface of said recording layer increases when the surface of said recording layer in a condition where the receding contact angle thereof has decreased is heated in air, and a base plate, which supports said recording layer, said apparatus comprising:

in-liquid heating means for previously heating the entire surface of said recording layer in a condition in which the entire surface of said recording layer is in contact with the liquid so that said contact angle decreases;

in-air heating means for heating a partial area of said recording layer in air, in accordance with image information so as to form a latent image, and so that said contact angle increases in the partial area; and developing means for contacting recording agent with the surface of said recording layer, after said in-air heating means has heated said recording layer, so as to develop the latent image and form a developed image.

6. The image forming apparatus according to claim 5, further comprising lighting means provided at a rear side of said recording body so as to light said developed image from the rear side of said recording body, wherein said rear side is a side opposite to a side to which the recording agent adheres after development.

7. An image recording and indicating apparatus using a recording body which comprises a recording layer, which has characteristics such that a receding contact angle of a surface of said recording layer to a liquid decreases when the surface of said recording layer comes into contact with the liquid and is heated, and the receding contact angle of said recording layer increases when the surface of said recording layer in a condition where the receding contact angle thereof has decreased is heated in air, and a base plate, which supports said recording layer, and also using a contact member selected from among liquid, steam, and a solid which becomes liquid or generates liquid or steam at a temperature not greater than the receding contact angle decrease starting temperature of the surface of said recording layer, said apparatus comprising:

means for previously heating said recording layer in one of two conditions, a first condition where said recording layer is in contact with said contact member, and a second condition where said recording layer comes into contact with said contact member in a condition where said recording layer is heated, so as to cause the receding contact angle of the entire surface of said recording layer to decrease and cause the entire surface of said recording layer to be in a liquid attraction state by heating the entire surface of said recording layer in a condition in which the entire surface of said recording layer is in contact with the liquid so that said contact angle decreases;

means for heating a non-image portion of the surface of said recording layer selectively in accordance with image information in a condition where said recording layer is out of contact with said contact member, so as to form a latent image, by heating a partial area of said recording layer in air, in accordance with the image information so as to form the latent image, and so that said contact angle increases in the partial area;

means for developing said latent image on the surface of said recording layer with coloring material; and means for removing the coloring material from the surface of said recording layer.

8. The image recording and indicating apparatus according to claim 7, further comprising one of a light emitting device and a light reflecting member at a rear side of said recording body, wherein said rear side is a side opposite to a side to which the recording agent adheres after development.

9. An image forming method, using a recording body which comprises a recording layer, which has characteristics such that a receding contact angle of a surface of said recording layer to a liquid decreases when the surface of said recording layer comes into contact with the liquid and is heated, and the receding contact angle of the surface of said recording layer increases when the surface in a condition where the receding contact angle thereof has decreased is heated in air, and a base plate, which supports said recording layer, said method also using a contact member selected from among liquid, steam, and a solid which becomes liquid or generates liquid or steam at a temperature not greater than the receding contact angle decrease starting temperature of the surface of said recording layer, said method comprising the steps of:

a) previously heating said recording layer in one of two conditions, a first condition where said recording layer is in contact with said contact member, and a second condition where said recording layer comes into contact with said contact member in a condition where said recording layer is heated, so as to cause the receding contact angle of the entire surface of said recording layer to decrease and cause the entire surface of said recording layer to be in a liquid attraction state by heating the entire surface of said recording layer in a condition in which the entire surface of said recording layer is in contact with the liquid so that said contact angle decreases; and b) heating a non-image portion of the surface of said recording layer selectively in accordance with image information in a condition where said recording layer is out of contact with said contact member, so as to form a latent image, by heating a partial area of said recording layer in air, in accordance with the image information so as to form the latent image, and so that said contact angle increases in the partial area.

10. The image recording method according to claim 9, wherein said recording body removably has said contact member holding layer on said recording surface which is in the liquid attraction state, when said recording body is preserved.

11. The image recording method according to claim 9, wherein said step b) comprises the steps of:

b-1) melting and transferring a recording agent of an original image sheet to a transparent film;

b-2) placing said transparent film on the surface of said recording layer;

b-3) exposing said recording body from said transparent film side so as to form the latent image on the surface of said recording layer.

12. The image recording method according to claim 9, wherein said step b) comprises-the steps of:

b-1) placing a thermochromic transparent film, having a thermochromic layer, on an original image sheet;

b-2) exposing said thermochromic transparent film and said original image sheet and forming on said thermochromic transparent film an image the same as the image of said original image sheet;

b-3) placing said thermochromic transparent film on the surface of said recording layer;

b-4) exposing said recording body from said thermochromic transparent film side so as to form the latent image on the surface of said recording layer.

13. The image recording method according to claim 9, wherein:

said recording body has a light absorbing layer in or on said base plate; and means for heating said recording layer is used, said means comprising optically heating means.

14. The image recording method according to claim 9, wherein:

said recording body has minute particles of a light absorbing member in said recording layer; and means for heating said recording layer is used, said means comprising optically heating means.

15. The image recording method according to claim 9, wherein said step a) causes only an image area defined on the surface of said recording layer to be in the liquid attraction state, a margin area being left not caused to be in the liquid attraction state.

16. The image recording method according to claim 9, further comprising the step c) of heating only a margin area defined on the surface of said recording layer in a condition in which said margin area is out of contact with said contact member, after said step a) and before said step b).

17. The image recording method according to claim 9, wherein said step b) comprises the steps of:

b-1) forming a non-light-transmitting image in one of two locations, a first location being in said base plate and a second location being on a surface of said base plate; and b-2) exposing the surface of said recording layer from said non-light-transmitting image side, so as to form the latent image on the surface of said recording layer, wherein said non-light-transmitting image acts as a shading mask for forming the latent image.

18. The image recording method according to claim 17, wherein said step b) comprises the steps of:

b-1) forming a non-light-transmitting image in one of two locations, a first location being in said base plate and a second location being on the surface of said base plate; and b-2) exposing said recording body from said image side, in a condition where said recording body removably has said contact member holding layer on the surface of said recording layer, so as to form the latent image on the surface of said recording layer.

19. The image recording method according to claim 9, said step b) comprises the steps of:

b-1) placing an original image paper sheet impregnated with liquid on one of a surface of said base plate and on the surface of said recording layer; and b-2) exposing said recording body from the original image paper sheet side so as to form a latent image on the surface of said recording layer.

20. The image recording method according to claim 19, wherein said step b-1) includes inserting a transparent liquid cut-off layer between said original image paper sheet and said recording layer.

21. The image recording method according to claim 9, wherein said step a) comprises the steps of:

a-1) causing the surface of said recording layer to be in contact with the liquid which has been heated to a temperature at least equal to the receding contact angle decrease starting temperature, the surface of said recording layer being in one of two states, a first state being a liquid repelling state and a second state in which an image is formed thereon; and a-2) cooling said recording body in a condition where said liquid is in contact with the surface of said recording layer.

22. The image forming method according to claim 21, wherein liquid for removing residual ink from said recording body is also used for causing the entire surface of said recording layer to be in the liquid attraction state, and means for cleaning said recording body includes cleaning-liquid heating means so that said cleaning means performs cleaning of said recording body and causing the entire surface of said recording layer to be in the liquid attraction state simultaneously.

23. The image recording method according to claim 21, including heating said recording body in a condition where liquid is in contact with said recording surface of said recording body using a removable liquid layer holding means, and cooling the recording body in said condition.

24. The image recording method according to claim 23, wherein said removable liquid layer holding means is transparent and a heating source for heating said recording surface of said recording body comprises optical means.

* * * * *